US005255904A

United States Patent [19]

Taguchi et al.

[11] Patent Number: 5,255,904

[45] Date of Patent: Oct. 26, 1993

[54] FEEDER OR IMAGE FORMING APPARATUS

[75] Inventors: Kazushige Taguchi, Warabi; Hiroshi Takahashi, Kawasaki; Kazunori Bannai, Tokyo; Tetsuya Fujioka, Yokohama; Fumio Kishi, Yokohama, all of Japan

[73] Assignee: Ricoh Company, Ltd., Tokyo, Japan

[21] Appl. No.: 795,021

[22] Filed: Nov. 20, 1991

[51] Int. Cl.[5] ..... B65H 3/18

[52] U.S. Cl. ..... 271/18.1; 271/34

[58] Field of Search ..... 271/9, 18.1, 34, 35, 271/94, 95

[56] References Cited

U.S. PATENT DOCUMENTS

| | | | |
|---|---|---|---|
| 3,260,520 | 7/1966 | Sugden | 271/34 X |
| 3,405,935 | 10/1968 | MacNeill | 271/95 X |
| 3,726,520 | 4/1973 | Doi | 271/18.1 X |
| 3,926,427 | 12/1975 | Moksness | 271/95 X |
| 3,963,339 | 6/1976 | Taylor | 271/34 X |
| 4,625,954 | 12/1986 | Pusey | 271/9 |
| 4,688,782 | 8/1987 | Browne | 271/9 |
| 4,826,148 | 5/1989 | Coons | 271/9 X |
| 5,090,676 | 2/1992 | Matsuno | 271/270 X |

FOREIGN PATENT DOCUMENTS

| | | | |
|---|---|---|---|
| 195065 | 11/1982 | Japan | 271/287 |
| 212673 | 9/1988 | Japan | 270/52 |
| 92173 | 4/1989 | Japan | 270/58 |

*Primary Examiner*—Richard A. Schacher

*Attorney, Agent, or Firm*—Oblon, Spivak, McClelland, Maier & Neustadt

[57] ABSTRACT

A feeder of an image forming apparatus which includes a storing device for storing a stack of recording mediums and an endless belt to be used in the conveyance of a recording medium to an image forming section of the apparatus. A speed control device is provided for varying the speed of the endless belt driven by a driving device when a portion of the endless belt passes the storing device. Also provided are a plurality of pickup rollers which are disposed adjacent to the endless belt in correspondence with each respective storage device for moving the endless belt into engagement with a foremost recording medium in the storing device in order to convey the recording medium to the image forming section.

24 Claims, 53 Drawing Sheets

| |
|---|
| Fig. 32A |
| Fig. 32B |
| Fig. 32C |

| Fig. 35A |
| --- |
| Fig. 35B |

| Fig. 41A | Fig. 41B |
|---|---|

| |
|---|
| Fig. 51A |
| Fig. 51B |

PB BELT DRIVE MOTOR

PAPER FEEDING UNIT DRIVE MOTOR

PB BELT SPEED CHANGING MOTOR

HIGH VOLTAGE POWER SOURCE B (FREQUENCY)

PB PAPER FEEDING SENSOR

SPEED OF PAPER FEEDING FACE

FEEDER OR IMAGE FORMING APPARATUS

BACKGROUND OF THE INVENTION

1. Field of the Invention

The present invention relates to a feeder for feeding a recording medium in an image forming apparatus such as a copying machine, a laser printer, a facsimile, etc.

2. Description of the Related Art

In a known image forming apparatus such as a copying machine, a sheetlike recording medium such as a sheet of transfer paper is fed by the friction of a roller made of rubber and is conveyed by a pair of rubber rollers, a belt, etc. to an image forming position such as a transfer position with respect to a photosensitive body.

In such a general feeder for feeding and conveying the recording medium, a frictional pad is combined with the feed roller made of rubber to prevent a plurality of recording media from being fed in an overlapping state. A reversing roller made of rubber may be combined with the feed roller to turn the recording media upside down. Further, a corner claw may be disposed in a cassette for storing the recording media. However, in a general recording system, a recording medium is jammed and slantingly fed in a feeding operation thereof. Accordingly, the general feeder has problems about reliability of the feeding and conveying operations of the recording medium in addition to the overlap-feeding operation of the recording media.

Further, the general feeder has a complicated structure and a control operation of the general feeder is complicated so that cost of the feeder is increased. Accordingly, no problems about the simplified structure and the reduction in cost are solved in the general feeder.

To solve these problems about the general feeder, an insulating endless belt is approximately wound around an entire conveying system disposed within the copying machine and is charged by a charging means. A sheet of paper stored in a paper feeding tray is fed by a paper feed roller coaxially disposed with a belt support roller. Thereafter, the sheet of paper is electrostatically adsorbed to the belt. Otherwise, the belt directly comes in contact with the sheet of paper. Thus, the sheet of paper is fed by the belt in a state in which the sheet of paper is electrostatically adsorbed to the belt. Simultaneously, the sheet of paper comes in contact with the photosensitive body and is conveyed by the belt to a transfer region for performing a transfer operation. For example, such a structure is proposed and shown in Japanese Patent Application Laying Open (KOKAI) Nos. 59-212856, 59-224858 and 59-229585, etc.

However, in such a general structure, the sheet of paper is fed by a frictional contact between the paper feed roller and the sheet of paper when the sheet of paper stored in the paper feeding tray is fed out of this tray by the paper feed roller coaxially disposed with a drive shaft of the insulating endless belt. Accordingly, the sheet of paper is slantingly fed in a certain case. When some sheets of paper are simultaneously fed in an overlapping state, a first or upper sheet of paper is conveyed in a state in which the first sheet of paper is electrostatically adsorbed to the belt. In contrast to this, lower second and subsequent sheets of paper fed together with the first sheet of paper are projected from a front end of the paper feeding tray. Therefore, a paper jam is caused when the next paper feeding operation is performed.

Further, paper powder is generated by the above frictional contact so that an error in the paper feeding operation is caused and a reduction in image quality is caused when an image is formed.

When the sheet of paper stored in the paper feeding tray is directly fed by the charged insulating endless belt, the belt comes in contact with the sheet of paper in a state in which the belt is moved and turned in the normal image formation. Accordingly, a contact state between the belt and the sheet of paper becomes unstable unless tension of the belt, a lowering state of the belt, and loading and arranging states of the sheet of paper are uniformed with considerable accuracy. In such a case, the sheet of paper tends to be slantingly fed.

It is necessary to arrange the belt and the sheet of paper within the feeder with high accuracy so as to stabilize the contact state between the belt and the sheet of paper.

The belt and the paper feed roller come in contact with the first sheet of paper in a turning state between the first and second sheets of paper (i.e., the upper and lower sheets of paper). Therefore, frictional force having a certain strength is caused so that there is a fear of generation of the overlap-feeding operation of sheets of paper.

Further, the belt in the turning state comes in contact with the sheet of paper although no sheet of paper is separated and discharged by friction. Accordingly, frictional force is caused in a discharging portion of the sheet of paper, thereby generating a certain amount of paper powder.

As mentioned above, a conveying state of the sheet of paper from the paper feeding tray is not constant and reliable at any time although the paper feed roller or the belt is used as a paper feeding means. Accordingly, it is necessary to dispose a resisting means for adjusting positions of a front end of the paper sheet and a front end of an image copied on the paper sheet and correcting an inclination of the paper sheet. Therefore, the general feeder has a complicated structure and a control operation of the general feeder is complicated.

A paper feeding section of the copying machine, a resisting section, a transfer section, a fixing section and a paper discharging section are sequentially connected to each other through a single endless belt. First, the endless belt comes in press contact with a sheet of copying paper held by the copying paper feeding section. The sheet of copying paper is then discharged by frictional force from the copying paper feeding section. After a resisting operation of the sheet of paper, the sheet of paper is conveyed to an image forming region. For example, such a structure is proposed and shown in Japanese Patent Application Laying Open (KOKAI) No. 63-139846. In this paper feeder, when a sheet of paper stored in the copying paper feeding section such as a paper feeding tray is fed by the belt, the paper feed roller separates the sheet of paper therefrom by a frictional contact and feeds this sheet of paper. Accordingly, the sheet of paper is slantingly fed and some sheets of paper are fed together in an overlapping state in a certain case. Further, paper powder is caused by the frictional contact. Therefore, an error in the paper feeding operation is caused and a reduction in image quality is caused when an image is formed. A feeding state of the sheet of paper from the paper feeding tray is not constant and reliable at any time. Accordingly, it is necessary to dispose a resisting means for adjusting positions of a front end of the paper sheet and a front end of the image copied on the paper sheet and correcting an inclination of the paper sheet. Therefore, this general feeder has a complicated structure and a control operation of this feeder is complicated.

SUMMARY OF THE INVENTION

It is therefore an object of the present invention to provide a feeder of an image forming apparatus in which the slanting and overlap-feeding operations of a recording medium such as a sheet of paper and a jam thereof are prevented without any resisting means.

The above object of the present invention can be achieved by a feeder of an image forming apparatus comprising means for storing a recording medium for recording an image; and endless conveying means for attracting and conveying the recording medium from the storing means to a predetermined position; the endless conveying means being formed such that only one portion of the endless conveying means can be moved in at least one of horizontal and vertical directions except for an entire conveying movement of the endless conveying means and a feeding speed of the endless conveying means can be changed.

In accordance with the above structure in the present invention, the endless conveying means conveys and moves the recording medium at a constant speed. In this case, only one portion of the endless conveying means is additionally moved in the horizontal or vertical direction, or is additionally moved simultaneously in the horizontal and vertical directions. A relative speed of the endless conveying means with respect to a stationary member such as the recording medium is locally decelerated, or the endless conveying means is stopped or moved in a reverse direction in accordance with the selection of a moving speed of the one portion of the endless conveying means.

When the endless conveying means comes in contact with the recording medium in a state in which the relative speed is equal to zero, it is possible to feed the recording medium in a storing state thereof. In the case, there is no relative shift in position between the endless conveying means and the recording medium.

When an alternating electric field pattern is formed on the conveying means to attract the recording medium, the conveying means adsorbs only an uppermost sheet of the recording medium coming in contact with this conveying means. No adsorbing force is applied to a second or subsequent sheet of the recording medium. Accordingly, it is possible to prevent the recording medium from being fed in an overlapping state.

Further objects and advantages of the present invention will be apparent from the following description of the preferred embodiments of the present invention as illustrated in the accompanying drawings.

DESCRIPTION OF THE PREFERRED EMBODIMENTS

The preferred embodiments of a feeder of an image forming apparatus in the present invention will next be described in detail with reference to the accompanying drawings.

Figure 1:
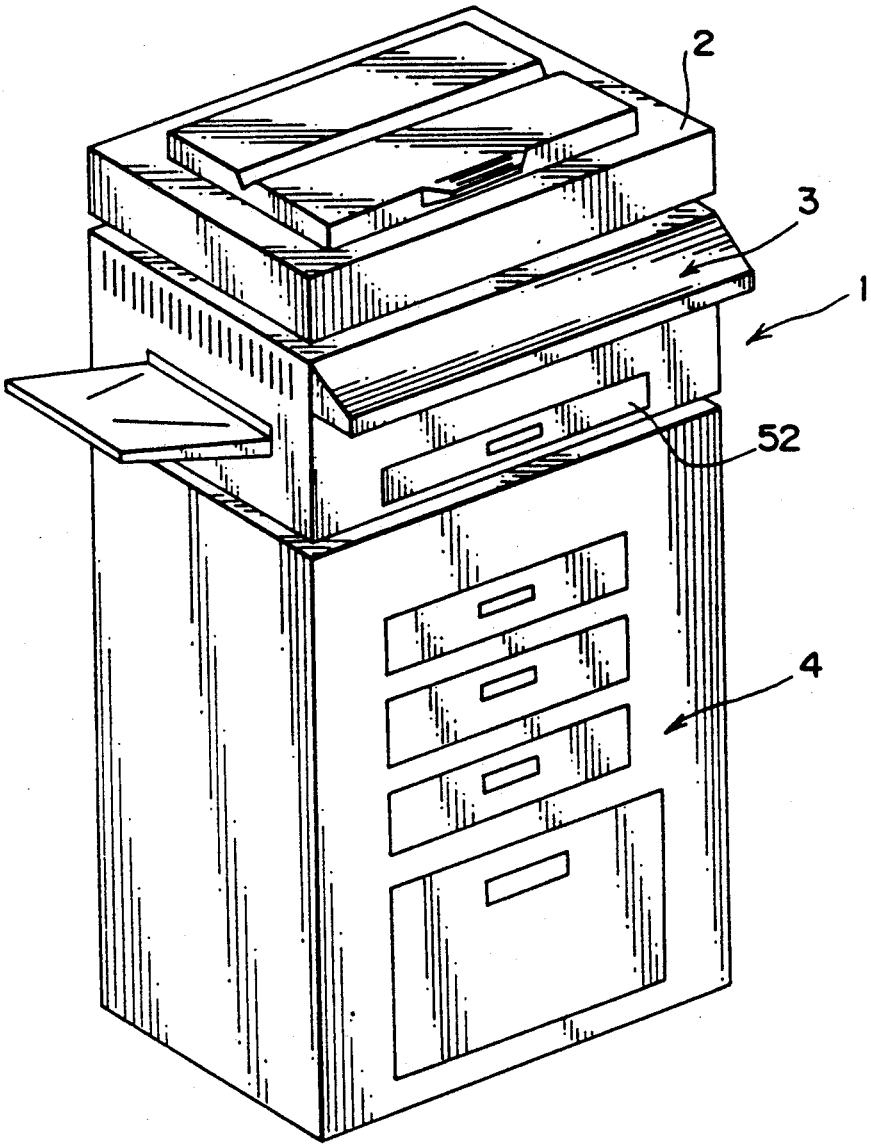
FIG. 1 is a perspective view showing an entire image forming apparatus in accordance with one embodiment of the present invention.

FIG. 1 shows a copying machine 1 as an image forming apparatus in accordance with one embodiment of the present invention. The copying machine 1 has a scanner 2, a copying body 3 and a paper bank device 4. The scanner 2 reads an image of an original. The copying body 3 has an image forming section for forming an image by information from the scanner 2. The paper bank device 4 stores many recording media such as sheets of recording paper for recording the image. The copying body 3 is arranged on the paper bank device 3 and the scanner 2 is arranged on the copying body 3.

Figure 2:
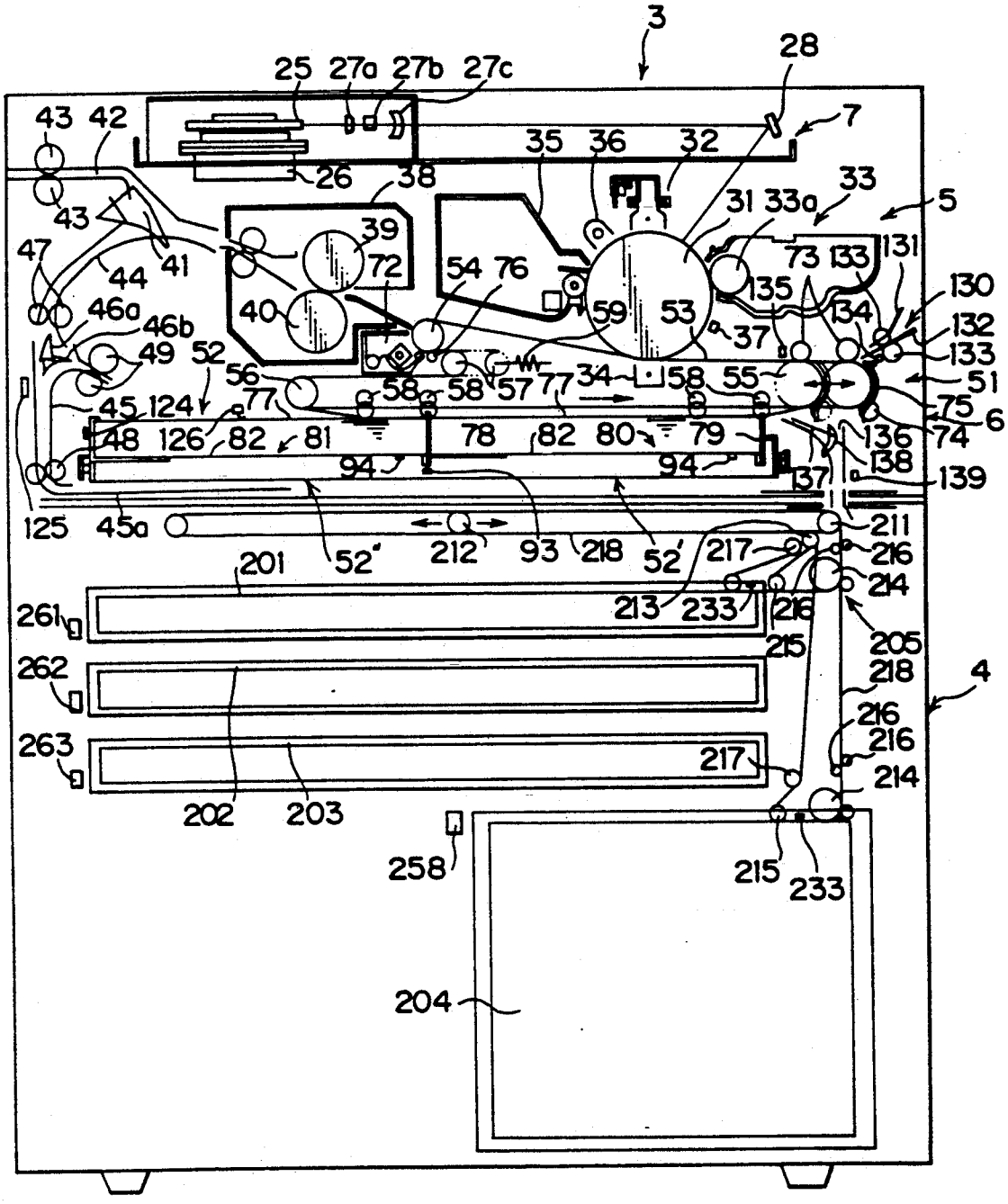
FIG. 2 is a front view showing a schematic structure of the image forming apparatus.

In FIG. 2, the copying body 3 has an image forming section 5 and a paper feeder 6.

Figure 3:
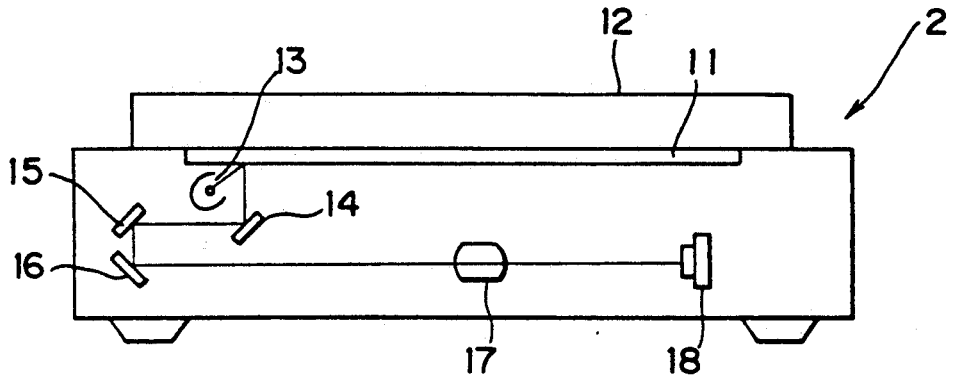
FIG. 3 is a schematic view for explaining a scanner.

As shown in FIGS. 1 and 3, the scanner 2 arranged on the copying body 3 is separated from the copying body 3 as one example. However, the scanner 2 and the copying body 3 can be constructed by as an integral structure.

The scanner 2 has an optical device, a contact glass 11 for putting the original thereon, and an original presser 12 for pressing the original against the contact glass 11 and mounting and fixing this original thereto. The optical device has a lamp 13 for illuminating and scanning the original on the contact glass 11, and has a first mirror 14 moved together with the lamp 13 to scan the original and reflecting light reflected from the original. The optical device further has a second mirror 15 and a third mirror 16 for sequentially reflecting the reflected light from the first mirror 14, and has a lens 17 for focusing and forming light reflected from the third mirror 16 as an image on a charge coupled device (CCD) 18. The second mirror 15 and the third mirror 16 are moved at a speed half a read scanning speed of the lamp 13 to scan the original.

Figure 4:
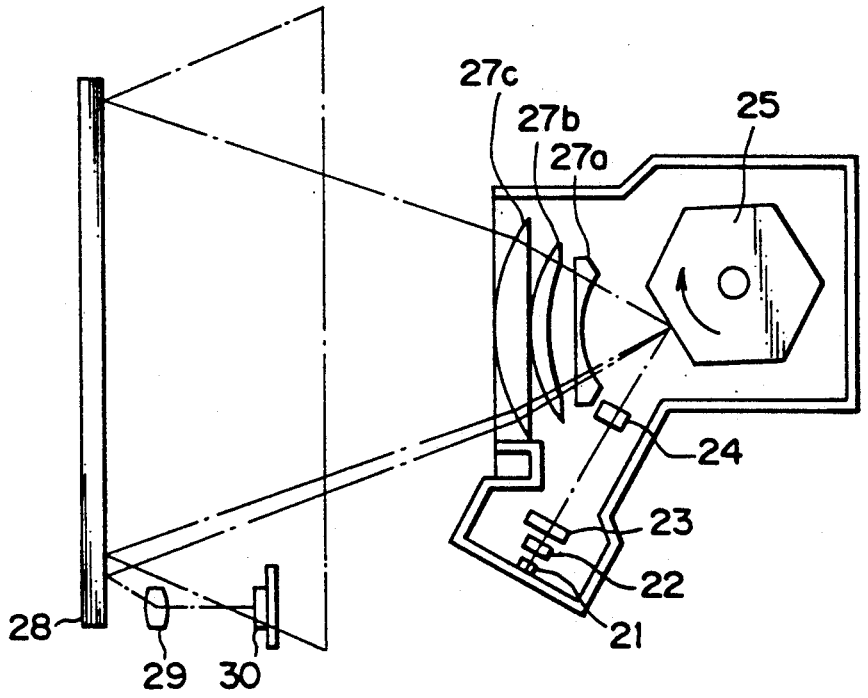
FIG. 4 is a plan view for explaining a write optical device.

A write optical device 7 is included in the image forming section 5 disposed in the copying body 3. In FIGS. 2 and 4, the write optical device 7 has a semiconductor laser 21, a collimator lens 22, an aperture 23 and a cylindrical lens 24. The collimator lens 22 changes a laser beam emitted from the semiconductor laser 21 to a parallel light beam. The aperture 23 shapes the light beam in a constant shape. The light beam shaped by the aperture 23 is incident to a polygon mirror 25 through the cylindrical lens 24 in a shape in which the light beam is compressed in a cross scanning direction.

The polygon mirror 25 has an accurate polygonal shape and is rotated by a polygon motor 26 at a constant speed in a constant direction. The laser beam incident to the polygon mirror 25 is deflected by rotating the polygon mirror 25 and is incident to f $\theta$ lenses 27*a*, 27*b* and 27*c*. A rotational speed of the polygon mirror 25 is determined by a speed, a write density and the number of faces of an image information holding means 31 such as a photosensitive body disposed in the image forming section 5.

Each of the f $\theta$ lenses 27*a*, 27*b* and 27*c* changes scanning light having a constant angular velocity to light scanned on the photosensitive body 31 at an equal speed. Each of the f $\theta$ lenses 27*a*, 27*b* and 27*c* focuses and forms this light as an image on the photosensitive body 31 such that this light is formed as a minimum light point. Each of the f $\theta$ lenses 27*a*, 27*b* and 27*c* also has a function for correcting an inclination of a reflecting face of the polygon mirror.

After the above light is transmitted through each of the f $\theta$ lenses 27*a*, 27*b* and 27*c*, the light is reflected on a mirror 28. A light portion outside an image region is guided to a synchronizing sensor 30 by a synchronous detecting mirror 29. The synchronizing sensor 30 transmits a synchronizing signal for emitting a heading signal in a main scanning direction. After a constant time has passed since the synchronizing signal was transmitted from the synchronizing sensor 30, image data on one line are outputted on the basis of read image information from the scanner 2. The light as the image data is reflected on the mirror 28 and is focused and formed as an image in an exposure position of the photosensitive body 31. Such an operation is repeatedly performed so that the image is sequentially exposed on the photosensitive body 31.

The photosensitive body 31 has a drum shape and a surface of the photosensitive body 31 is coated with a photosensitive layer. An organic photosensitive body (OPC) such as α-Si, Se-Te, etc. is known as the photosensitive body sensitive to light having a wavelength of 780 nm in the semiconductor laser. In this embodiment, the organic photosensitive body is used.

In general, in the case of the laser writing operation, there is a negative/positive (N/P) process for illuminating light to an image section and a positive/positive (P/P) process for illuminating light to a texture portion. In this embodiment, the negative/positive process is used.

A surface of the photosensitive body 31 is uniformly charged with a minus charge by a charger 32 in a scorotron system in which a grid is disposed on a side of the photosensitive body. A laser beam is then illuminated onto a photosensitive portion of the photosensitive body 31 to drop an electric potential thereof. Thus, an electrostatic latent image having −750 to −800 volts can be formed in the texture portion of the photosensitive body 31 on a surface thereof. Further, an electrostatic latent image having about −50 volts can be formed in the image section. The electrostatic latent image is developed by toner charged with a minus charge using a developing device 33 in a state in which a bias voltage from −500 to −600 volts is applied to a developing roller 33*a*.

The image developed by the developing device 33 is charged with a plus charge and is transferred by a transfer charger 34 from a rear face of a conveying belt 53 onto a recording face of a recording medium such as a sheet of transfer paper fed by the conveying belt 53 of the feeder 6 in sychronization with a rotation of the photosensitive body 31.

The remaining toner untransferred to the sheet of recording paper and left on the photosensitive body 31 is removed from the photosensitive body 31 by a cleaner 35. The remaining toner is then collected into a tank disposed within the cleaner 35. Further, an electric potential pattern left on the photosensitive body 31 is erased by illuminating light thereto by a charge-removing lamp 36.

Reflection density on a surface of the photosensitive body 31 is measured by a photodetector or photosensor 37 disposed just after a developing position of the developing device 33. The photosensor 37 is constructed by combining a light-receiving element with a light-emitting element. In the measurement of the reflection density, a constant pattern such as a black or mesh point pattern is written by the write optical device 7 in a position corresponding to a reading position of the photosensor. An image density is judged from a ratio of the reflectivity of a pattern section after a developing operation of the written constant pattern and the reflectivity of a photosensitive body portion except for the pattern section. In the case of a thin image density, the photosensor 37 transmits a toner supplying signal. It is possible to detect insufficiency of the remaining toner amount by using that no image density is increased after the toner supply.

The sheet of recording paper having the transferred image thereon is curved and separated by a driving roller 54 around which the conveying belt 53 is wound. The sheet of recording paper is then fed to a fixing device 38. In the fixing device 38, the toner on a surface of the sheet of recording paper is fixed by a pair of fixing rollers composed of a heating roller 39 and a pressurizing roller 40. The fixed sheet of recording paper is guided by a claw 41 to a paper discharging path 42 in the case of the normal image formation such as a copying operation. The fixed sheet of recording paper is thus discharged from the paper discharging path 42 by paper discharging rollers 43.

The paper feeder 6 has a conveyor 51 and a storing means such as paper feeding trays or paper feeding cassettes.

The conveyor 51 has an endless conveying means such as the conveying belt 53 endlessly moved circularly. The conveying belt 53 is sequentially wound around a driving roller 54, a first driven roller 55, a second driven roller 56 and an adjusting roller 57. The conveying belt 53 is approximately moved and conveyed by the driving roller 54 at a constant speed. The photosensitive body 31 comes in contact with the conveying belt 53 from an outside thereof in an image forming position such as a transfer position between the driving roller 54 and the first driven roller 55. The conveying belt 53 has a predetermined nipping width for nipping the sheet of paper. The transfer charger 34 opposite to the photosensitive body 31 is arranged on an inside face of the conveying belt 53 such that the transfer charger 34 is opposed to this inside face.

A suitable number of pickup rollers 58 such as two pickup rollers 58 are spaced from each other at a suitable distance on an inner side of the conveying belt 53 between the first driven roller 55 and the second driven roller 56. Each of the pickup rollers 58 can be vertically moved. The distance between the pickup rollers 58 can be changed by moving one or more pickup rollers at a suitable time in accordance with necessity. The first driven roller 55 and the adjusting roller 57 are formed such that these rollers can be approximately moved in a horizontal direction. The adjusting roller 57 is formed such that the tensile force of a spring 59 is applied to the adjusting roller 57 so as to give predetermined tensile force to the conveying belt 53 at any time.

Figure 5:
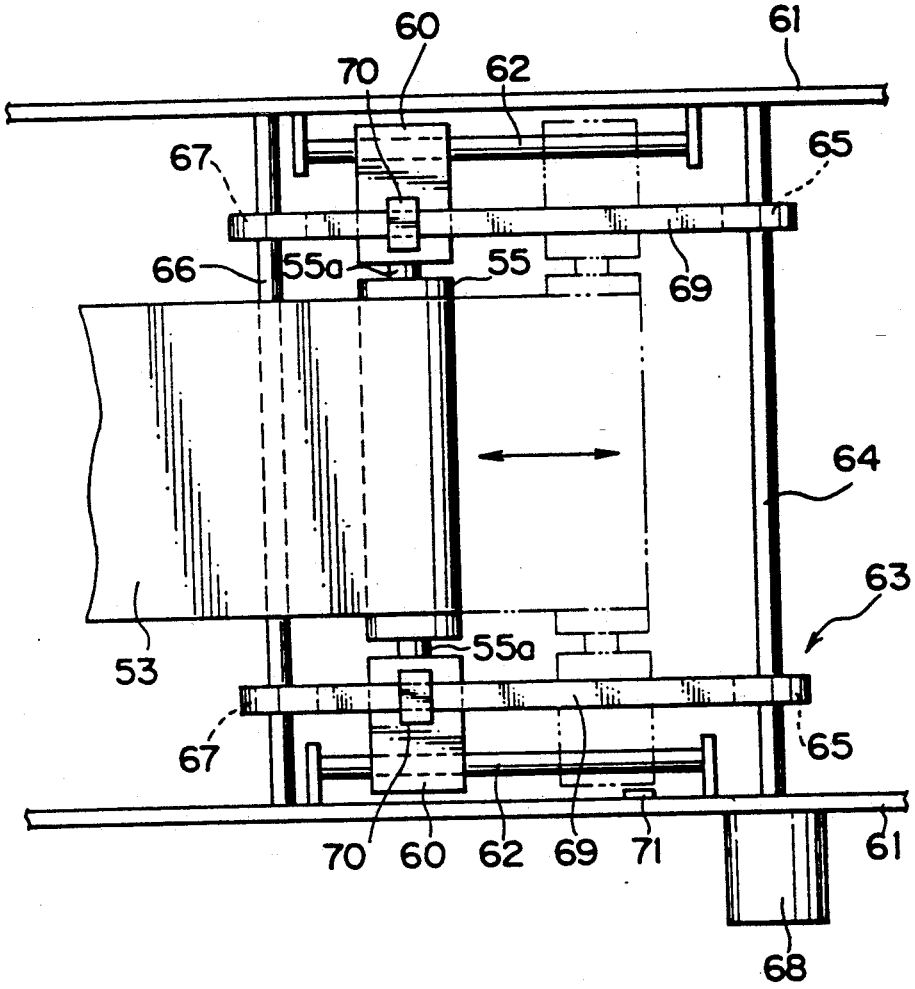
FIG. 5 is a plan view of a conveying means speed changing device.
Figure 6:
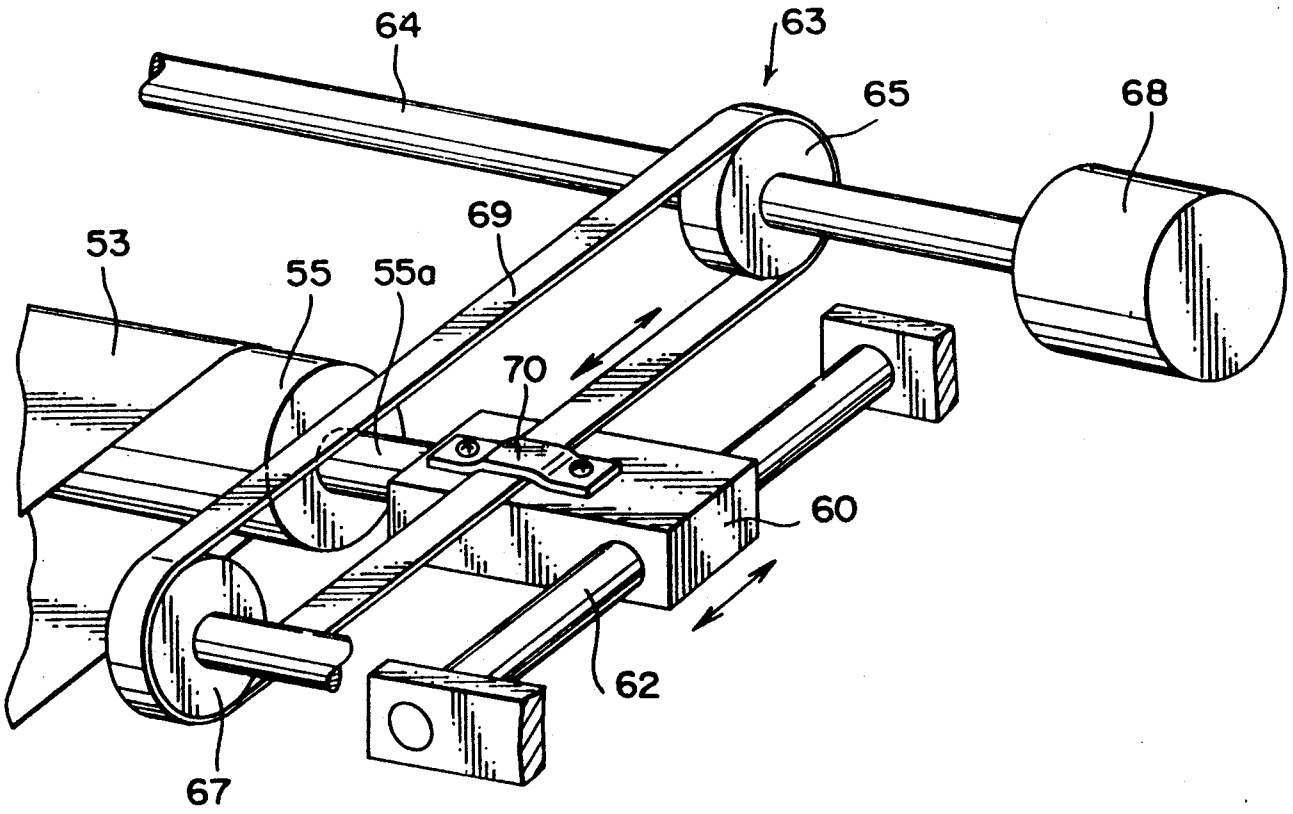
FIG. 6 is a perspective view of the conveying means speed changing device.

As shown in FIGS. 5 and 6, a shaft portion 55*a* of the first driven roller 55 at each of opposite ends thereof is rotatably supported by a bearing 60. This bearing 60 is formed as a slider slidably supported by a guide shaft 62 fixed to a side plate 61. It is possible to use a structure in which the shaft portion 55*a* is fixed to the bearing 60 and the first driven roller 55 is rotatably supported in the shaft portion 55*a*. The first driven roller 55 and the bearing 60 are reciprocated by a moving device 63 along the guide shaft 62.

The moving device 63 conveys and moves the conveying belt 53 by the driving roller 54 and further moves this conveying belt 53 additionally. The moving device 63 is used as a feeding speed changing device. The moving device 63 has driving pulleys 65 fixed to a drive shaft 64 rotatably supported by the side plate 61. The moving device 63 also has driven pulleys 67 fixed to a driven shaft 66 rotatably supported by the side plate 61. The drive shaft 64 is rotated by a moving motor 68. A driving belt 69 is wound around each of the driving pulleys 65 and the driven pulleys 67 and is fixed by a fixed plate 70 to the bearing 60 as a slider. The driving belt 69 is moved in normal and reverse directions by rotating the moving motor 68 in normal and reverse directions. Thus, the bearing or slider 60 is moved along the guide shaft 62 so that the first driven roller 55 is approximately moved in the horizontal direction.

When the first driven roller 55 is located in a home position at a right-hand end in FIG. 5, the first driven roller 55 is detected by a home sensor 71. The adjusting roller 57 is moved in accordance with the movement of the first driven roller 55 so that the tensile force of the conveying belt 53 can be constantly held. Accordingly, the adjusting roller 57 is generally moved by the same distance as a moving distance of the first driven roller 55 in a direction opposite to a moving direction of the first driven roller.

In the following description, a moving speed V mm/s of the first driven roller 55 is set to be half a conveying or circumferential moving speed v mm/s of the conveying belt 53. Namely, $V=v/2$ is set. In this case, when the first driven roller 55 is moved on the left-hand side in FIG. 5, the speed of the conveying belt 53 moving in an arrow direction is apparently changed and an operating state of this belt is apparently changed to a stopping state by actions of the circumferential moving speed v mm/s and the moving speed V mm/s in a speed changing region. Thus, the conveying belt 53 can be held in the stopping state. This speed changing region is set to a region from the adjusting roller 57 to the first driven roller 55 through the second driven roller 56.

The sheet of recording paper is adsorbed to the conveying belt 53 from a paper feeding tray 52 in the stopping state of the conveying belt 53 in which the apparent paper feeding speed is equal to zero. Thus, the sheet of paper can be fed to the conveying belt without using any resisting device and causing any resisting shift at a front end of the paper sheet. The sheet of paper is adsorbed in the same adsorbing position at any time and no shift in this position is caused by the conveyance of the conveying belt. Further, it is not necessary to stop a resisting operation of the resisting device especially disposed to position an image. Accordingly, it is sufficient to control only paper feeding timing and timing for starting the image formation.

The operating state of the conveying belt 53 is once apparently set to the stopping state by moving the first driven roller 55 in the speed changing region constituting a portion of the conveying belt 53. Then, the speed of the conveying belt 53 is returned to a predetermined speed, thereby performing a speed changing operation of the belt. A constant speed region of the conveying belt 53 is set to a region from the first driven roller 55 to the adjusting roller 57 through the transfer position and the driving roller 54. In this constant speed region, the conveying belt 53 is moved at a constant speed without causing any apparent change in speed of the conveying belt 53. Accordingly, no circumferential speed of the conveying belt 53 is changed while the sheet of recording paper is fed from the transfer position to a fixing position of the fixing device 38. Accordingly, the speed of a portion of the conveying belt 53 is apparently changed and the operating state of the conveying belt 53 is changed to the stopping state. Another sheet of recording paper is conveyed by the same conveying belt 53 during the paper feeding operation. Thus, it is possible to transfer, separate and fix the sheet of recording paper without causing any influence. Further, for example, no error in cleaning operation of the conveying belt 53 is caused if the cleaning operation is performed by a belt cleaner 72 disposed on an lower side of the driving roller 54 in the constant speed region in which the conveying belt 53 is moved at the constant speed at any time.

When the sheet of recording paper is adsorbed to the conveying belt 53 from the paper feeding tray 52, the first driven roller 55 is moved and returned to the home position on the right-hand side in FIG. 5. At this time, the adjusting roller 57 is also moved together with the movement of the first driven roller 55.

When the first driven roller 55 is returned to the home position, the apparent feeding speed of the conveying belt 55 in the speed changing region is increased until a speed twice the feeding speed in the constant speed region.

An upper pressing roller 73 is arranged on an upper side of the first driven roller 55 in FIG. 2. A lower pressing roller 74 is arranged on a lower right-hand side of the first driven roller 55 in FIG. 2. A guide plate 75 is arranged between the upper pressing roller 73 and the lower pressing roller 74. The guide plate 75 fulfills an auxiliary conveying function such that a conveying direction of the sheet of recording paper conveyed by the conveying belt 53 from the paper feeding tray 52 can be smoothly changed by the guide plate 75 along the first driven roller 55.

The dirty conveying belt 53 is cleaned by the belt cleaner. Thereafter, a constant electric charge pattern is formed on the conveying belt 53 by a charging roller 76 arranged in the vicinity of the belt cleaner 72. The electric charge pattern is formed in the speed changing region of the conveying belt 53 when the charging roller 76 is arranged in contact with an outside of the second driven roller 56. In such a case, a constant electric charge pattern can be formed on the conveying belt 53 by changing or controlling the frequency of a electric charge applied to the conveying belt 53, etc. in accordance with a change in feeding speed thereof.

The paper feeding tray 52 constitutes a device for loading sheets of recording paper in a front loading system. The paper feeding tray 52 is pulled out of a front face of the copying machine 1 and sheets 77 of recording paper are set in this paper feeding tray 52. Then, the paper feeding tray 52 is pushed into the copying machine 1. Thus, the sheets of recording paper can be supplied to the paper feeding tray 52.

The paper feeding tray 52 is prepared every size series of the sheets of recording paper such as A-series, B-series, letter sizes, etc. In the following description, the A-series is used, but the other series can be similarly used.

Figure 7:
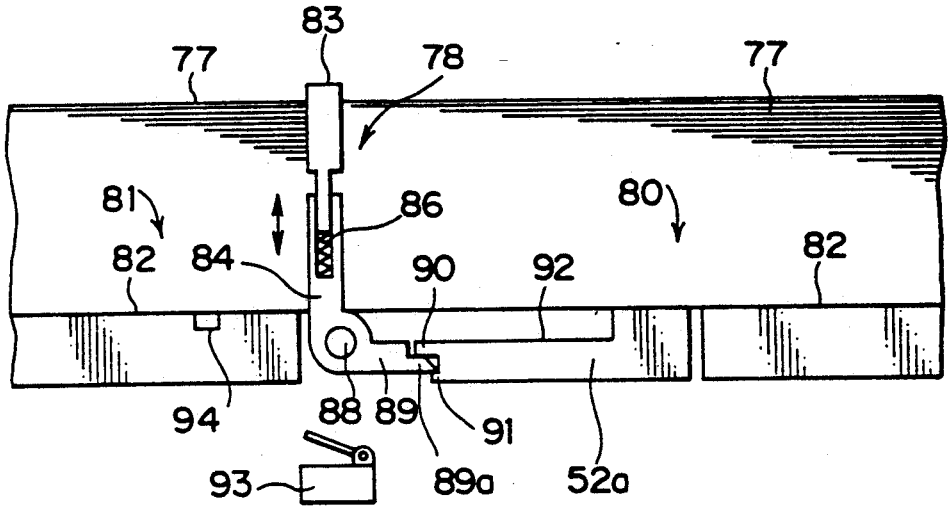
FIG. 7 is a front cross-sectional view showing a portion of a storing means.

As shown in FIG. 7, a central fence 78 is disposed in a central portion of the paper feeding tray 52 and a rightward fence 79 is disposed on the right-hand side of the paper feeding tray 52. The central fence 78 is of an inclinable type. When sheets of recording paper having size A4 are set in the paper feeding tray, the central fence 78 is set to rise as shown in FIG. 7. Then, the sheets of recording paper are stored into each of two tray chambers 80 and 81 formed rightward and leftward. When the sheets of recording paper having size A3 are set, the central fence 78 between the two tray chambers 80 and 81 is opened as shown in FIG. 8 to form a single tray chamber and the sheets of recording paper are then stored into this single tray chamber.

A raising tray 82 is disposed on a lower side of the paper feeding tray 52 in each of the tray chambers 80 and 81 formed on the right-hand and left-hand sides of the central fence 78.

When the central fence 78 is set to rise, a tray section constructed by the right-hand tray chamber 80 in FIG. 2 and the raising tray 82 is called a first tray 52' in the following description. Further, a tray section constructed by the left-hand tray chamber 81 and the raising tray 82 is called a second tray 52" in the following description.

Figure 8:
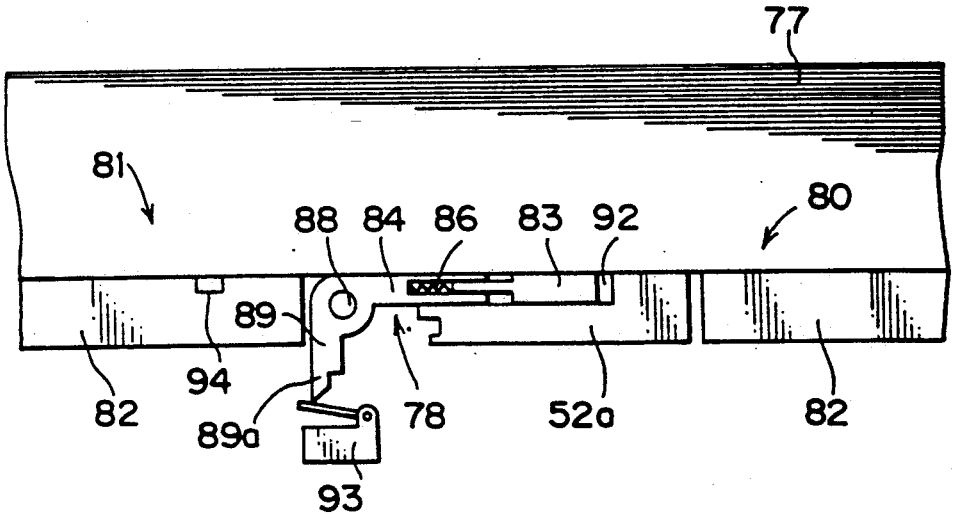
FIG. 8 is a front cross-sectional view showing a slanting state of a partition means shown in FIG. 7.
Figure 9:
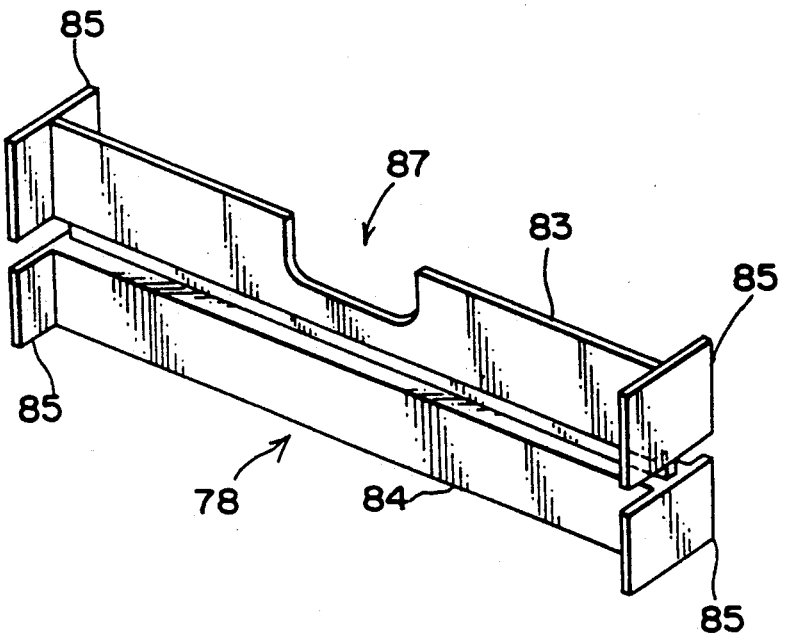
FIG. 9 is a perspective view of the partition means.

As shown in FIGS. 7 to 9, the central fence 78 has an upper fence guide 83 and a lower fence guide 84. Corner guides 85 are respectively disposed at both ends of the upper fence guide 83 and both ends of the lower fence guide 84 to prevent the sheets 77 of recording paper from being transversally shifted from each other. The upper fence guide 83 is inserted into a groove of the lower fence guide 84 so as to be vertically slid. A spring 86 is attached between the upper fence guide 83 and the lower fence guide 84. It is possible to use a structure in which a groove is formed in the upper fence guide 83 and the lower fence guide 84 is inserted into this groove. The upper fence guide 83 is held by an action of the spring 86 in a predetermined relative position with respect to the lower fence guide 84 when there is no load of the spring 86.

As shown in FIG. 9, a notch portion 87 is formed in an upper central edge portion of the upper fence guide 83 such that no operator's hands come in contact with the sheets 77 of recording paper when the sheets of recording paper are set.

The lower fence guide 84 is rotatably supported by a support shaft 88 in a frame portion of the paper feeding tray 52 (see FIG. 7). The lower fence guide 84 has an L-shaped finger portion 89 in a lower end portion thereof. The finger portion 89 is engaged with a projected engaging portion 90 formed in the frame portion 52*a* of the paper feeding tray 52. Accordingly, when the lower fence guide 84 is rotated and rises, the lower fence guide 84 is approximately stopped in a vertical position to prevent the lower fence guide 84 from being further rotated.

A claw 89*a* is formed in the finger portion 89 and is engaged with a hanging portion 91 formed in the frame portion 52*a*. Accordingly, the rotation of the lower fence guide 84 in an inclining direction thereof is prevented so that the lower fence guide 84 is held in a rising position. When the upper fence guide 83 is transversally pushed by force set to resiliently deform and disengage the claw 89*a* from the hanging portion 91, the central fence 78 is rotated in the clockwise direction and falls down as shown in FIG. 8. Thus, the central fence 78 between the rightward tray chamber 80 and the leftward tray chamber 81 is opened. The upper fence guide 83 and the lower fence guide 84 are formed such that these fence guides are located within a recessed portion 92 formed in the frame portion 52*a* of the paper feeding tray 52 when the central fence 78 is rotated and falls down. Accordingly, no feeding operation of the sheets of recording paper arranged on the raising tray 82 is obstructed by the upper fence guide 83 and the lower fence guide 84 when the central fence 78 is rotated and falls down. When the central fence 78 is rotated and falls down and the rightward tray chamber 80 and the leftward tray chamber 81 are communicated with each other, the claw 89*a* of the falling lower fence guide 84 pushes a switch 93 as a paper size sensor, thereby detecting this communicating state.

A paper end sensor 94 is disposed on an upper face of the raising tray 82 to detect whether there are sheets of paper in the tray or not.

The central fence 78 can be constructed by using a detachable system instead of the inclinable structure shown in FIGS. 7 and 8. In this case, the paper size can be detected by disposing a sensor for detecting whether there is the central fence 78 or not.

Similar to FIG. 9, the rightward fence 79 can be also formed by an upper fence guide 83 and a lower fence guide 84. In this case, it is not necessary to rotate and make the rightward fence 79 fall down.

The above-mentioned pickup rollers 58 press the above conveying belt 53 against the sheets 77 of recording paper in the paper feeding tray 52. One of such pickup rollers 58 is arranged just above the upper fence guide 83 of the intermediate central fence 78. Similarly, another one of the pickup rollers 58 is arranged just above the upper fence guide 83 of the rightward fence 79.

Figure 10:
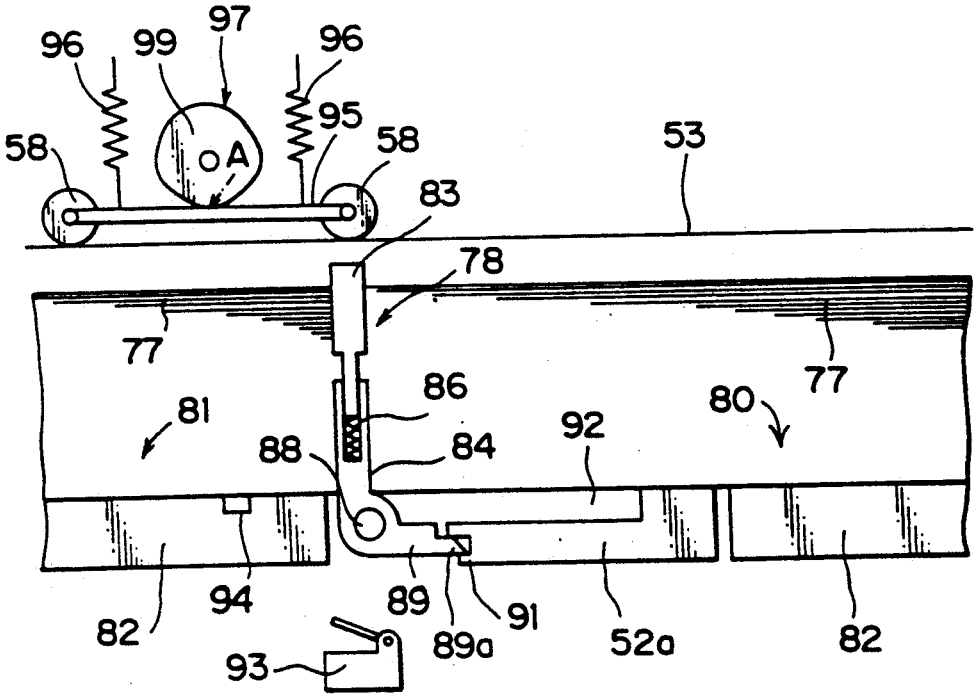
FIG. 10 is a front cross-sectional view schematically showing the storing means and a conveying means presser as an attractive operating means.
Figure 11:
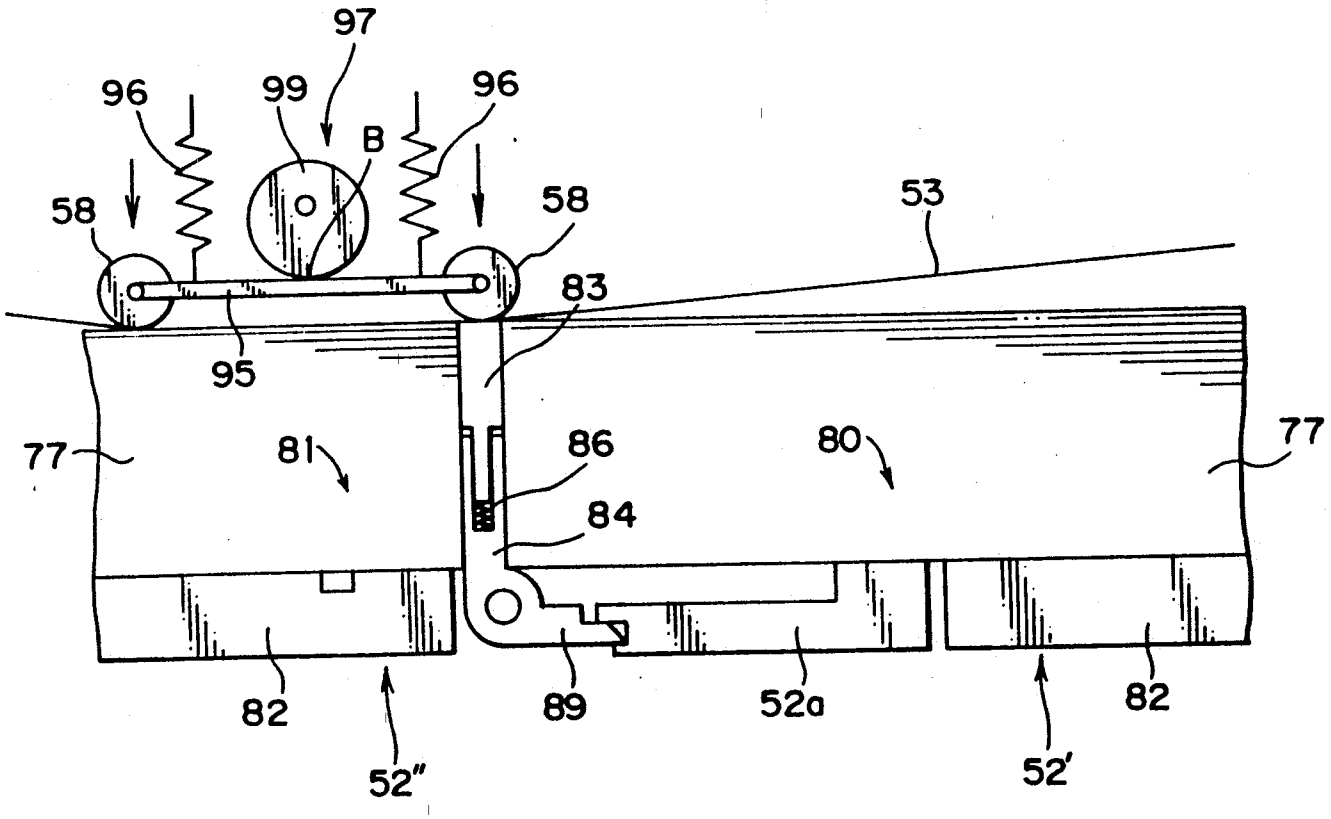
FIG. 11 is a front cross-sectional view corresponding to FIG. 10 and showing an operating state of the conveying means presser.

As shown in FIG. 10, one pickup roller 58 arranged just above each of the fence guides 83 and another one or plural pickup rollers 58 are rotatably supported as one set by e.g., a carrier plate 95. In this embodiment, two pickup rollers 58 are supported as one set by the carrier plate 95. Each set of the pickup rollers 58 is supported by the carrier plate 95 at the same height. The carrier plate 95 is biased by a tension spring 96 so that the carrier plate 95 is raised and held in a constant position at any time. The conveying belt 53 is in a state in which the conveying plate 53 is separated from an upper end face of the upper fence guide 83. The carrier plate 95 comes in contact with a pushing-down device 97 such as a cam device by resilient force of the spring 96. The carrier plate 95 is pushed down by an operation of the pushing-down device 97 such as the rotation of a cam 99 from a time when no sheet of paper is fed as shown in FIG. 10. Then, as shown in FIG. 11, one of the pickup rollers 58 comes in contact with the upper fence guide 83 and pushes this upper fence guide 83 down. The carrier plate 95 is pushed down until the conveying belt 53 comes in contact with the sheet 77 of recording paper and attracts this paper sheet 77.

Figure 12:
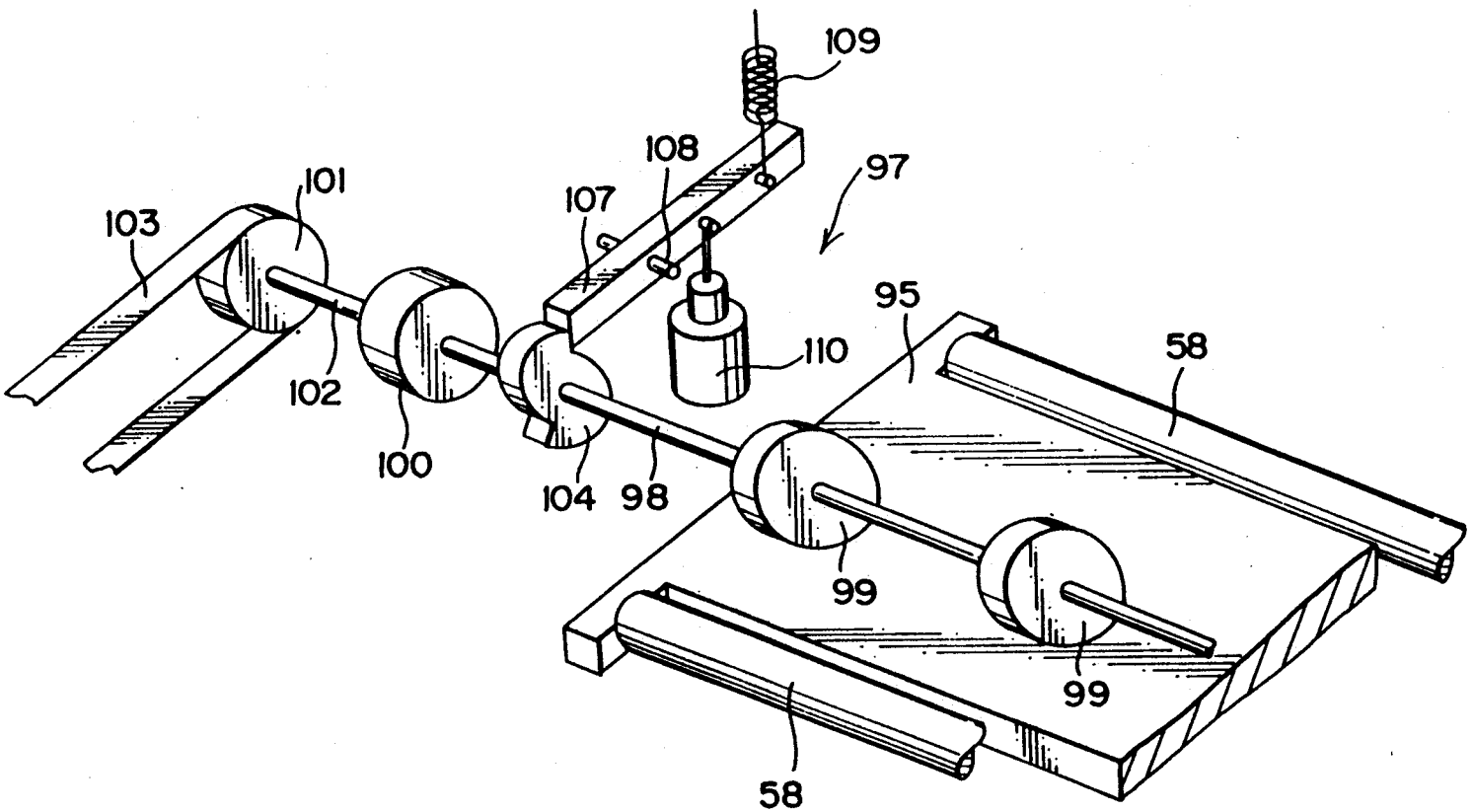
FIG. 12 is a perspective view showing a driving system of the conveying means presser.
Figure 13:
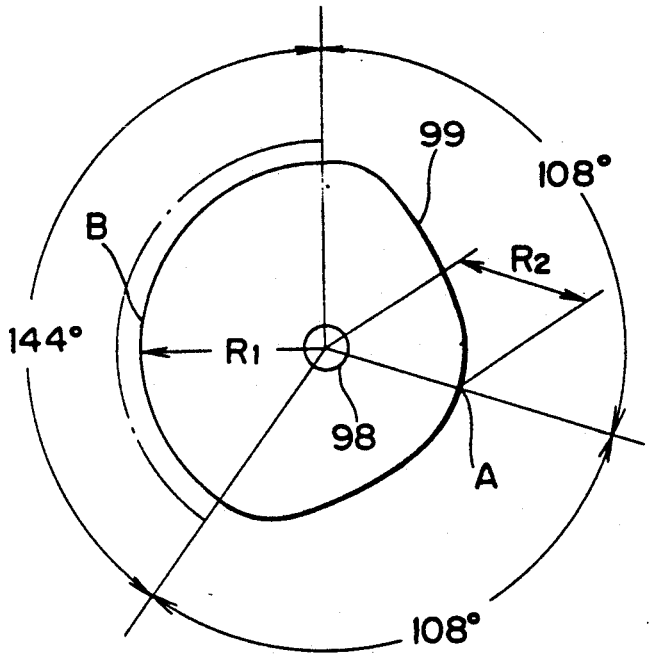
FIG. 13 is a front view of a cam disposed in FIG. 12.

As shown in FIG. 12, in the case of the cam device, the pushing-down device 97 has paper feeding cams 99 fixed to a shaft 98 and spaced from each other at a predetermined distance in the same posture. As shown in FIG. 13, for example, each of the paper feeding cams 99 has an arc face B having a radius $R_1$ such as 10 mm from a center of the shaft 98 in an outer circumferential portion of this cam ranged from 0° to 144°. The remaining cam portion having the range of an angle 216° is divided into two cam circumferential portions each having the range of an angle 108°. A divisional central point A of these two cam circumferential portions has a radius $R_2$ such as 6 mm from the center of the shaft 98. The arc face B and the central point A are connected to each other by a smooth curved surface.

Figure 14:
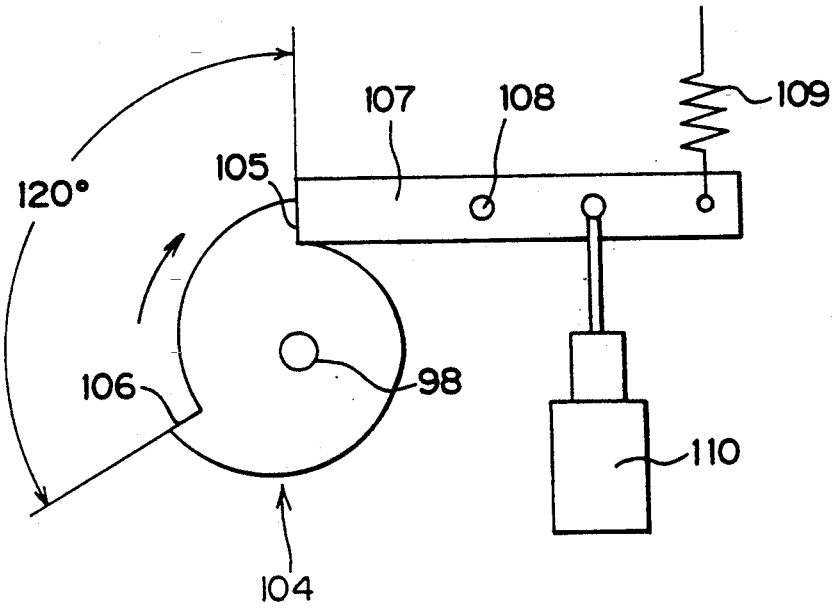
FIG. 14 is an explanatory view of a stopper disposed in the driving system of the conveying means presser.

The shaft 98 is connected to a driving shaft 102 through a spring clutch 100. A pulley 101 is fixed to the driving shaft 102. The pulley 101 is driven by a motor through a timing belt 103 and an unillustrated speed change gear. A stopper 104 is fixed to the shaft 98. As shown in FIG. 14, the stopper 104 is formed by a ratchet wheel approximately having a spiral shape and first and second step portions 105 and 106 in an outer circumferential portion thereof. A claw portion of an engaging bar 107 is engaged with the step portion 105 to prevent the stopper 104 from being rotated. The engaging bar 107 is rotatably supported by a support shaft 108 and is held by a spring 109 at any time in an engaging position of the step portion 105 or 106. A plunger of a paper feeding solenoid 110 is connected to the engaging bar 107. When this solenoid 110 is energized, the engaging bar 107 is rotated around the support shaft 108 against resilient force of the spring 109. Thus, the engaging bar 107 is disengaged from the step portion 105 or 106.

When the stopper 104 is rotated, a rotational angle of the stopper 104 from the first step portion 105 to the second step portion 106 is set to 120°. When the engaging bar 107 is disengaged from the first step portion 105 at an engaging time thereof, the stopper 104 is rotated this angle 120° so that the second step portion 106 is engaged with the engaging bar 107, thereby stopping the rotation of the shaft 98. As shown in FIG. 10, the paper feeding cam 99 comes in contact with the carrier plate 95 at the point A in a state in which the engaging bar 107 is engaged with the first step portion 105. Accordingly, the carrier plate 95 is located in the raising position.

The pulley 101 is rotated by an unillustrated motor and the rotation of 120 rpm is transmitted to this pulley 101. The rotation of the pulley 101 is transmitted to the stopper 104 through the spring clutch 100. At the paper feeding time, the paper feeding solenoid 110 is energized so that the stopper 104 is disengaged from the engaging bar 107. The stopper 104 begins to be rotated since the stopper 104 receiving a moment of rotation at any time is disengaged from the engaging bar 107. After 0.25 seconds, the energizing operation of the paper feeding solenoid 110 is released and the engaging bar 107 again comes in contact with an outer circumferential face of the stopper 104. At this time, the stopper 104 is already rotated 180° so that the stopper 104 has passed through the second step portion 106. When the stopper 104 is rotated once, the claw of the engaging bar 107 is engaged with the first step portion 105 of the stopper 104, thereby stopping the rotation of the stopper 104. Accordingly, the cam 99 is rotated once in 0.5 seconds.

The pickup rollers 58 are lowered by 4 mm in 0.15 seconds together with the carrier plate 95 and are stopped for 0.2 seconds. At this time, as shown in FIG. 11, the arc face B of the cam 99 comes in contact with the carrier plate 95 and pushes this carrier plate 95 down. After the pickup rollers 58 are stopped for 0.2 seconds, the pickup rollers 58 are returned to their original positions in 0.15 seconds. The pickup rollers 58 and a means for pushing the pickup rollers 58 down such as the pushing-down device 97 and the carrier plate 95 act as a sucking operating means for sucking the conveying belt 53.

When no paper sheet is fed, a distance between the conveying belt 53 and the sheets 77 of recording paper is set to about 4 mm. A distance between the conveying belt 53 and the upper fence guide 83 is set to 2 mm. Accordingly, when the pickup rollers 58 are moved by 2 mm downward, the pickup rollers 58 come in contact with the upper fence guide 83. Further, the pickup rollers 58 are lowered by 2 mm while the pickup rollers 58 push the upper fence guide 83 down. The conveying belt 53 comes in contact with the sheets 77 of recording paper in this lowering position of the pickup rollers 58. At this time, a sheet 77 of recording paper is adsorbed to the conveying belt 53 by a non-uniform electric field caused by an electric charge pattern formed by the charging roller 76 in advance on an outer circumferential face of the conveying belt 53. The raising tray 82 is formed and controlled in operation such that the raising tray 82 is stopped after the raising tray 82 is raised until a contact pressure between the sheets 77 of recording paper and the conveying belt 53 reaches a predetermined value immediately after the downward movement of the pickup rollers 58. Thus, it is possible to correct a change in lowering of an upper face position of the sheets 77 of recording paper caused by the paper feeding operation. Accordingly, a paper feeding position can be held at the same height at any time.

The conveying belt 53 has a feeding function for feeding a sheet of recording paper from the paper feeding tray 52. The conveying belt 53 also has a conveying function for conveying the sheet of recording paper to a transfer position. The conveying belt 53 further has a transfer function for contributing to the transfer of the sheet of recording paper in the transfer position.

The conveying belt 53 adsorbs and feeds the sheet of recording paper by adsorbing force caused by the non-uniform electric field instead of frictional force. Accordingly, there is no shift in position of the sheet of recording paper and the conveying belt 53 has a resisting function. Further, no paper powder is generated during the paper conveying operation and it is not necessary to remove the remaining electric charge from the conveying belt 53 after the transfer of the sheet of recording paper.

The second step portion 106 of the stopper 104 is used when sheets of recording paper are supplied to the paper feeding tray 52 as described later.

Figure 15:
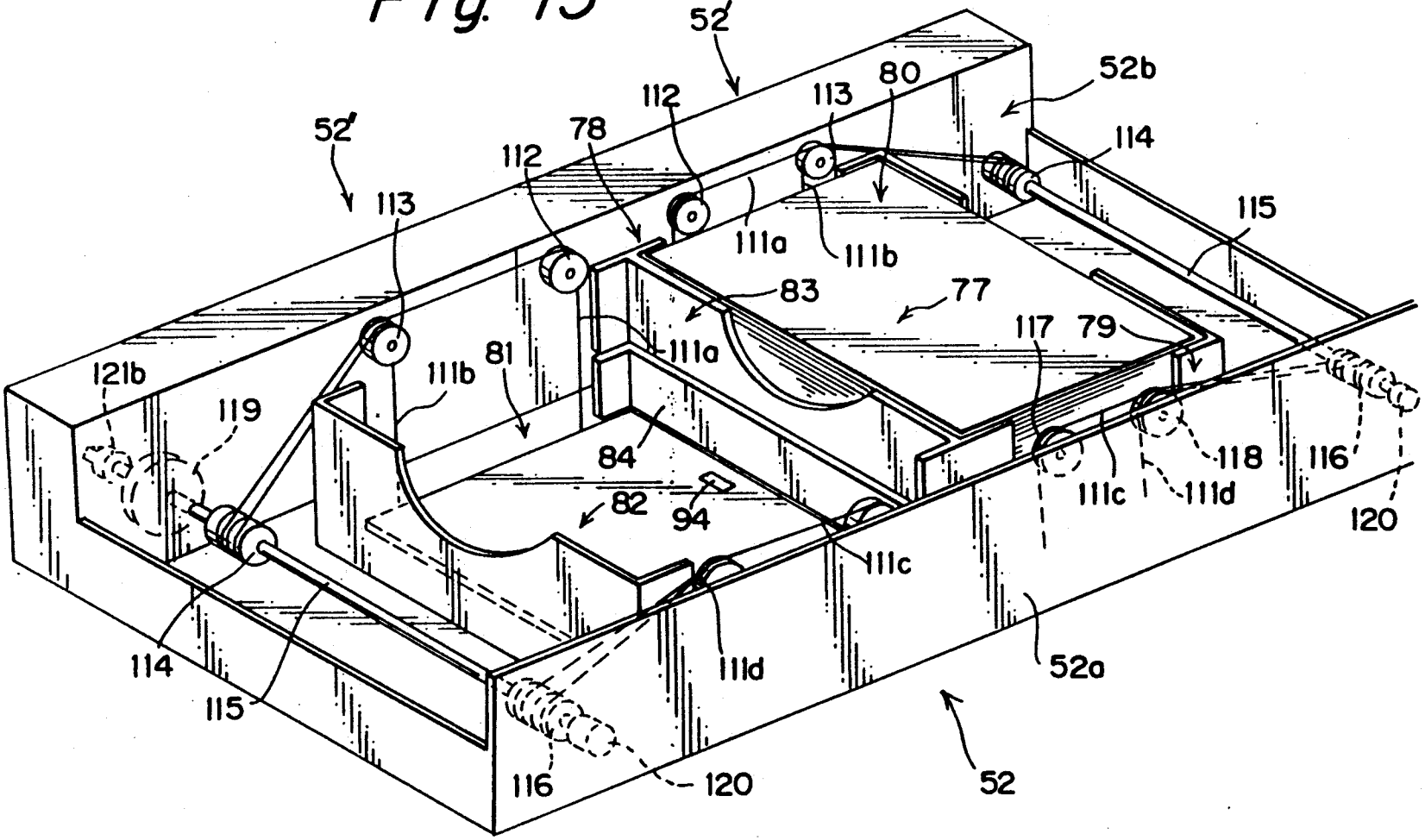
FIG. 15 is a perspective view showing the entire storing means.
Figure 16:
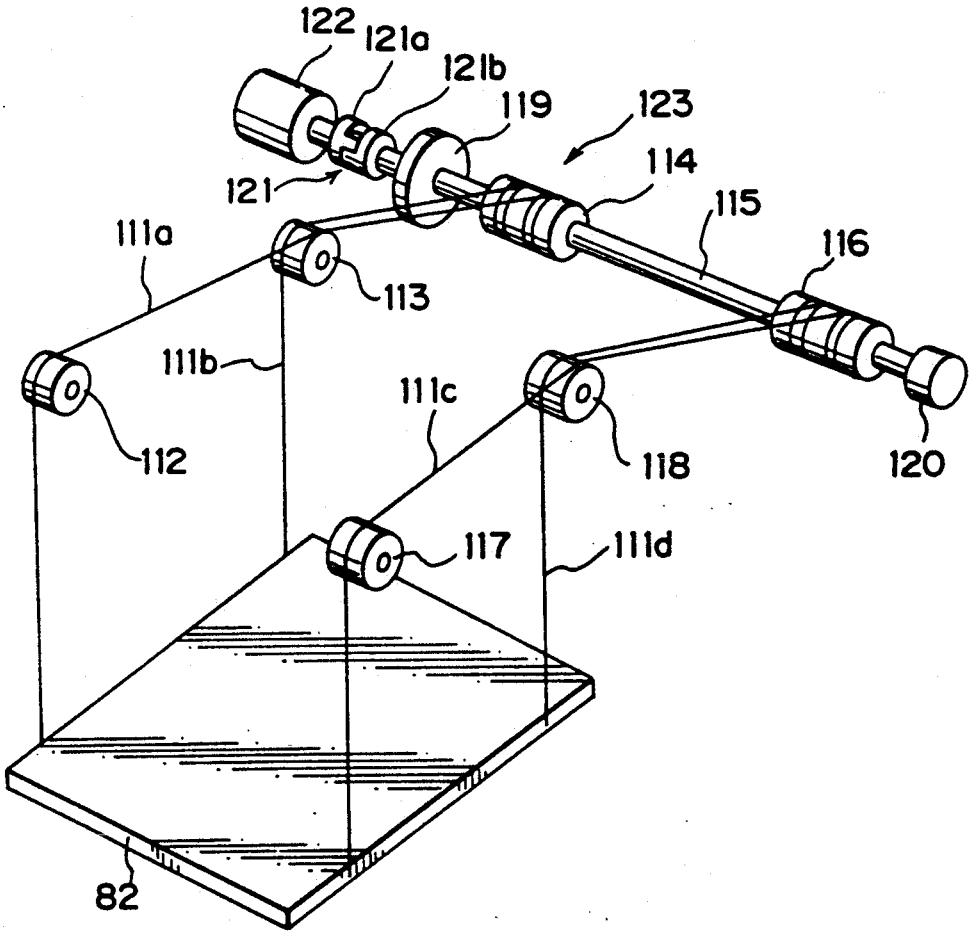
FIG. 16 is a perspective view showing a driving system of a raising tray disposed in the storing means.

As shown in FIGS. 2 and 15, the raising tray 82 is arranged in each of the rightward tray chamber 80 and the leftward tray chamber 81 divided by the central fence 78 of the paper feeding tray 52. As shown in FIGS. 15 and 16, an elevating device for moving the raising tray 82 upward and downward has four wires 111 respectively fixed to the raising tray 82 in four portions thereof. A winding direction of a first wire **111*a* is changed by a first guide pulley 112 and a second guide pulley 113. An end portion of the first wire 111*a* is wound around a first driving pulley 114. The first driving pulley 114 is fixed to a shaft 115 rotatably supported by the frame portion 52*a* of the paper feeding tray 52. One end of a second wire 111*b* is wound around the first driving pulley 114. A winding direction of the second wire 111*b* is changed by the second guide pulley 113 in a middle winding portion thereof and the second wire 111*b* is guided by this second guide pulley 113**.

Each of a third wire **111*c* and a fourth wire 111*d* is fixed to the raising tray 82 on a side thereof opposite to each of the first wire 111*a* and the second wire 111*b*. Each of the third wire 111*c* and the fourth wire 111*d* is wound around a second driving pulley 116 fixed to the shaft 115 in an end portion thereof. Similar to the first wire 111*a*, a winding direction of the third wire 111*c* is changed by a third guide pulley 117 and a fourth guide pulley 118. The third wire 111*c* is guided by these guide pulleys 117 and 118 and is wound around the second driving pulley 116. Similar to the second wire 111*b*, a winding direction of the fourth wire 111*d* is changed by only the fourth guide pulley 118. The fourth wire 111*d* is guided by only the fourth guide pulley 118 and is wound around the second driving pulley 116**.

One end of the shaft 115 is connected to an output side of an electromagnetic clutch 119. An encoder 120 is fixed to the other end of the shaft 115. An input side of the electromagnetic clutch 119 is connected to a tray motor 122 through a coupling 121. The coupling 121 has a driving half body 121*a* connected to a side of the tray motor 122 and a driven half body 121*b* connected to a side of the electromagnetic clutch 119.

Each of the raising tray 82 and the elevating device 123 has the same structure with respect to the rightward tray chamber 80 and the leftward tray chamber 81. In this embodiment shown in FIG. 15, etc., the raising tray 82 and the elevating device 123 are approximately formed symmetrically on the right-hand and left-hand sides of the central fence 78. The raising tray 82 for the rightward tray chamber 80 and the raising tray 82 for the leftward tray chamber 81 can be moved by separate motors 122. In the following description, when it is necessary to discriminate the raising tray 82 for the rightward tray chamber 80 from the raising tray 82 for the leftward tray chamber 81, alphabet A is added to a reference numeral thereafter with respect to the rightward tray chamber 80 and alphabet B is added to a reference numeral thereafter with respect to the leftward tray chamber 81.

The electromagnetic clutch 119 transmits driving force only when torque on an output side of this clutch is equal to or smaller than a predetermined value with respect to one rotational direction thereof. In contrast to this, the electromagnetic clutch 119 is slipped and does not transmit the driving force when the torque on the output side of the clutch is greater than the predetermined value. Accordingly, the raising tray 82 having the sheets 77 of recording paper thereon is raised by rotating the tray motor 122. When an uppermost face of the sheets 77 of recording paper comes in contact with the conveying belt 53 and is pressed by this conveying belt 53, no raising tray 82 is further raised by a slipping action of the electromagnetic clutch 119. After a predetermined time, the rotation of the tray motor 122 is stopped and the uppermost face of the sheets 77 of recording paper is held at a constant height at all times.

When sheets 77 of recording paper are supplied into the paper feeding tray 52, the paper feeding tray 52 is pulled out of a front face of the copying machine 1. At this time, the driving half body 121*a* of the coupling attached onto a side of the copying machine 1 is detached from the driven half body 121*b* of the coupling attached onto a side of the paper feeding tray 52. Accordingly, the raising tray 82 is lowered by its dead weight until a lowermost position thereof. Simultaneously, the tray opening/closing sensor 124 shown in FIG. 2 detects that the paper feeding tray 52 is pulled out of the front face of the copying machine 1.

After the sheets 77 of recording paper are supplied into the paper feeding tray 52 and the paper feeding tray 52 is pushed into the copying machine 1, the driving half body 121*a* of the coupling attached to the copying machine side is engaged with the driven half body 121*b* of the coupling attached to the side of the paper feeding tray 52. Simultaneously, the tray opening/closing sensor 124 detects that the paper feeding tray 52 is set in the copying machine.

When the paper feeding solenoid 110 is then operated and the engaging bar 107 is rotated in the clockwise direction in FIG. 14, the claw portion of the engaging bar 107 is disengaged from the first step portion 105 of the stopper 104. Thus, no moment of the rightward rotation in the clockwise direction is applied to the stopper 104 although this moment was applied to the stopper 104 at any time by the spring clutch 100. Therefore, there is no member for restricting the rotation of the stopper 104 so that the stopper 104 begins to be rotated in the clockwise direction.

After 0.1 second, the operation of the paper feeding solenoid 110 is released and a moment of rotation in the counterclockwise direction is applied to the engaging bar 107. Accordingly, the engaging bar 107 comes in contact with an outer circumferential face of the stopper 104. At this time, the stopper 104 is rotated only 72° indicative of 1/5 rotation so that the engaging bar 107 comes in contact with an outer circumferential face of the stopper 104 between the first step portion 105 and the second step portion 106. When the stopper 104 is rotated just 120°, the claw portion of the engaging bar 107 is engaged with the second step portion 106 of the stopper 104, thereby stopping the rotation of the stopper 104.

At this time, the circumferential face B of the cam 99 comes in contact with the carrier plate 95 and is stopped so that the conveying belt 53 is located in a paper feeding position.

Next, the tray motor 122 is operated to raise the raising tray 82 together with the sheets 77 of recording paper. When the uppermost face of the sheets 77 of recording paper comes in contact with the conveying belt 53 and is pressed by this conveying belt 53, the movement of the raising tray 82 is stopped by a braking action of the electromagnetic clutch 119. After a predetermined time, the rotation of the tray motor 122 is stopped. Then, the paper feeding solenoid 110 is operated to rotate the engaging bar 107 in the clockwise direction. Thus, the claw portion of the engaging bar 107 is disengaged from the second step portion 106 of the stopper 104. Thus, no moment of the rightward rotation in the clockwise direction is applied to the stopper 104 although this moment was applied to the stopper 104 at any time by the spring clutch 100. Therefore, there is no member for restricting the rotation of the stopper 104 so that the stopper 104 begins to be rotated in the clockwise direction.

After 0.1 second, the operation of the paper feeding solenoid 110 is released and a moment of rotation in the counterclockwise direction is applied to the engaging bar 107. Accordingly, the engaging bar 107 comes in contact with an outer circumferential face of the stopper 104. When the stopper 104 is rotated just 240°, the engaging bar 107 is again engaged with the first step portion 105 of the stopper 104, thereby stopping the rotation of the stopper 104. At this time, the conveying belt 53 is returned to a position in which no paper sheet is fed.

As mentioned above, the sheets of recording paper can be separately supplied into the first 52' and the second tray 52''. When the central fence 78 is inclined downward and falls down and the sheets of recording paper having size A3 are stored and set in the paper feeding tray 52 over the first tray 52' and the second tray 52'', both the above-mentioned operation of the raising tray and the cam operation are simultaneously performed in the first tray 52' and the second tray 52''. Thus, a contact region of the conveying belt 53 at the paper feeding time is widened to stabilize the paper feeding and conveying operations.

In FIG. 2, at the normal image forming time, a sheet of recording paper such as a sheet of transfer paper fixed by the fixing device 38 is guided by the claw 41 to the paper discharging path 42 and is discharged therefrom by the paper discharging rollers 43. In contrast to this, at a double-sided copying time when a copy is made on front and rear sides of the sheet of recording paper, it is necessary to turn the fixed sheet of recording paper upside down and feed this paper sheet to a transfer position of the photosensitive body 31.

Accordingly, a return guide path 44 for guiding the sheet of recording paper to the paper feeding tray 52 is disposed as a branching path for switching the paper discharging path 42 by the claw 41 after the sheet of recording paper is fixed by the fixing device 38.

The return guide path 44 has a reversing path 45 as a branching path. A direct passage toward the paper feeding tray 52 and a passage toward the reversing path 45 can be switched by a first switching claw 46*a* in a branching position of the return guide path 44. the sheet of recording paper fed to the return guide path 44 is fed to the first switching claw 46*a* by feed rollers 47. The sheet of recording paper guided to the reversing path 45 is nipped and fed by reversing rollers 48. When a reversing sensor 125 detects a rear end of the sheet of recording paper, the sheet of recording paper is reversely fed by rotating the reversing rollers 48 in reverse directions. This sheet of recording paper is guided by a second switching claw 46*b* to feed-out rollers 49 in the return guide path 44 and is then discharged onto the paper feeding tray 52.

When the first tray 52' and the second tray 52" are simultaneously used as in the case of copying paper size A3, the raising tray 82 is lowered by a constant lowering or moving distance by reversely rotating the tray motor 122 after the paper feeding operation of a front face copy is performed. In this case, this lowering or moving distance of the raising tray 82 is stored to an unillustrated encoder. After the sheet 77 of recording paper copied with respect to a front face thereof is inserted into the paper feeding tray 52, the raising tray 82 is returned to its original position and the paper feeding operation of a rear face copy is then performed. The sheet 77 of recording paper is copied with respect to the rear face thereof and is then discharged from the paper discharging path.

When one of the first tray 52' and the second tray 52" is used as in the case of copying paper size A4 and a front face copy is fed from the first tray 52', the raising tray 82 of the second tray 52" is lowered by a constant lowering or moving distance by reversely rotating the tray motor 122 in advance. In this case, this lowering or moving distance of the raising tray 82 is stored to an unillustrated encoder. After the sheet 77 of recording paper copied with respect to a front face thereof is inserted into the second tray 52", the raising tray 82 is returned to its original position and the paper feeding operation of a rear face copy is then performed. The sheet 77 of recording paper is copied with respect to the rear face thereof and is then discharged from the paper discharging path.

When a front face copy is fed from the second tray 52", the raising tray 82 of the second tray 52" is lowered by a constant lowering or moving distance by reversely rotating the tray motor 122 after the paper feeding operation of the front face copy is performed. In this case, this lowering or moving distance of the raising tray 82 is stored to an unillustrated encoder. After the sheet 77 of recording paper copied with respect to a front face thereof is inserted into the second tray 52", the raising tray 82 is returned to its original position and the paper feeding operation of a rear face copy is then performed. The sheet 77 of recording paper is copied with respect to the rear face thereof and is then discharged from the paper discharging path.

A recording paper upper limit sensor 126 is disposed above the second tray 52" (see FIG. 2). In a mode for forming double-sided images, when the raising tray 82 is filled with sheets of recording paper and begins to be lowered, the recording paper upper limit sensor 126 displays on an operation panel that no double-sided copy can be made.

When a plurality of images are repeatedly formed on the same face as in a combined copy instead of the double-sided copy, the sheet of recording paper is not guided by the reversing path 45, but can be directly fed to the paper feeding tray 52 by the first switching claw 46*a*.

There is a case in which it is desirable to manually feed the sheet of recording paper instead of an automatic paper feeding operation using the paper feeding tray 52. Therefore, a manual paper feeder 130 is disposed to manually feed the sheet of recording paper.

The manual paper feeder 130 has an unillustrated manual door disposed in a machine frame of the copying body 3. The manual paper feeder 130 also has guide plates 131 and 132 for guiding a sheet of recording paper inserted from the manual door and further has a manual paper feed roller 133.

When the manual door is opened, an operating mode of the copying machine is switched to a manual paper feeding mode. In this mode, the first driven roller 55 is returned to a manual home position thereof and a manual sensor 134 detects that there is a sheet of recording paper in the manual paper feeder 130. At this time, an unillustrated manual clutch is operated so that the sheet of recording paper is conveyed onto the conveying belt 53 by rotating the manual paper feed roller 133.

The copying machine 1 is constructed by the scanner 2 and the copying body 3 as a minimum unit. This copying machine 1 can fulfill the function of an ordinary copying machine. When sheets of recording paper having many kinds of paper sizes are used or many sheets of paper are copied, it is possible to arrange many storing means such as paper feeding trays or paper feeding cassettes. Further, it is possible to use the paper bank device 4 including a tray capable of storing many sheets of recording paper. In this case, the copying body 3 is arranged on the paper bank device 4 as shown in FIG. 1.

A paper feeding path 136 is disposed in a casing of the copying body 3 and is opened on a bottom face of this casing. The paper feeding path 136 guides a sheet of recording paper fed from the paper bank device 4. The paper feeding path 136 is formed such that the sheet of recording paper can be fed to a nipping position between the lower pressing roller 74 and the first driven roller 55 in a home position such as the manual home position. A branching path 137 is disposed in the paper feeding path 136 and is formed such that the sheet of recording paper can be fed toward the first tray 52' of the paper feeding tray 52. A switching claw 138 is disposed in a branching position of the branching path 137 so as to switch feeding paths of the sheet of recording paper. A paper bank paper feeding sensor 139 is disposed in the paper feeding path 136 and detects that the sheet of recording paper fed from the paper bank device 4 is fed to the paper feeding path 136. The paper bank is briefly called PB in the following description in accordance with necessity.

The paper bank device 4 has three stage trays composed of a first PB tray 201, a second PB tray 202 and a third PB tray 203 each storing 250 sheets of paper as a maximum loading capacity. The paper bank device 4 also has a fourth PB tray 204 storing 2000 sheets of paper as a maximum loading capacity. A sheet of paper is fed from each of the PB trays 201 to 204 by a single paper feeding/conveying apparatus 205.

Figure 17:
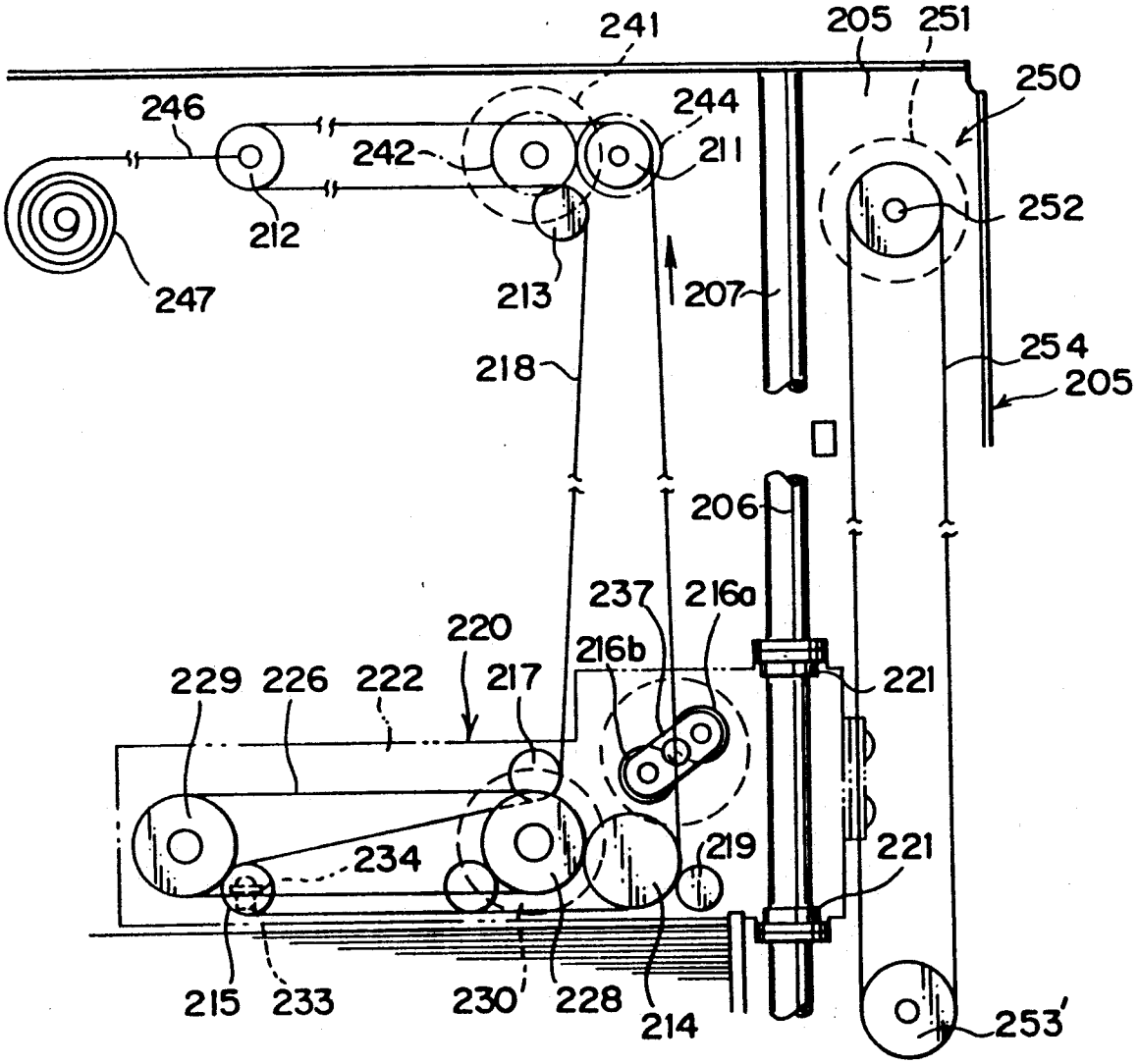
FIG. 17 is a front view for schematically showing a paper bank device.

As shown in FIGS. 2 and 17, the paper feeding/conveying apparatus 205 has an endless conveying means such as one endless belt 218. The endless belt 218 is wound around a fixed driving roller 211, a movable tension roller 212, a fixed deflecting roller 213, a driven roller 214, a pickup roller 215, a pair of belt speed changing rollers 216 (216*a*, 216*b*) and an auxiliary deflecting roller 217.

Figure 18:
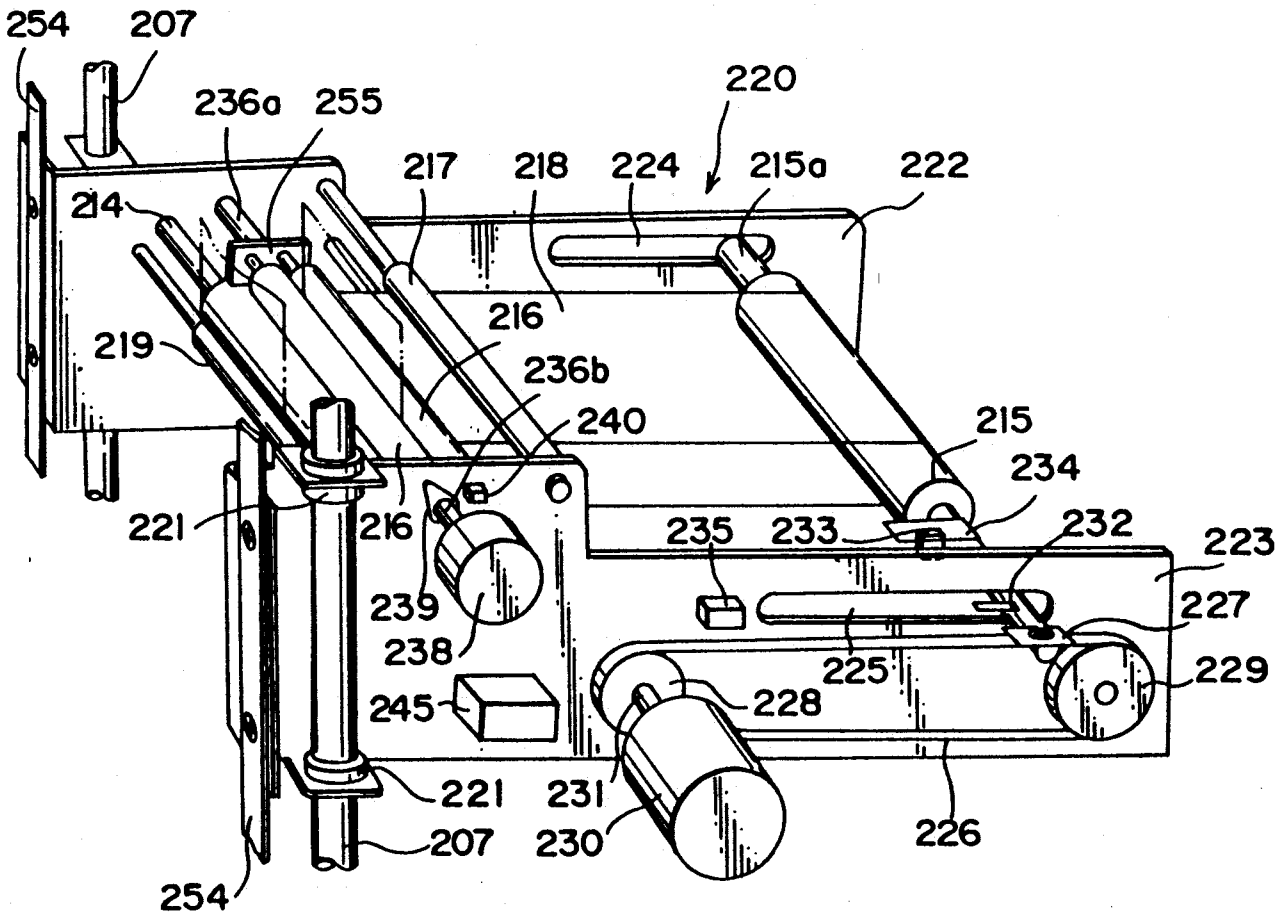
FIG. 18 is a perspective view of a paper feeding unit.
Figure 19:
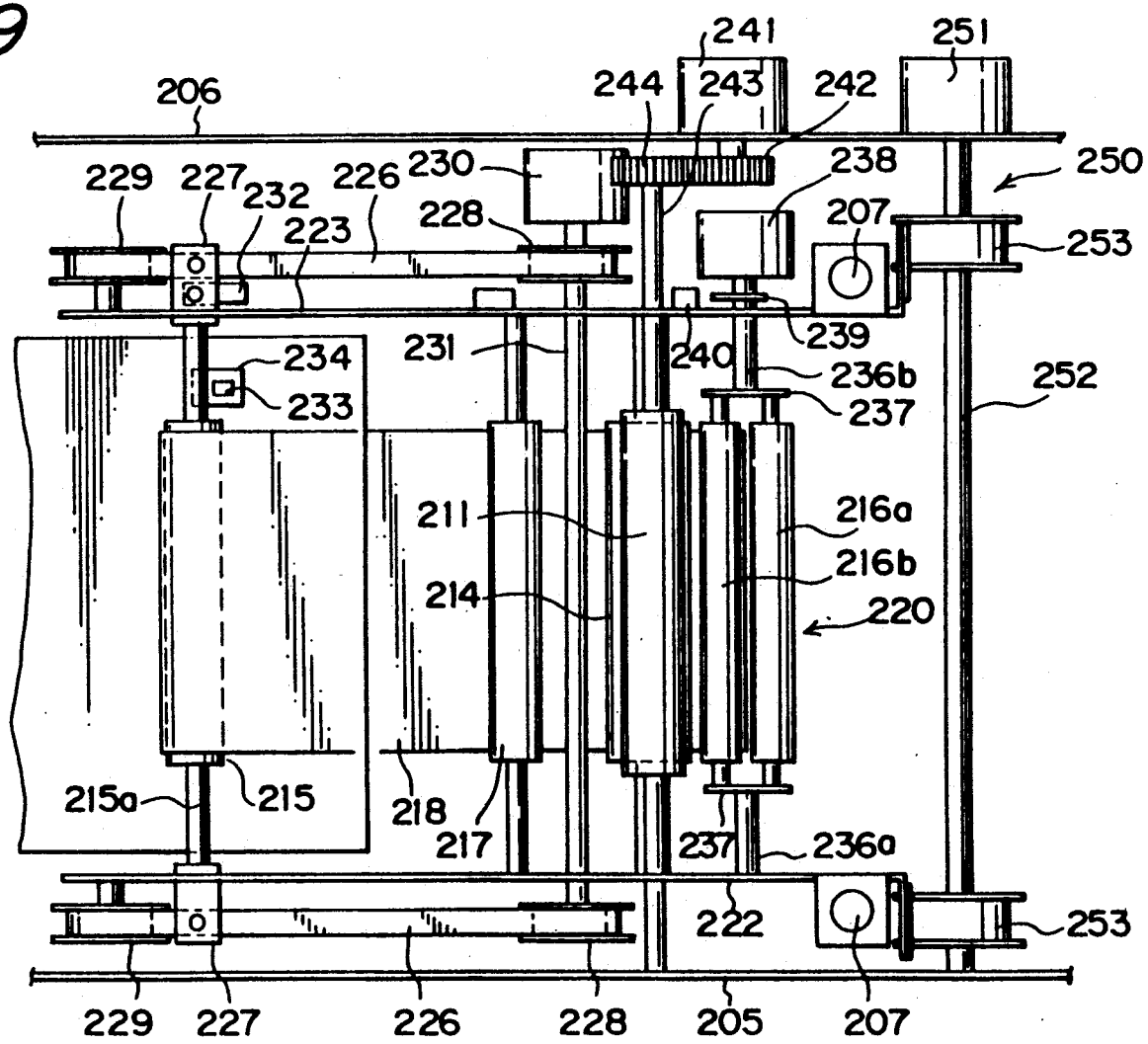
FIG. 19 is a plan view of the paper feeding unit.

In FIGS. 17 to 19, a guide rod 207 is approximately disposed vertically in each of a front side plate 205 and a deep side plate 206 of the paper bank device 4. A paper feeding unit 220 is guided by this guide rod 207 such that the paper feeding unit 220 is vertically slid. The paper feeding unit 220 has a paper feeding unit front side plate 222 and a paper feeding unit deep side plate 223. A bearing 221 is fixed to each of the paper feeding unit front side plate 222 and the paper feeding unit deep side plate 223 and is slidably attached to the guide rod 207. The driven roller 214, the pickup roller 215 and the auxiliary deflecting roller 217 are arranged such that both ends of each of these rollers are supported by the paper feeding unit front side plate 222 and the paper feeding unit deep side plate 223.

A pickup auxiliary roller 219 is opposed to the driven roller 214 and is arranged such that this pickup auxiliary roller 219 presses the PB endless belt 218 as a conveying belt against the driven roller 214. The pickup auxiliary roller 219 is rotatably supported by the paper feeding unit front side plate 222 and the paper feeding unit deep side plate 223. The pickup auxiliary roller 219 prevents a sheet of recording paper from being separated from the PB belt 218 when a conveying direction of the paper sheet is changed.

A shaft 215*a* rotatably supports the pickup roller 215. The shaft 215*a* is supported by the paper feeding unit front side plate 222 and the paper feeding unit deep side plate 223 such that both ends of the shaft 215*a* can be approximately moved in a horizontal direction in elongated holes 224 and 225 respectively formed in the paper feeding unit front side plate 222 and the paper feeding unit deep side plate 223. Further, each of the opposite ends of the shaft 215*a* of the pickup roller 215 is fixed to a timing belt 226 by a fitting 227. The timing belt 226 is wound around a driving pulley 228 and a driven pulley 229.

The driving pulley 228 is fixed to a common driving shaft 231 driven by a motor 230. This driving shaft 231 is rotatably supported by the paper feeding unit front side plate 222 and the paper feeding unit deep side plate 223. The driven pulley 229 is rotatably supported by shafts separately attached to the paper feeding unit front side plate 222 and the paper feeding unit deep side plate 223. The pickup roller 215 is reciprocated along the elongated holes 224 and 225 by rotating the motor 230 in normal and reverse directions. A feeler 232 for a home position and a bracket 234 are attached to the shaft 215*a* of the pickup roller 215. An upper end sensor 233 is attached to the bracket 234 and detects an upper end of sheets of recording paper.

A home position of the pickup roller 215 is detected by operating a home position sensor 235 attached to the paper feeding unit deep side plate 223 by the feeler 232 for a home position. The upper end sensor 233 detects that a paper feeding face of the PB belt 218 is located by 5 mm above the upper end of the sheets of recording paper. A paper feeding operation is performed from this position.

An elevating device 250 is disposed to raise and lower the paper feeding unit 220. The elevating device 250 is rotatably supported by a motor 251 fixed to the deep side plate 206 of the paper bank device, the deep side plate 206 and the front side plate 205. The elevating device 250 has a driving shaft 252 rotated by the motor 251 and two driving pulleys 253 fixed to this driving shaft 252 (see FIG. 19). The elevating device 250 also has driven pulleys 253' respectively supported rotatably by the deep side plate 206 and the front side plate 205. The elevating device 250 further has two timing belts 254 respectively wound around the driving pulleys 253 and the driven pulleys 253'. The timing belts 254 are respectively fixed to the paper feeding unit front side plate 222 and the paper feeding unit deep side plate 223. When the timing belts 254 are moved by rotating the motor 251 in normal and reverse directions, the paper feeding unit 220 is raised and lowered so that the paper feeding unit front side plate 222 and the paper feeding unit deep side plate 223 are raised and lowered.

A bracket 237 is fixed to a front shaft 236*a* rotatably supported by the paper feeding unit front side plate 222. Another bracket 237 is also fixed to a rear shaft 236*b* rotatably supported by the paper feeding unit deep side plate 223. Both end portions of the pair of belt speed changing rollers 216 (216*a* and 216*b*) are supported by both the brackets 237. Namely, the first belt speed changing roller 216*a* and the second belt speed changing roller 216*b* are supported by the brackets 237. Relative positions of the belt speed changing rollers 216*a* and 216*b* with respect to the PB belt 218 moved therebetween are displaced by rotating the shafts 236*a* and 236*b*.

The front shaft 236*a* and the rear shaft 236*b* are rotated by a motor 238 connected to the rear shaft 236*b*. A feeler 239 is fixed to the rear shaft 236*b*. The feeler 239 operates a sensor 240 fixed to the paper feeding unit deep side plate 223, thereby detecting the home position of the belt speed changing rollers 216. Before a paper feeding operation, a portion of the PB belt 218 is wound around the first belt speed changing roller 216*a* and the second belt speed changing roller 216*b* by rotating the shafts 236. In this winding state, the PB belt 218 wound by rotating the shafts 236 in an opposite direction is unwound during the paper feeding operation to control a feeding speed of the PB belt 218.

The PB belt 218 is driven and conveyed by rotating the driving roller 211 by a transmitting device having gears 242 and 244. The gear 242 is rotated by a motor 241 attached to the deep side plate 206. The gear 244 is engaged with the gear 242 and is fixed to a shaft 243 of the driving roller 211.

A charging roller is disposed to form an electric charge density pattern on the PB belt 218 so as to adsorb and convey a sheet of recording paper. In this embodiment, the auxiliary deflecting roller 217 is used as the charging roller, but a separate roller may be disposed as the charging roller. For example, an alternating voltage having $\pm 2\ KV_{p-p}$ and a frequency of 26 Hz is applied by a high voltage power source 245 to the charging roller 217 in a certain position before the charging roller 217 comes in contact with the sheet of recording paper. Thus, the electric charge density pattern is formed in the shape of a stripe on a surface of the PB belt 218. In this electric charge density pattern, for example, electric charge densities $-\sigma$ and $+\sigma$ are alternately arranged at a period or pitch of 5 mm.

The paper feeding unit 220 is raised and lowered in accordance with positions of the PB trays 201 to 204 for feeding the sheet of paper. At this time, the tension or adjusting roller 212 is moved in accordance with a movement of the driven roller 214 to constantly hold tensile force of the belt at any time. An end portion of the adjusting roller 212 supported by the front side plate 205 is connected to a spring 247 through a wire 246 (see FIG. 17). An end portion of the adjusting roller 212 supported by the deep side plate 206 is also connected to the spring 247 through the wire 246. The adjusting roller 212 is pulled in a direction in which tensile force is applied to the PB belt 218.

Opening/closing sensors 261 to 264 for the respective first to fourth PB trays 201 to 204 are disposed within a frame of the paper bank device 4 and detect opening and closing states of these trays (see FIG. 2).

Figure 20:
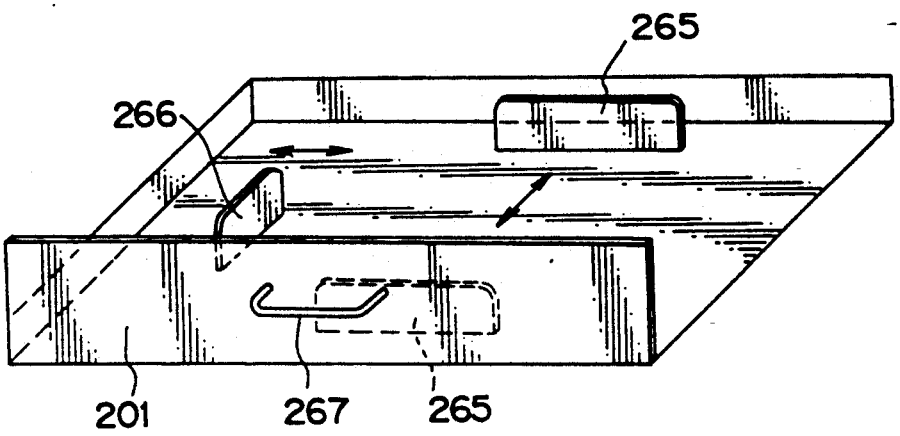
FIG. 20 is a perspective view showing one example of the storing means.

For example, as shown in FIG. 20, each of the first to third PB trays 201 to 203 is disposed as a small tray for storing 250 sheets of paper as a maximum loading capacity and has side fences 265 and an end fence 266 for positioning the sheets of paper stored into each of the trays. In the following description, the first PB tray 201 will be described. Three sides of the sheets of recording paper are guided by the side fences 265 and the end fence 266. A fence can be arranged at a front end of the PB tray in a paper feeding direction if no paper feeding operation is obstructed by this fence. The side fences 265 and the end fence 266 can be moved in arrow directions in FIG. 20 in accordance with a paper size. A grip 267 can be attached to a front face wall of the PB tray 201 to pull and push the PB tray 201.

Figure 21:
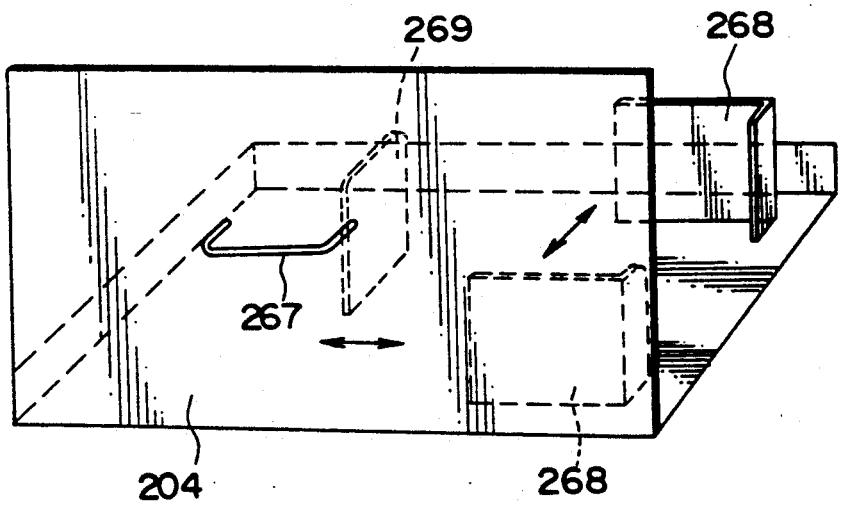
FIG. 21 is a perspective view showing another example of the storing means.

In FIG. 21, for example, the fourth PB tray 204 is disposed as a large tray for storing 2000 sheets of paper as a maximum loading capacity. Similar to the first PB tray 201 shown in FIG. 20, side fences 268, an end fence 269 and a grip 267 can be formed in the fourth PB tray 204. The fourth PB tray 204 has a large paper capacity. Accordingly, it is preferable to provide a structure for guiding front, rear, right-hand and left-hand sides of the sheets of paper by forming each of the side fences 268 in the shape of an L so as not to shift the sheets of paper from each other. In this case, the L-shaped side fences 268 are formed such that no paper feeding operation is obstructed by the side fences 268.

Figure 22:
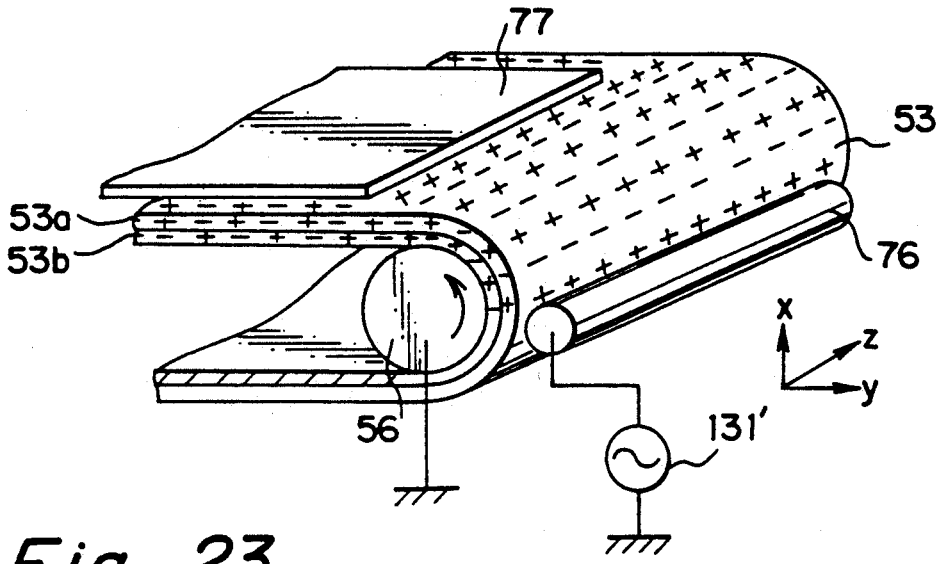
FIG. 22 is a perspective view for explaining the formation of an alternating electric field applied to a conveying means.

An electric charge density pattern is formed by the charging roller 76 on the PB belt 53 in the copying body 3 (see FIG. 22). The PB belt 53 adsorbs and conveys the sheet of recording paper in accordance with this electric charge density pattern. In the paper bank device 4, an electric charge density pattern is formed on the PB belt 218 by the auxiliary deflecting roller 217 acting as a charging roller to adsorb and convey the sheet of recording paper by the PB belt 218. To adsorb the sheet of recording paper, each of the conveying belt 53 and the PB belt 218 is formed by an endless belt in which a front face layer has a dielectric layer **53*a* capable of holding an electric charge and a rear face layer has a semiconductor layer 53*b*. At least one of rollers such as rollers 56 and 215 for supporting the conveying belt 53 and the PB belt 218 are connected to the ground and are arranged such that these rollers come in contact with respective rear faces of the belts 53 and 218**.

For example, as shown in FIG. 22, an alternating electric field (AHz) is applied from a high voltage power source 131' to the charging rollers 76 and 217 opposed to the ground roller 56. In FIG. 22, only the charging roller 76 is shown. The conveying belt 53 is moved by the driving roller 54 at a constant speed of U mm/s in an arrow direction in FIG. 22. A pickup roller coming in contact with the sheet of recording paper and attracting this sheet is located on a downstream side from a contact position between the conveying belt 53 and the charging roller 76 in a moving direction of the conveying belt 53. Accordingly, an alternating voltage is applied to the conveying belt 53 from the high voltage power source 131' through the charging roller 76 before the sheet of recording paper comes in contact with a front face of the conveying belt 53. Thus, an electric charge density pattern having a stripe shape is formed on the front face of the conveying belt 53. In this electric charge density pattern, electric charge densities $-\sigma$ and $+\sigma$ are alternately formed and arranged at a period of U/A mm. Charges having opposite signs are induced by the electric charge densities formed on the front face of the conveying belt in the semiconductor layer on a rear face of the conveying belt 53.

Figure 23:
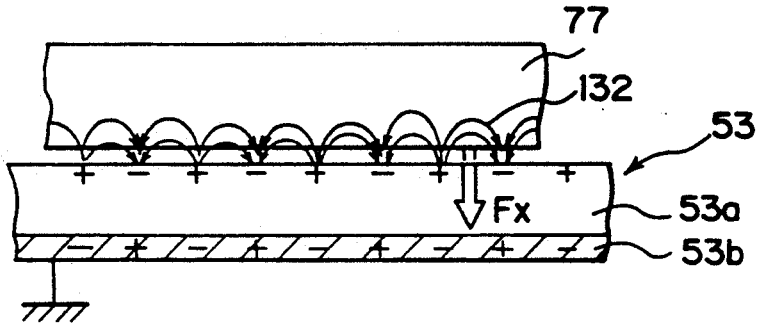
FIG. 23 is a front view for explaining the formation of the alternating electric field.

When the electric charge density pattern as shown in FIG. 22 is formed, a non-uniform electric field 132 is formed as shown in FIG. 23 in the vicinity of the front face of the conveying belt 53. Force applied by this electric field to a unit volume of a dielectric substance constituting the sheet 77 of recording paper can be calculated by the following formula using a Maxwell stress tensor. The sheet 77 of recording paper is electrostatically adsorbed and held by the conveying belt 53 by force Fx perpendicular to a sheet face without causing any shift in position of this sheet. Thus, the sheet 77 of recording paper is fed and conveyed by the conveying belt 53.

In the following description, reference numerals x and y respectively designate a direction perpendicular to the sheet face, and a conveying direction of the paper sheet. Reference numeral z designates a direction perpendicular to the conveying direction on the sheet face. Reference numerals Fx, Fy and Fz respectively designate components of the force applied to the unit volume of the dielectric substance in the x, y and z directions. In this case, the component forces Fx, Fy and Fz are respectively provided as follows.

The Maxwell stress tensor is provided as follows.

$$\begin{pmatrix} E_xD_x - \frac{1}{2}(E\cdot D) & E_xD_y & E_xD_z \\ E_yD_x & E_yD_y - \frac{1}{2}(E\cdot D) & E_yD_z \\ E_zD_x & E_zD_y & E_zD_z - \frac{1}{2}(E\cdot D) \end{pmatrix}$$

Accordingly, the component forces Fx, Fy and Fz of the force applied to the above unit volume are represented as follows:

$$f_x = \frac{\partial}{\partial x}\left\{E_xD_x - \frac{1}{2}(E\cdot D)\right\} + \frac{\partial}{\partial y}(E_xD_y) + \frac{\partial}{\partial z}(E_xD_z)$$

-continued $$f_y = \frac{\partial}{\partial x}(E_yD_x) + \frac{\partial}{\partial y}\left\{E_yD_y - \frac{1}{2}(E \cdot D)\right\} + \frac{\partial}{\partial z}(E_yD_z)$$

$$f_z = \frac{\partial}{\partial x}(E_zD_x) + \frac{\partial}{\partial y}(E_zD_y) + \frac{\partial}{\partial z}\left\{E_zD_z - \frac{1}{2}(E \cdot D)\right\}$$

This adsorbing principle is different from the principle of normally known attractive force between charges having different signs. In accordance with this adsorbing principle, the sheet of recording paper can be adsorbed to the conveying belt 53 by using the above-mentioned method without giving any charge to the sheet of recording paper. Therefore, there is no influence of the adsorbing force in a transfer process even when this adsorbing principle is used in a paper feeding-/conveying apparatus of an electrostatic recorder.

In the above embodiment, the electric charge density pattern has a stripe shape. However, the electric charge density pattern may have a suitable shape such as a chechered shape.

Figure 24:
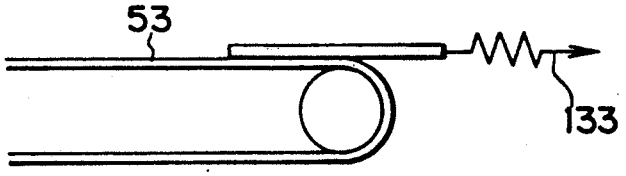
FIG. 24 is a view for explaining a method for testing attractive force generated by the alternating electric field.
Figure 25:
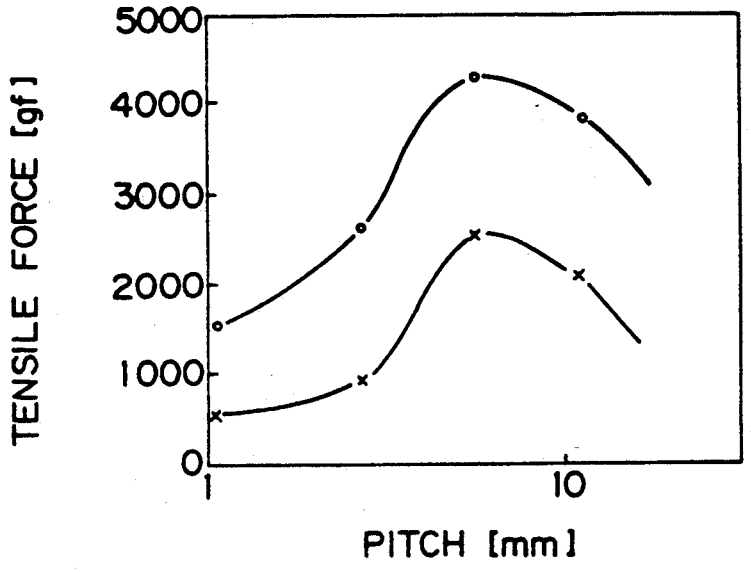
FIG. 25 is a graph showing the relation between a pitch of the alternating electric field and tensile force indicative of the attractive force.

As shown in FIG. 24, a sheet of plain paper having size A3 is fed to the conveying belt. When a contact length between the paper sheet and the conveying belt reaches 100 mm, the adsorbing force is measured as a tensile strength by attaching a spring balance 133 to the paper sheet at a rear end thereof. The results of this measurement are shown in FIG. 25. At this time, an adsorbing area is set to 300 $cm^2$.

Figure 26:
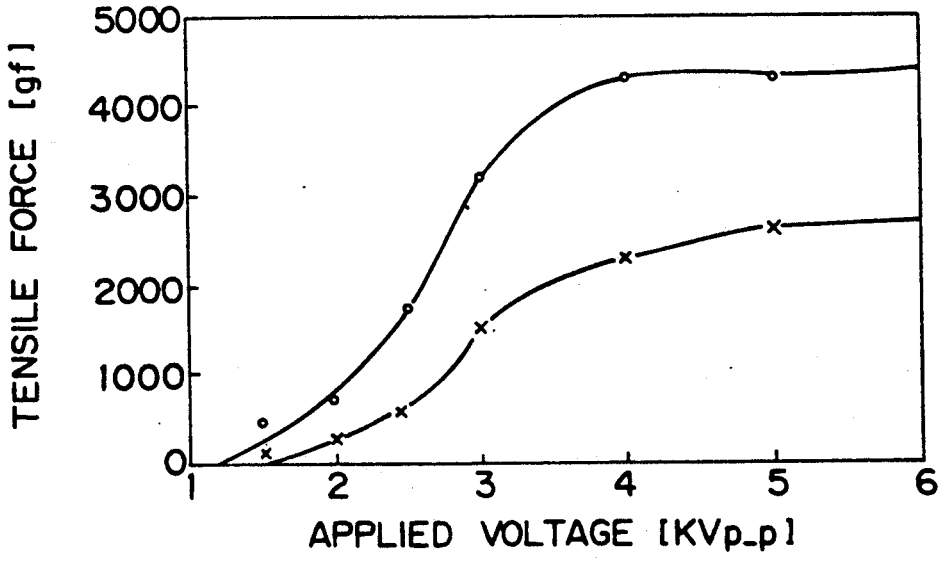
FIG. 26 is a graph showing the relation between an applied voltage of the alternating electric field and the tensile force.

In FIG. 25, the adsorbing force is measured when the alternating voltage has e.g., 4 KVp-p and has a constant amplitude and an applied frequency is changed. In the present invention, sufficient adsorbing force can be obtained when the period of the stripe shape is set in the range of a pitch equal to or smaller than 20 mm, especially, 10 mm. As shown in FIG. 26, the adsorbing force is measured when the applied frequency is set to a constant frequency such as 26 Hz and the applied voltage is changed. As a result, preferable adsorbing force can be obtained when the alternating voltage is equal to or greater than 2 KVp-p. At this time, it is found by measuring a surface potential that no charge density pattern is formed on the belt at the applied voltage at which no adsorbing force is generated. Accordingly, at least an applied voltage equal to or higher than a voltage for starting a charging operation is required to generate the adsorbing force.

Such an applied voltage is similarly required when the applied voltage is provided by superimposing a direct current component on the alternating voltage and a non-uniform alternating voltage is applied to the belt from a power source for outputting the non-uniform alternating voltage.

FIG. 22 shows a structure of the conveying belt 53 used in the paper feeding/conveying apparatus in the present invention. The conveying belt 53 is constructed by an endless belt of a two-layer type. A front face or upper layer of the conveying belt 53 is formed by a dielectric film constructed by resin including polyester and having a thickness of 20 μm and a volume resistivity of $10^{16}$ Ωcm. A lower layer of the conveying belt 53 is formed by a semiconductor layer constructed by resin which includes polyester having dispersed carbon and has a thickness of 80 μm and a volume resistivity of $10^8$ Ωcm. The conveying belt 53 is rotatably supported by a driving roller and a plurality of support rollers. An alternating voltage having ±2 kV and a frequency of 24 Hz is applied to the charging roller 76 from the high voltage power source 131'. The conveying belt 53 is moved by the driving roller at a constant speed of 120 mm/s in the arrow direction in FIG. 22. A feeding position of the sheet of recording paper is located on a downstream side from a constant position of an electrode of the charging roller 76 in a moving direction of the conveying belt 53. Accordingly, before the sheet of recording paper is fed onto a front face of the conveying belt 53, an electric charge density pattern is formed on the front face of the conveying belt 53 at a period or pitch of 5 mm. The volume resistivity of the conveying belt 53 on a rear face thereof is set to $10^8$ Ωcm because a volume resistivity equal to or greater than $10^7$ Ωcm is required to dispose a transfer means on the rear face of the conveying belt 53 and perform a transfer operation. Further, adsorbing force is increased when a difference in volume resistivity between the front and rear faces of the conveying belt 53 is increased. However, no functional problem is caused when the volume resistivity of the conveying belt 53 on the rear face thereof is substantially ranged from $10^7$ Ωcm to $10^{11}$ Ωcm.

In FIG. 23, the PB belt 218 is used in the paper feeding/conveying apparatus of the paper bank device 4 in the present invention. This PB belt 218 is constructed by an endless belt of a two-layer type in which a front face or upper layer is formed by a dielectric film (PET 50 μm) and a lower layer is formed by evaporation of aluminum. The PB belt 201 is rotatably supported by a driving roller and a plurality of support rollers.

A volume resistivity of this dielectric substance of the PB belt 218 is set to $10^{16}$ Ωcm. An alternating voltage having ±2 KV and a frequency of 26 Hz is applied to the charging roller 217 from the high voltage power source B. The PB belt 218 is moved by the driving roller at a constant speed of 130 mm/s in the arrow direction in FIG. 17. A feeding position of the sheet of recording paper is located on a downstream side from a constant position of an electrode of the charging roller 217 in a moving direction of the PB belt 218. Accordingly, before the sheet of recording paper is fed into a front face of the PB belt, an electric charge density pattern is formed on the front face of the PB belt at a period or pitch of 5 mm.

The PB belt 218 in the paper bank device 4 adsorbs and feeds the sheet of recording paper from the first to fourth PB trays 201 to 204. The elevating device 250 is operated to adsorb and feed the paper sheet so that the paper feeding unit 220 is vertically moved in front of the first to third PB trays 201 to 203 and is stopped in paper feeding home positions of the first to third PB trays 201 to 203. In FIG. 17, a position of the fourth PB tray 204 is shifted from positions of the first to third PB trays 201 to 203 so that the paper feeding unit 220 can be directly moved onto an upper side of the sheets of recording paper stored within the fourth PB tray 204. However, it is possible to construct the PB trays such that the fourth PB tray is aligned with the first to third PB trays 201 to 203 and the paper feeding unit 220 is vertically moved in front of the fourth PB tray 204.

For example, the paper feeding home position of each of the PB trays is set to a position located by a constant distance such as 5 mm above an upper end of the sheets of recording paper. When the paper feeding unit 220 is moved to the paper feeding home position of a selected PB tray, the PB belt 218 is located by 5 mm above the upper end of the sheets of recording paper.

When the PB belt 218 comes in contact with a sheet of recording paper and adsorbs and feeds this paper sheet, a relative speed of a paper contact portion of the PB belt with respect to the sheet of recording paper is changed until an approximately zero speed.

A feeding speed changing means such as the pair of belt speed changing rollers 216 (216*a* and 216*b*) is used to change the feeding speed of a portion of the PB belt 218, i.e., the relative speed thereof with respect to the sheet of recording paper at rest.

Figure 27:
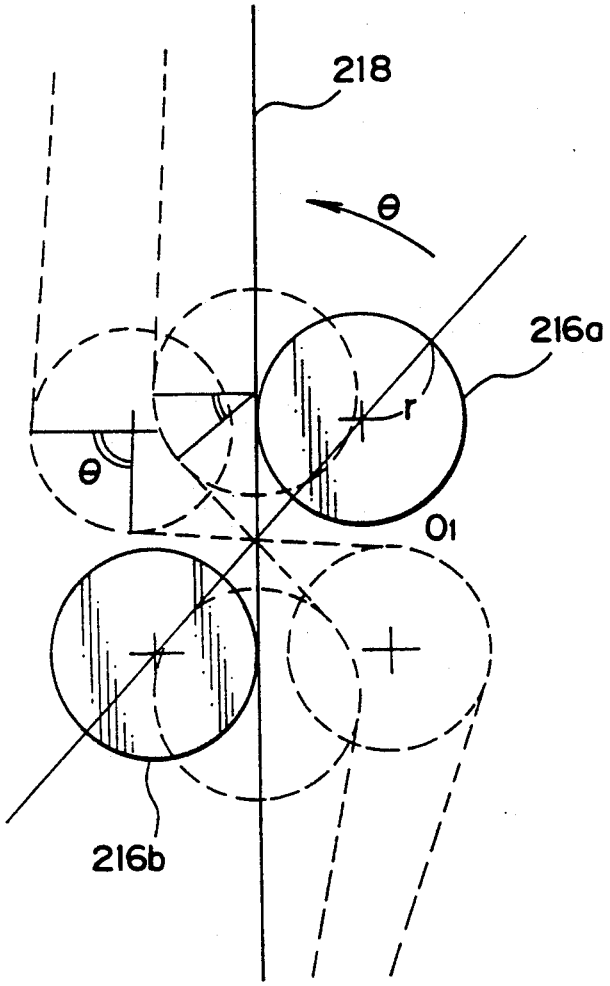
FIG. 27 is a view for explaining another example of the conveying means speed changing device.

In FIG. 27, for example, each of the belt speed changing rollers 216*a* and 216*b* has a diameter of 8 mm and a distance between centers of the belt speed changing rollers 216*a* and 216*b* is set to 12 mm. The belt speed changing rollers 216*a* and 216*b* are approximately rotated by a motor 238 around a central point between axes of these rollers to wind and unwind the PB belt 218 from the belt speed changing rollers 216*a* and 216*b*. In FIG. 27, each of the belt speed changing rollers 216*a* and 216*b* is rotated by an angle of $\theta$ (rad) around a center $0_1$ from a releasing or unwinding position thereof shown by a solid line in which the PB belt 218 simply comes in contact with each of the belt speed changing rollers 216*a* and 216*b*.

When no PB belt 218 is moved and conveyed, a moving amount l of the PB belt 218 provided by rotating the belt speed changing rollers 216*a* and 216*b* by the angle $\theta$ (rad) is represented as follows.

$$l=2\ \gamma\theta+1\ 2\ (1-\cos\theta)$$

In this formula, reference numeral $\gamma$ designates a winding radius of each of the belt speed changing rollers 216*a* and 216*b*.

A displacing speed V is represented as follows by differentiating the above moving amount with respect to time using the relation of $\theta=\omega t$.

$$V=2\gamma\omega+1\ 2\omega\ \sin\ \omega t$$

In this formula, reference numeral $\omega$ designates an angular velocity of the rotation of each of the belt speed changing rollers.

Figure 28A:
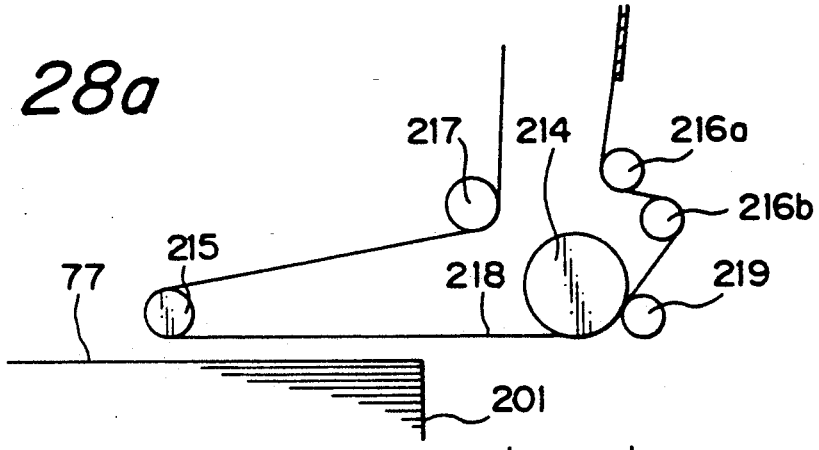
FIGS. 28*a*, 28*b* and 28*c* are views for sequentially showing operating states of the conveying means speed changing device shown in FIG. 27.

When the PB belt 218 is moved at an equal speed of 130 mm/sec and the paper feeding unit 220 is lowered at a speed of 150 mm/sec, the PB belt 218 is moved at a speed of 280 mm/sec in a contact region thereof coming in contact with the sheet of recording paper. Accordingly, it is necessary to cancel this speed 280 mm/sec so as to stop the PB belt 218 in the paper contact region thereof. When the above displacing speed V is set to 280 mm/sec to cancel this speed 280 mm/sec, it is possible to obtain the angular velocity $\omega$, i.e., a driving or rotational speed of the motor 238 for rotating the shafts 236. Namely, in the case of the first to third PB trays 201 to 203, the paper feeding unit 220 is lowered at the speed of 150 mm/sec from a paper feeding home position shown in FIG. 28*a* to a position coming in contact with the sheet of recording paper and shown in FIG. 28*b*. At this time, as shown in FIG. 28*a*, for example, the belt speed changing rollers 216*a* and 216*b* are rotated in a direction such as the clockwise direction in which the PB belt 218 is unwound from the belt speed changing rollers 216*a* and 216*b* from winding states thereof. A contact portion of the PB belt 218 coming in contact with the sheet of recording paper almost attains a stationary state and the sheet of recording paper is then electrostatically adsorbed by an electric charge density pattern of the PB belt 218. Thereafter, the paper feeding unit 220 is returned to a paper feeding home position shown in FIG. 28*c*.

Figure 29A:
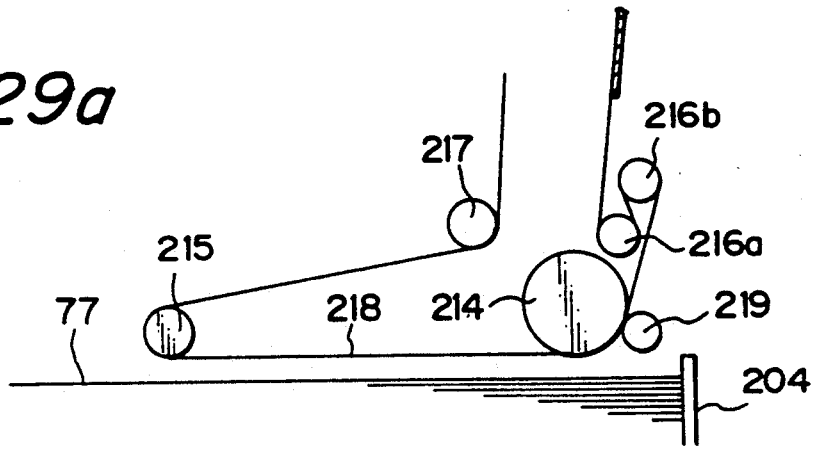
FIGS. 29*a*, 29*b* and 29*c* are views corresponding to FIGS. 28*a*, 28*b* and 28*c* in an example in which relative positions of the conveying means and the storing means are different from each other.
Figure 29B:
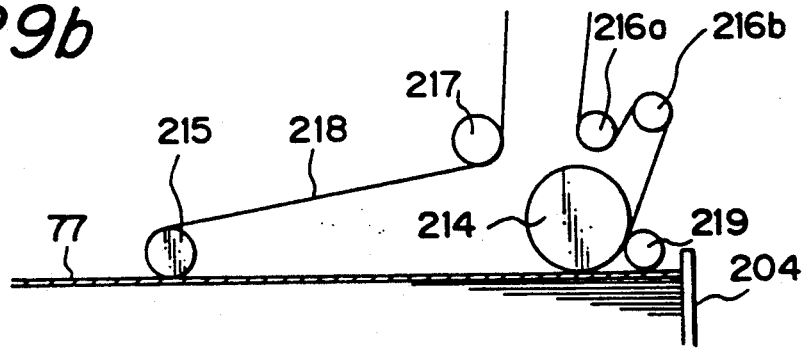
Figure 29C:
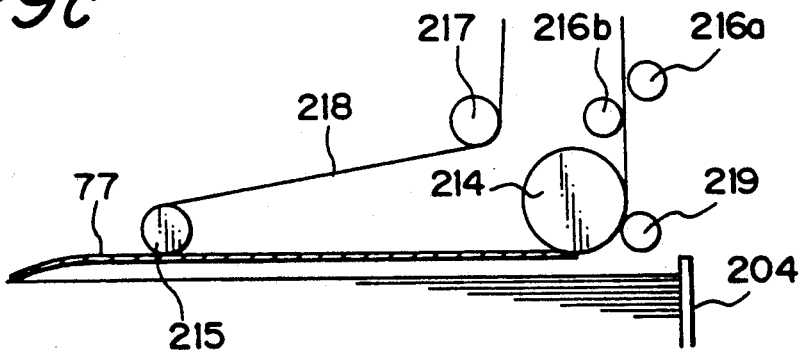

Similar to the above first to third PB trays, a sheet 77 of recording paper is attracted and fed by the belt in the case of the fourth PB tray 204. In the case of the fourth PB tray 204, the sheet 77 of recording paper is attracted in a state in which a front end portion of the paper sheet is separated from the contact region of the PB belt 218. Accordingly, when the sheet of recording paper is conveyed in this state, the sheet of recording paper is sequentially separated from the PB belt 218 from the front end portion thereof. Therefore, the PB belt 218 is lowered from a paper feeding home position shown in FIG. 29*a* to a position shown in FIG. 29*b* and comes in contact with the sheet 77 of recording paper in a state in which the PB belt 218 is at rest. After the sheet 77 of recording paper is attracted by the PB belt 218, the PB belt 218 is moved backward by a constant distance to a position in which a front end of the sheet of recording paper comes in contact with the driven roller 214 while the paper feeding unit 220 is raised and returned to the paper feeding home position as shown in FIG. 29*c*.

For example, when the PB belt 218 is moved backward by 20 mm, a time for returning the paper feeding unit 220 to the paper feeding home position is provided as follows.

$$5\ (\text{mm})/150\ (\text{mm/sec})=0.033(\text{sec})$$

A reverse linear velocity of the PB belt 218 is provided as follows.

$$20\ (\text{mm})/0.033(\text{sec})=600\ (\text{mm/sec})$$

The PB belt 218 is moved and conveyed at an equal speed of 130 mm/sec. Accordingly, when the paper feeding unit 220 is raised at a speed of 150 mm/sec, the PB belt 218 is unwound from the belt speed changing rollers 216*a* and 216*b* such that the PB belt 218 is returned at a speed of 580 mm/sec on a contact face thereof coming in contact with the sheet of recording paper. This speed 580 mm/sec is calculated as follows.

$$600+130-150=580\ \text{mm/sec}$$

Therefore, the above displacing speed V is set to 580 mm/sec to control a rotating speed of the motor 238.

The belt speed changing rollers 216*a* and 216*b* are rotated between adjacent conveyed sheets of recording paper so as to reduce the speed of the PB belt 218 in the recording paper contact region thereof in a process for feeding the next sheet of recording paper.

Figure 30:
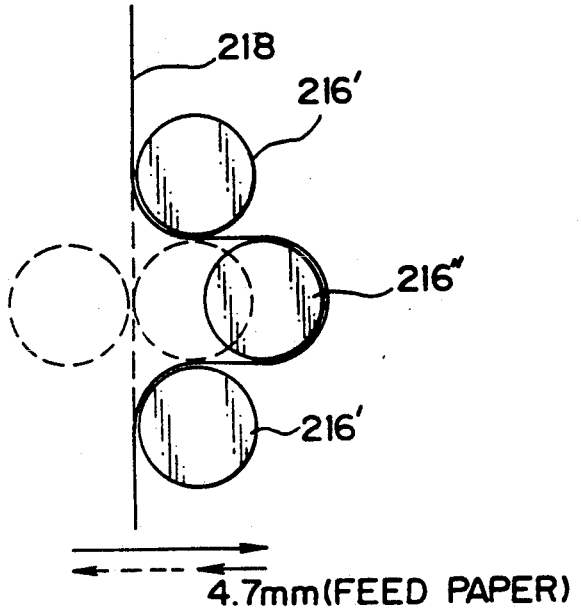
FIG. 30 is a view for explaining another example of the conveying means speed changing device.
Figure 31:
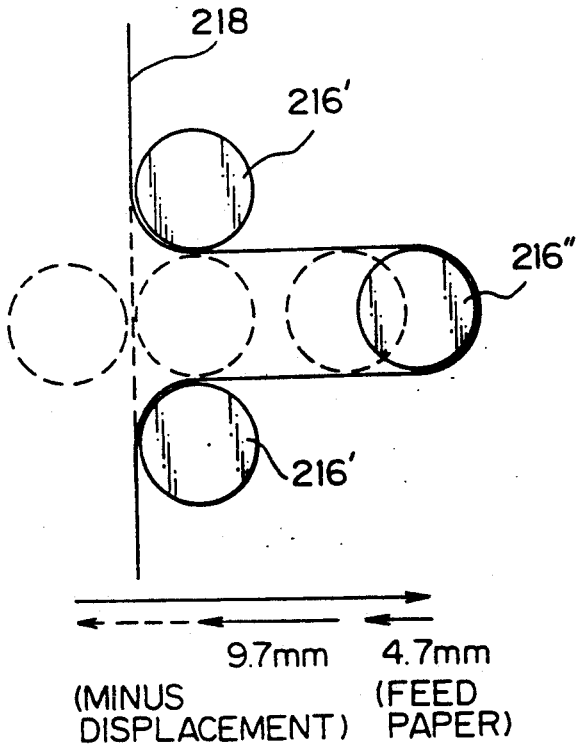
FIG. 31 is a view corresponding to FIG. 30 in an example in which a speed changing step is changed in comparison with that shown in FIG. 30.

FIGS. 27 to 29 show a structure for rotating two rollers 216*a* and 216*b*. In contrast to this, as shown in FIGS. 30 and 31, it is possible to use a structure having two fixed roller 216' and one speed changing roller 216'' arranged therebetween. FIG. 30 shows an example in which the fixed rollers 216' and the speed changing roller 216'' are used in the case of the first to third PB trays 210 to 203 as shown in FIG. 28. FIG. 31 shows an example in which the fixed rollers 216' and the speed changing roller 216'' are used in the case of the fourth PB tray 204 as shown in FIG. 29. In FIG. 30, the speed changing roller 216'' is moved to a paper feeding home position shown by a solid line. While the speed changing roller 216'' is lowered from this paper feeding home position to a position coming in contact with the sheet of recording paper, the speed changing roller 216" is moved leftward in FIG. 30 to reduce the speed of the PB belt or stop this PB belt in the recording paper contact region thereof. The speed changing or displacing roller 216" is displaced to a leftmost position thereof in FIG. 30 in a position in which the speed displacing roller 216" is again returned to the paper feeding home position.

In FIG. 31, a process for displacing the recording paper contact region of the PB belt backward in an opposite direction is additionally set in the example of FIG. 30.

The paper feeding unit 220 is lowered by 5 mm from the paper feeding home position at the speed of 150 mm/sec and comes in contact with the sheet of recording paper. A time from this paper feeding home position to the contact between the paper feeding unit 220 and the paper sheet is provided as follows.

$$5\ (\text{mm})/150\ (\text{mm/sec})=0.033\ \text{sec}$$

In the meantime, the PB belt 218 displaces the displacing roller 216" at a speed of 280 mm/sec in a minus displacing direction so as to cancel the movement of the PB belt at the equal speed of 130 mm/sec and a lowering displacement caused by lowering the paper feeding unit 220 at the speed of 150 mm/sec. This displacing operation of the PB belt is performed for a time of 0.033 seconds and a displacing amount is provided as follows.

$$280\ (\text{mm/sec})\times 0.033(\text{sec})=9.3\ (\text{mm})$$

Accordingly, it is sufficient to set a displacing speed of the displacing roller 216" as follows.

$$280\ (\text{mm/sec})/2=140\ (\text{mm/sec})$$

Further, a displacing amount of the displacing roller 216" is set as follows.

$$9.3\ (\text{mm})/2=4.7\ (\text{mm})$$

It is sufficient to move the displacing roller 216" leftward in FIG. 31 at the equal displacing speed.

In FIG. 31, a front end portion of the sheet of recording paper is further fed reversely until a position of the driven roller 214. Accordingly, the displacing roller 216" is moved leftward in FIG. 31 by a displacing distance of 9.7 mm at an equal speed of 290 mm/sec.

The speed changing operation of the PB belt is performed until a point at which an axis of the displacing roller 216" is moved leftward from a line connecting axes of the fixed rollers 216' to each other. Namely, this speed changing operation is performed by a total displacing distance of 14.4 mm by equal speed control.

An electric construction of the copying machine in the present invention will next be explained.

Figures 32, 32A:
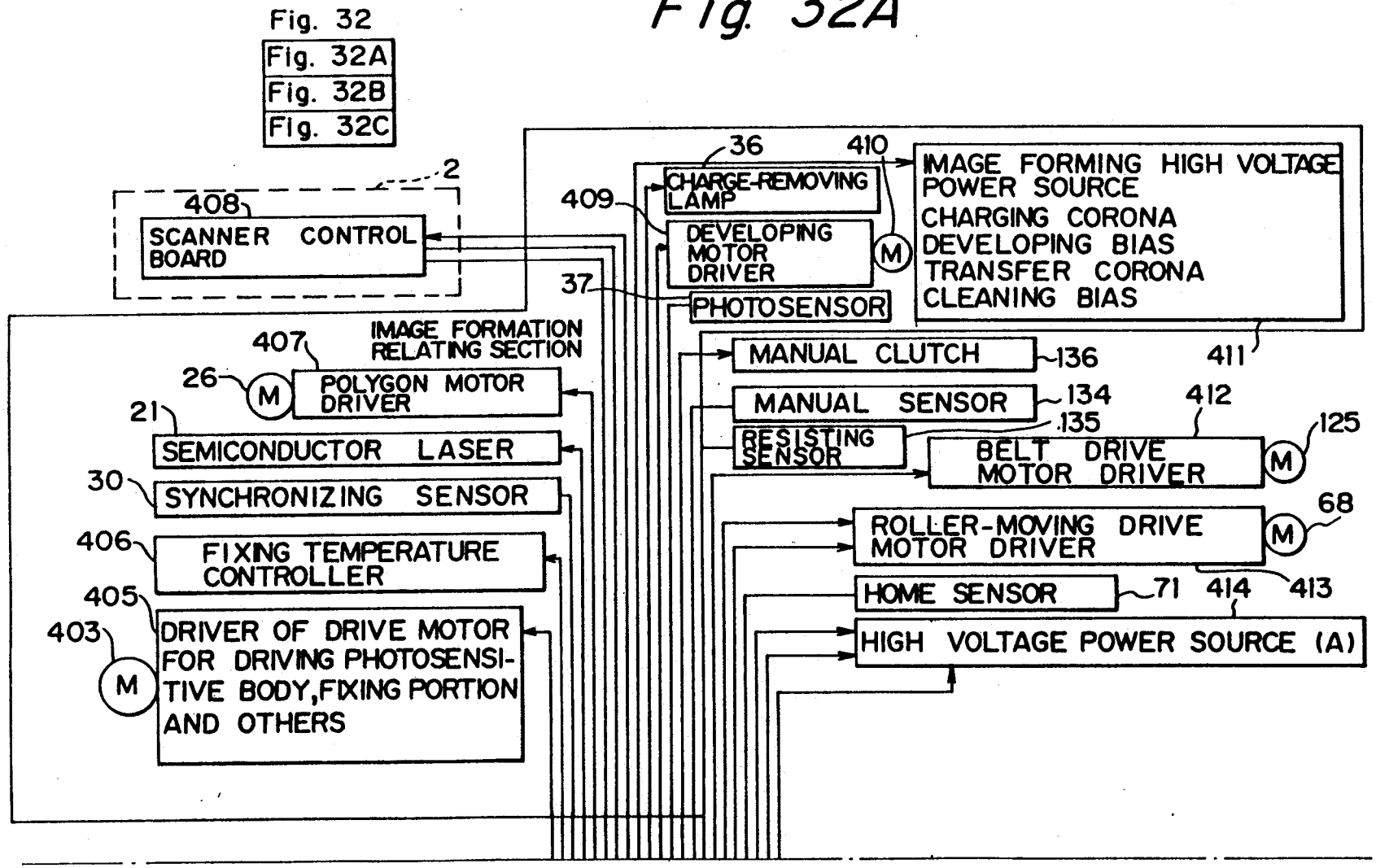
FIGS. 32A, 32B and 32C is a block diagram of an electric system disposed in a controller.
Figure 32B:
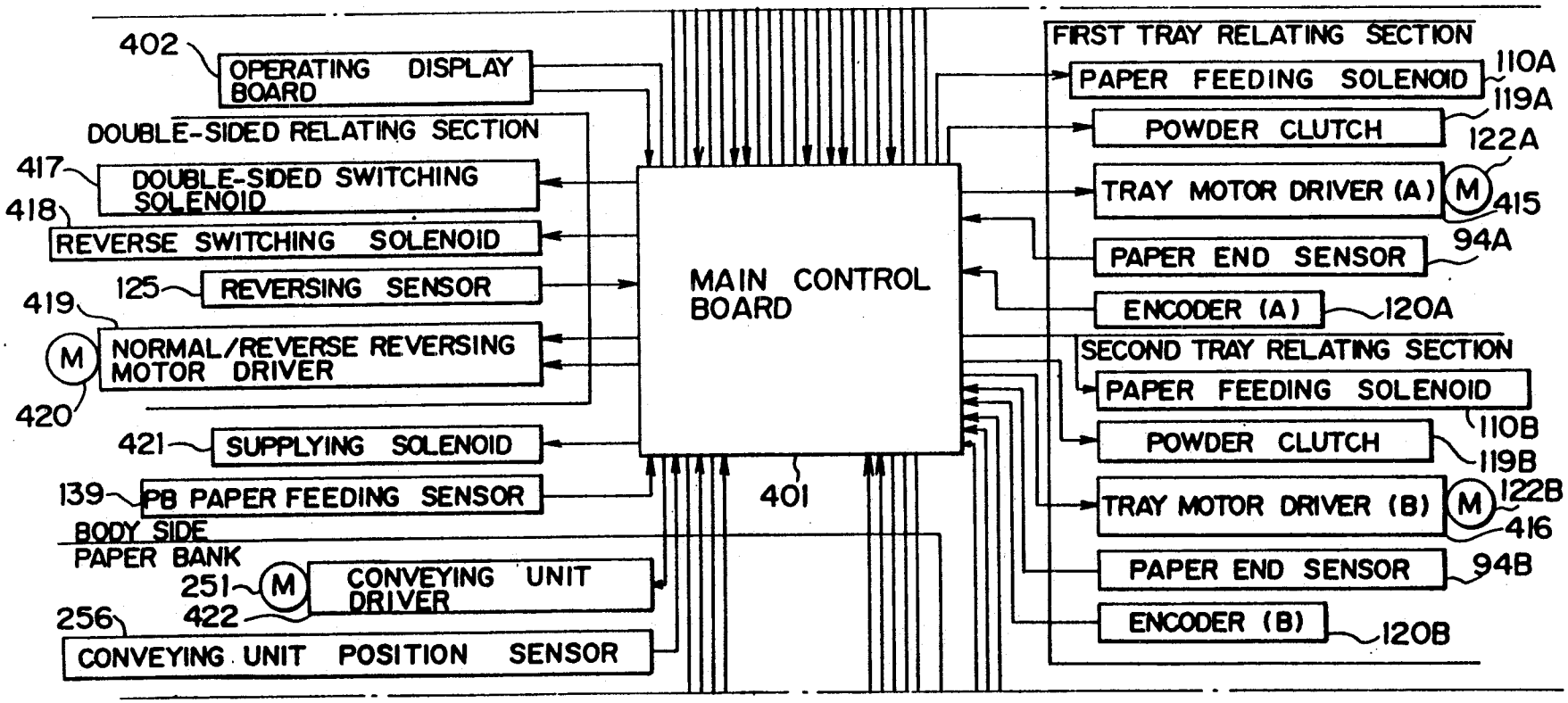
Figure 32C:
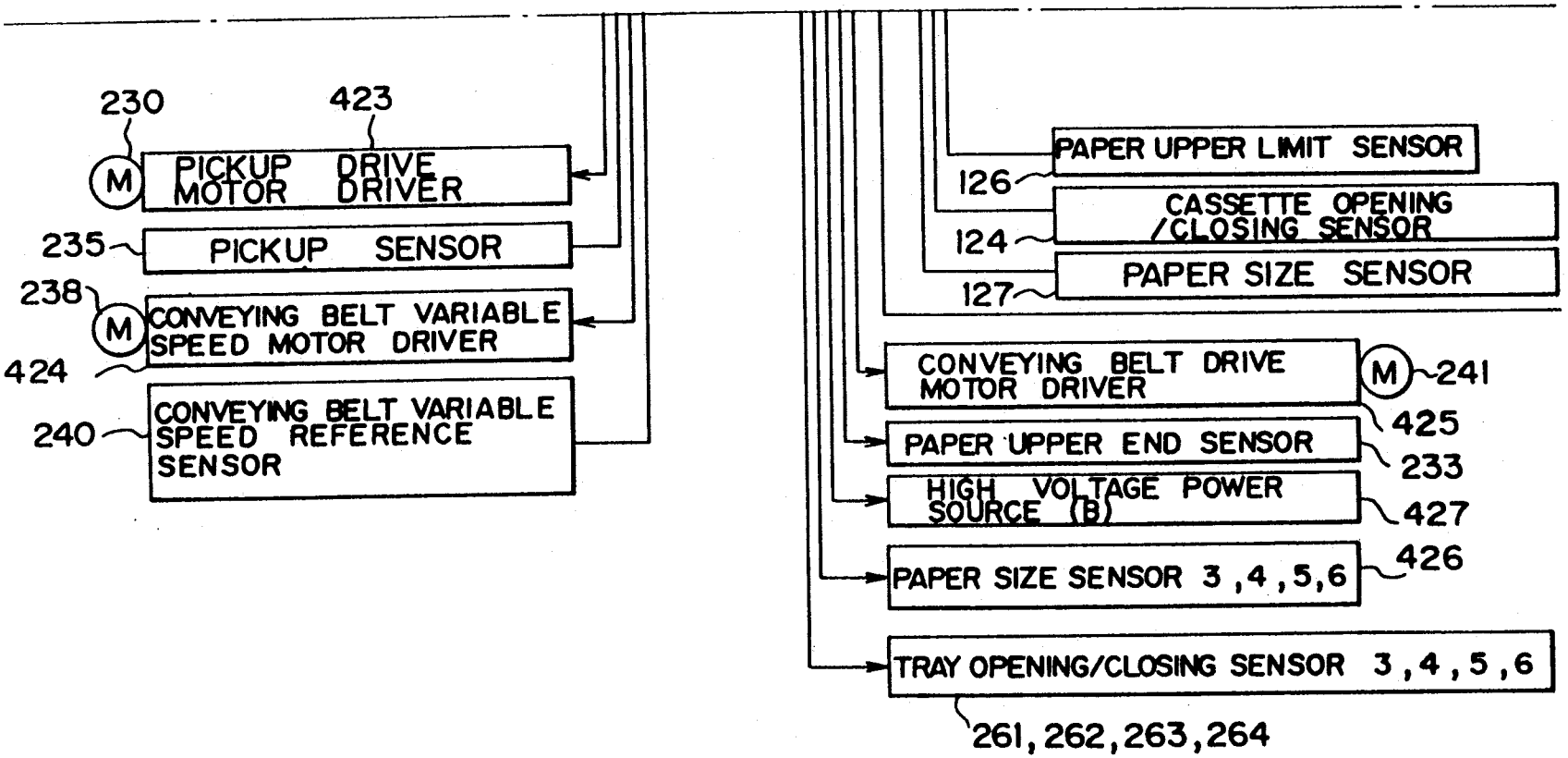

In FIG. 32, the interior of a main control board 401 is constructed by a CPU, a ROM, a RAM, a timer, I/O ports, serial electric circuits, etc. The interior of the main control board 401 may be constructed by a one-chip CPU including functions of these constructional elements. Entire sequential control of the copying machine is performed by the main control board 401.

The copying machine is generally divided into a copying body side and a paper bank side and explanations thereof will next be described.

An electric system of the copying body side will first be explained. The copying body side is generally divided into sections of image formation, the first PB tray, the second PB tray, a double-sided copy, paper conveyance and others in accordance with function.

The section of others will first be explained. An operating display board 402 can setting a write timing of the image data.

A charge-removing lamp 36 removes a charge from the photosensitive body having an electric potential. Reference numerals 410 and 409 respectively designate a developing motor and a driver thereof. A photodetector or photosensor 37 detects a standard pattern. A high voltage power source 411 for an image forming system can separately turn on and off the constructional portions of a charge corona, a developing bias, a transfer corona and a cleaning bias.

An electric system of the copying machine with respect to the first tray 52' of the paper feeding tray 52 will next be explained. Reference numerals 110A and 119A respectively designate a paper feeding solenoid and a powder clutch. Reference numerals 122A and 415 respectively designate a PB tray motor and a driver for driving this motor. This PB tray motor is constructed by a stepping motor. When the driver 415 receives a pulse signal from the main control board 401, the driver 415 energizes the stepping motor to control a moving amount and a moving speed of the PB tray by the number of pulses and a pulse frequency, respectively. be serially communicated with the main control board 401 to receive and transmit commands and data therebetween. Reference numeral 2 designates a scanner section. A scanner control board 408 transfers data of a read image and receive and transmit commands and these data. This scanner section does not directly relate to the present invention and an explanation about this scanner section will be therefore omitted in the following description.

The section of image formation will next be explained. A main motor 403 drives a photosensitive body, a fixing device, a cleaner, driving rollers of other conveyers, etc. Reference numeral 405 designates a driver of this main motor 403. A fixing temperature controller 406 constantly holds a fixing temperature.

Image data are read out of a scanner and are transmitted to a semiconductor laser 21. A laser beam as a signal of the image data is emitted from the semiconductor laser 21 by a polygon motor 26 driven by a polygon motor driver 407 to perform a main scanning direction. A synchronizing sensor 30 is a sensor for In this embodiment, this driver is used in a self-starting frequency region, but slow-up and slow-down controls may be performed when loading torque of the stepping motor is large.

An encoder 120A is used to detect the remaining amount of sheets of recording paper. A paper end sensor 94A detects whether there are sheets of recording paper on the first tray or not.

A paper feeding solenoid 110B, a powder clutch 119B, a tray motor 122B, a driver 416 thereof, a paper end sensor 94B and an encoder 120B constitute an electric system of the copying machine for performing operations relative to the paper feeding operation of the second tray 52" and have structures and functions similar to those in the case of the first tray.

The section of paper conveyance will next described. A manual clutch 136 is driven at a manual paper feeding time to manually convey a sheet of recording paper. A manual sensor 134 detects a position of the sheet of recording paper at the paper feeding time.

A belt drive motor 125 and a driver 412 thereof rotate the conveying belt 53 at a constant speed. In this embodiment, the belt drive motor 125 is constructed by a stepping motor rotated by a pulse signal from the main control board 401.

A resisting sensor 135 detects a front end of the sheet of recording paper fed and conveyed from each of the first tray 52' and the second tray 52''. The resisting sensor 135 then calculates a timing for starting a laser writing operation and further determines a timing for turning on and off the image forming system and a double-sided conveying system.

Reference numerals 68 and 413 respectively designate a roller moving drive motor and a driver thereof. Similar to the above belt drive motor 125, the roller moving drive motor 68 is rotated by a pulse signal from the main control board 401. A pulse signal is inputted to this driver 413 to set a feeding speed of the conveying belt 53 to zero and is set to have a frequency half that of a pulse signal added to the belt drive motor driver 412, thereby stopping the rotation of the conveying belt. Further, the moving direction of a pickup roller can be controlled by a clockwise/counterclockwise switching signal of the driver 413 (or a CW/CCW switching signal). In this case, the clockwise direction of this roller is a direction for temporarily stopping the movement of the conveying belt 53. The counterclockwise direction of this roller is a direction for escaping this roller to a home position thereof.

A home sensor 71 detects the home position of a first driven roller.

A high voltage power source (A) 414 generates an alternating high voltage and forms an electric charge pattern having positive and negative signs on the conveying belt 53 by applying the high voltage onto this conveying belt in accordance with the movement thereof. A non-uniform electric field is formed by this electric charge pattern so that a sheet of recording paper can be electrostatically adsorbed onto the conveying belt 53. Adsorbing force of this electric charge pattern having positive and negative signs depends on a pitch and an applied voltage level. The adsorbing force is maximized at a suitable pitch. The sheet of recording paper is fed and conveyed in a region of this maximum adsorbing force. A frequency of the applied voltage for providing the maximum adsorbing force is determined at a certain conveying speed of the conveying belt 53. When the pitch of the electric charge pattern is reduced and the frequency of the applied voltage is thereby increased, the adsorbing force becomes zero at a certain pitch. Accordingly, effects similar to effects of the removal of charges from the conveying belt 53 can be obtained at this certain pitch providing the zero adsorbing force. An operation of the high voltage power source is controlled by three signal lines to adsorb the sheet of recording paper and remove the charges from the conveying belt and switch high voltage levels in accordance with a thick sheet of paper.

A paper upper limit sensor 126, a tray opening/closing sensor 124 and a paper size sensor 93 relate to the paper feeding tray 52 or the first and second trays 52' and 52''.

The section of double-sided image formation will next be explained. A double-sided switching solenoid 417, a reverse switching solenoid 418, a reversing sensor 125, a normal/reverse reversing motor 420 and a driver 419 thereof constitute an electric system of the double-sided image forming section. The double-sided switching solenoid 417 switches a claw 41. The reverse switching solenoid 418 switches the first switching claw **46*a* and the second switching claw 46*b*. The reversing sensor 125 detects whether or not there is a sheet of recording paper at a double-sided image forming time and sets timings of normal and reverse signals transmitted to the normal/reverse reversing motor 420 and its driver 419. This normal/reverse reversing motor 420** is constructed by a motor rotated in normal and reverse directions at a linear velocity higher than that of a system for forming an image and conveying the sheet of recording paper.

A supplying solenoid 421 switches a switching claw 138 for supplying sheets of recording paper from the paper bank device 4 onto the first tray 52'. A paper bank paper feeding sensor 139 detects a front end of a sheet of recording paper from the paper bank side and adjusts timings for turning on and off respective loads on the copying body side.

An electric system of the copying machine on the paper bank side will next be decribed.

In FIG. 32, reference numerals 241 and 425 respectively designate a PB belt drive motor and a driver thereof for conveying a sheet of recording paper onto the copying body side. In this embodiment, the PB belt drive motor 241 is constructed by a stepping motor.

Reference numerals 251 and 422 respectively designate a paper feeding unit drive motor and a driver thereof for moving the paper feeding unit 220 upward and downward. A vertical position of the paper feeding unit 220 is controlled on the basis of the operation of a paper feeding unit position sensor 256 as a reference.

Reference numerals 230 and 423 respectively designate a pickup drive motor and a driver thereof for performing a pickup operation of the sheet of recording paper by using a stepping motor. A pickup sensor (or the above-mentioned home position sensor) 235 constitutes a reference sensor for controlling the position of a pickup roller.

Reference numerals 238 and 424 respectively designate a PB belt variable speed motor and a driver thereof for temporarily stopping a movement of the conveying belt to adsorb and hold the sheet of recording paper. A PB belt variable speed reference sensor 240 detects a reference position of the PB belt.

A paper upper end sensor 233 detects an upper end of the sheet of recording paper to set a position of the paper feeding unit 220.

A high voltage power source (B) 427 is similar to the above-mentioned high voltage power source (A) 414 and generates force for adsorbing the sheet of transfer paper by applying a high voltage to the PB belt.

A paper size sensor 426 detects a size of the sheet of paper on each of the first to fourth PB trays. Tray opening/closing sensors 261 to 264 detect opening and closing states of the respective PB trays.

In a printer mode of the copying machine, control commands are given to the copying machine from a host computer for transmitting printing data. When a reading scanner is arranged and used for the copying machine to make a copy, it is necessary to dispose an operating section having input keys for giving commands for making a copy and indicators for indicating a operating modes. The input keys are mainly constructed by a print/stop key for indicating a starting operation of the copying machine and a stopping operation thereof, ten keys for setting the number of copies, an automatic density adjusting key for adjusting a copy density, a zoom key for designating a magnification, etc. The operating section is constructed by a liquid crystal display (LCD) panel showing an input state thereof.

Figure 33:
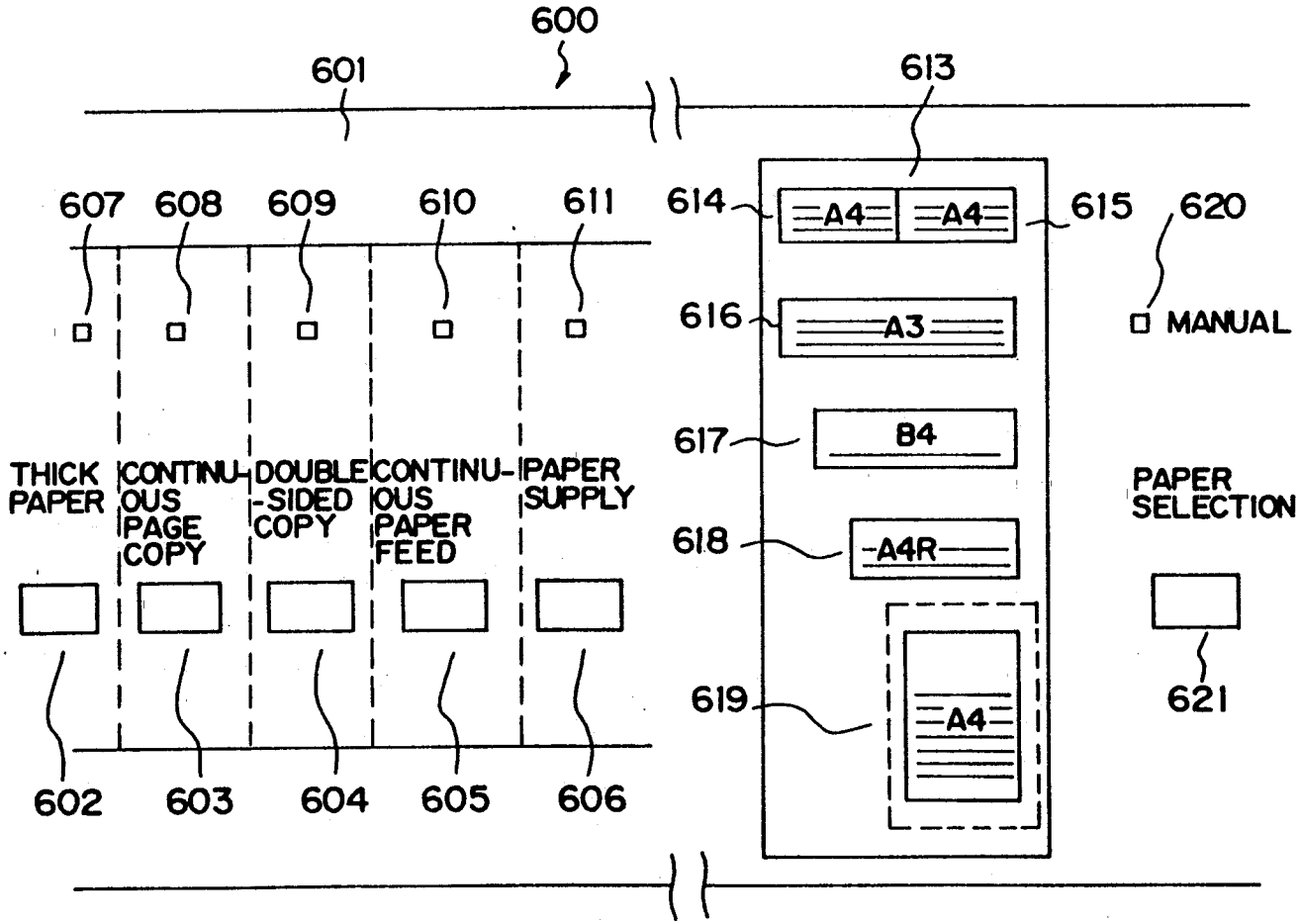
FIG. 33 is a view showing a portion of an operating section.

As shown in FIG. 33, the operating section 600 has an operation panel 601 and the above various kinds of unillustrated keys. The operating section 600 also has a continuous page copying key 603 for continuously copying an opened original such as an opened book onto two sheets of recording paper. The operating section 600 further has a double-sided key 604 for copying the original onto both faces of the sheet of recording paper. The operating section 600 further has a continuous paper feeding key 605 for continuously feeding the sheet of recording paper without giving any clearance between sheets of recording paper. The operating section 600 further has a supplying key 606 for conveying paper sheets of a lower PB tray upward.

When the respective operating modes are designated by inputting operations of the above input keys, liquid crystal displays (LCDs) 608 to 611 corresponding to the respective keys are turned on. A continuous page copying mode, a double-sided copy mode and a continuous paper feeding mode are independently set. When these three modes are designated, the original such as a book is copied at a high speed by making the continuous page copy and the double-sided copy and performing the continuous paper feeding operation. A supplying mode is set to convey and supply sheets of recording paper to an upper tray having a short conveying path when no copying machine is operated at a time such as nighttime designated in advance. The supplying mode may be set automatically or by an inputting operation of the supplying key 606. A thick paper display 607 is turned on by the input operation of a thick paper key 602 to change conditions of paper sheets fed from the paper feeding tray and the paper bank. For example, these conditions are constructed by an intensity and an area of an electric charge pattern.

A multistage paper feeding operation of the copying machine is displayed by a paper display section 613 constructed by a liquid crystal display within the operation panel. Sizes of sheets of recording paper stored in the respective paper feeding trays arranged at multiple stages are displayed by respective size indicators 614 to 619 and the remaining amount of sheets of recording paper with respect to each of the trays is also displayed by each of these indicators. In FIG. 33, paper size A4 is selected with respect to the fourth PB tray 619. A tray for the paper feeding operation is sequentially selected by the inputting operation of a paper selecting key 621 and is displayed by the paper display section 613. A manual paper feeding display 620 is turned on by manually opening the manual paper feeding section 130 and a sheet of paper is preferentially fed from the manual paper feeding section 130. The selected tray display of the paper display section 613 is turned off.

An operation of the copying machine will next be described with reference to flow charts and timing charts shown in FIGS. 34A, 34B, 35A and 35B, etc.

Figure 34A:
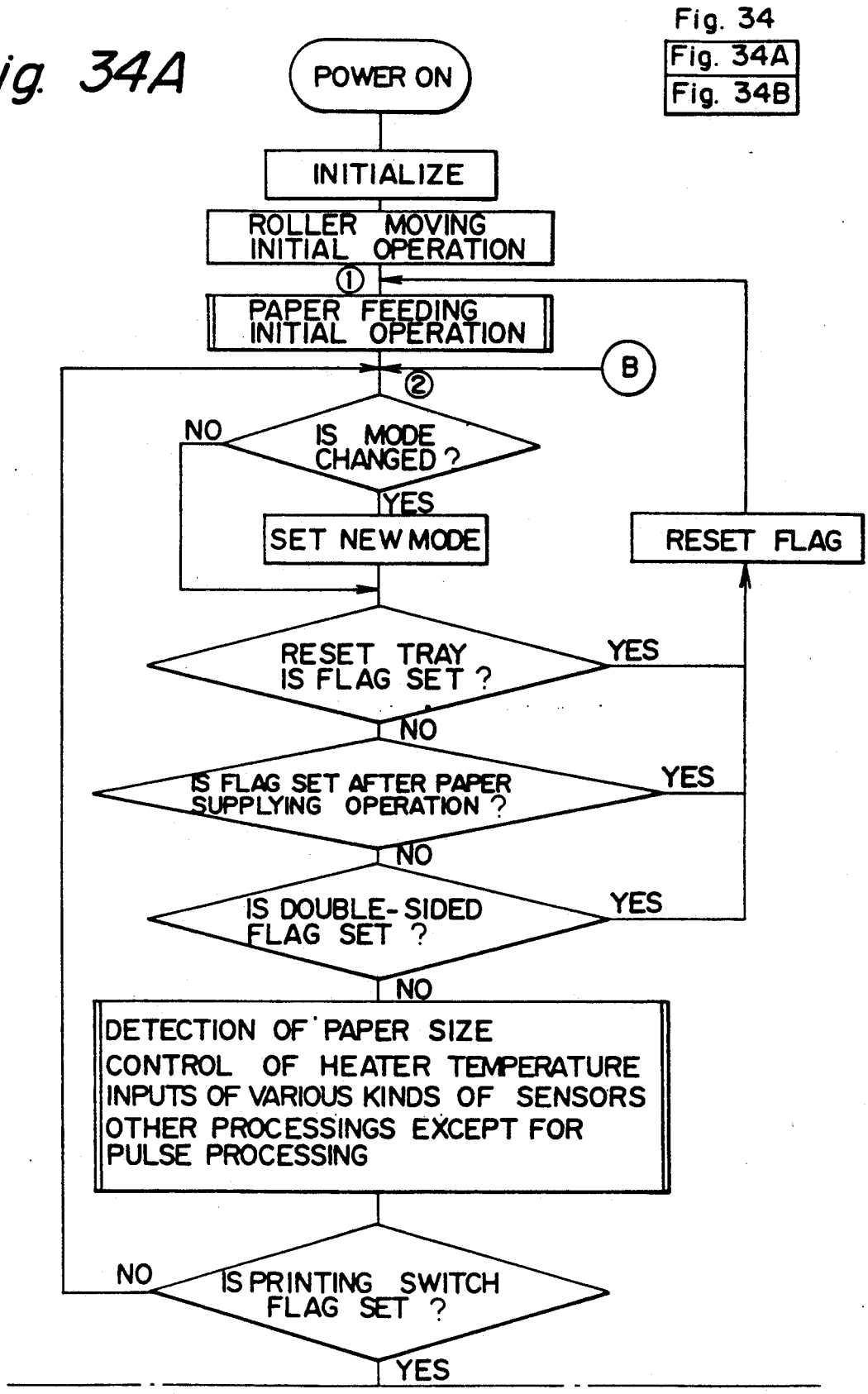
FIGS. 34A and 34B show a flow chart of the overall operation of the copier according to the present invention.
Figure 34B:
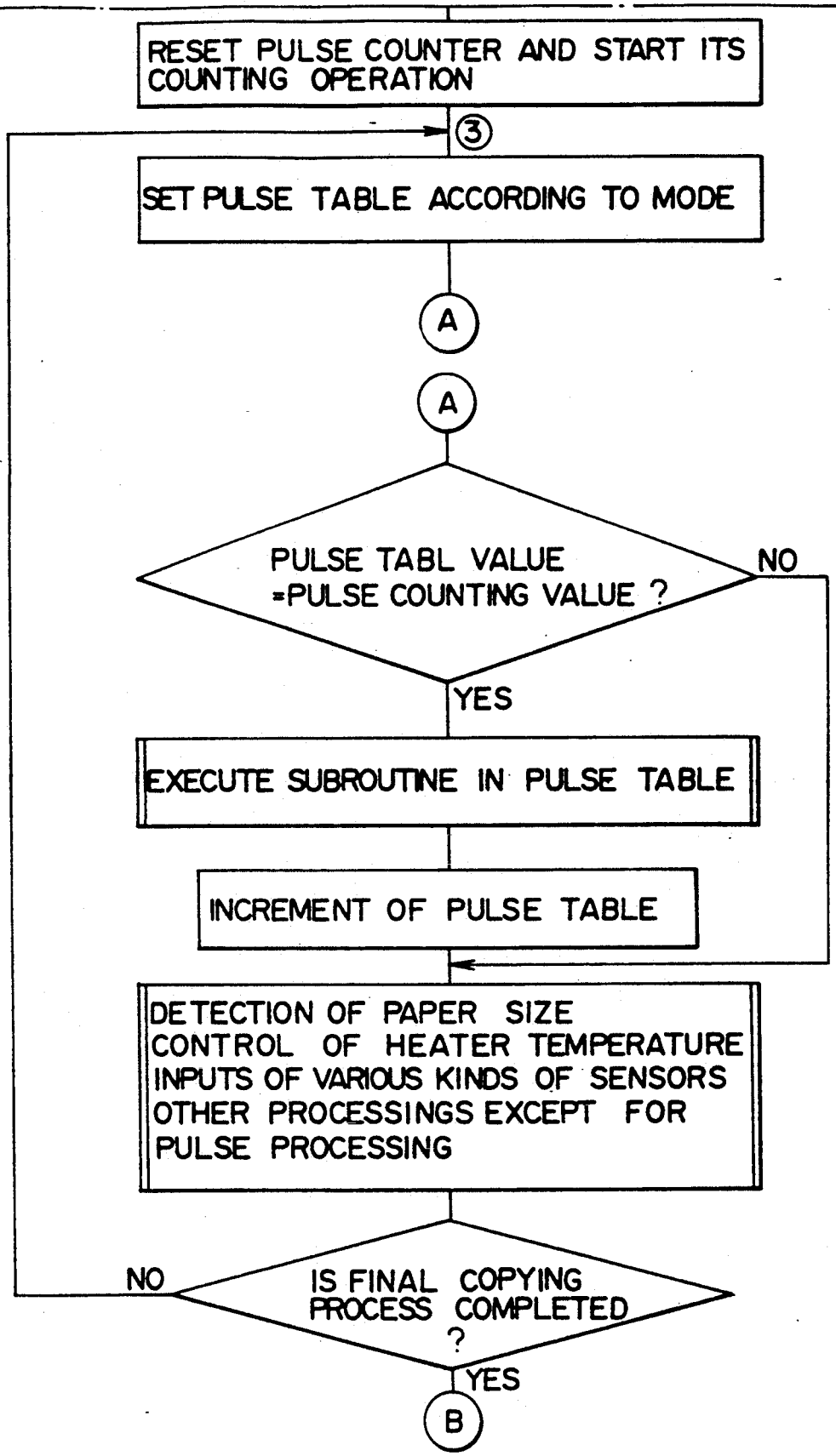

In FIGS. 34A and 34B, after a power source of the copying machine is turned on, the copying machine is initialized and a roller moving initial operation is performed. In this roller moving initial operation, the first driven roller 55 is escaped to a home position thereof. Thereafter, a paper feeding initial operation is performed on the basis of processings shown in FIGS. 35A and 35B.

Figure 36A:
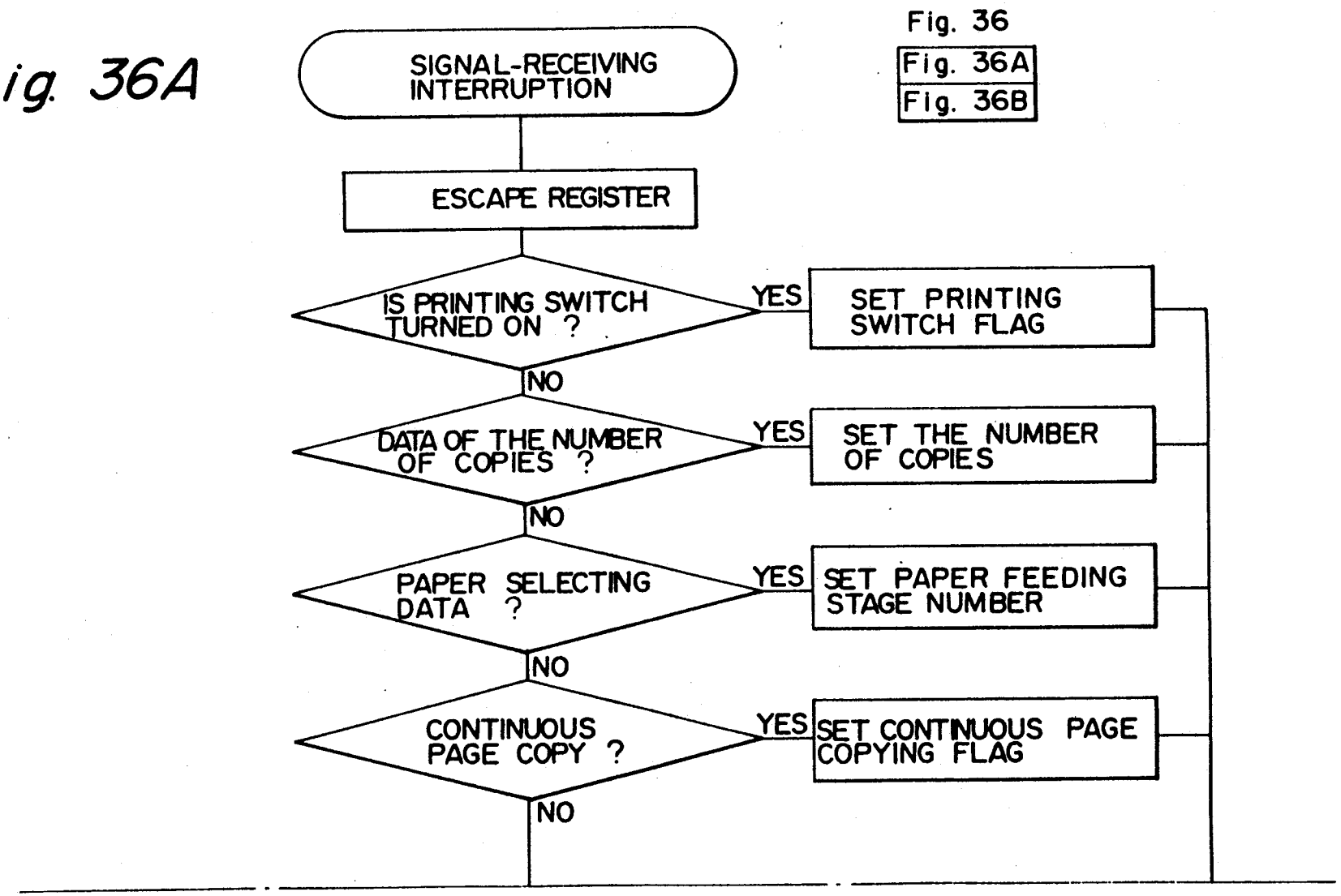
FIGS. 36A and 36B illustrate a flow chart of the signal-receiving interruption process according to the present invention.
Figure 36B:
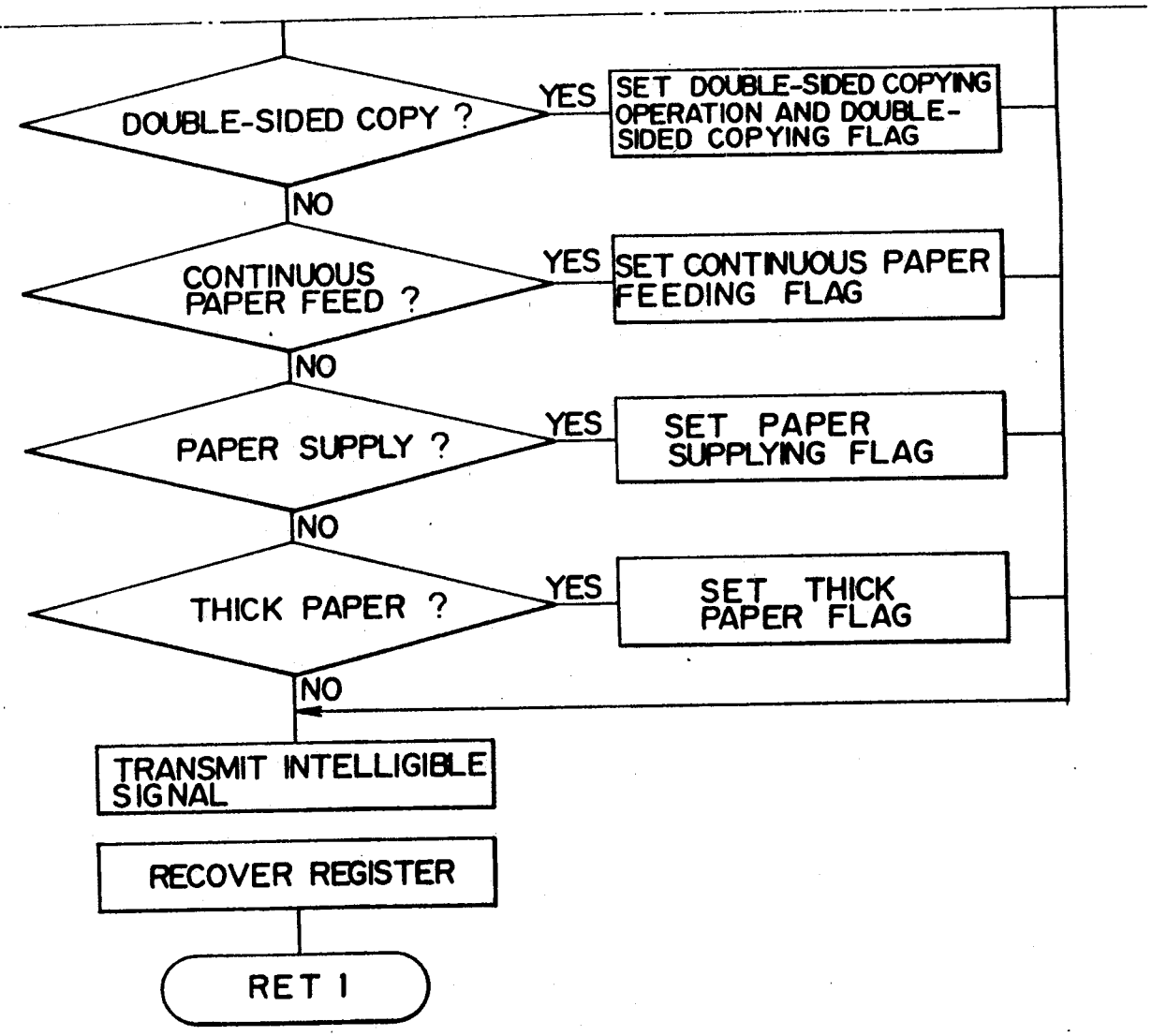

After this paper feeding initial operation, a new operating mode is set if operating modes are changed. The change in mode is inputted to the main control board 401 as serial data coded by the key input of an operating display board. Thus, a signal-receiving interruption is caused and the serial data are judged. A flow chart of the signal-receiving interruption is shown in FIGS. 36A and 36B.

After the new operating mode is set, it is judged whether the paper feeding initial operation must be executed again or not. In FIG. 34A, a first stage of the paper feeding initial operation is set when a paper feeding tray is pulled out to manually supply sheets of recording paper by a user and is again set. A second stage of the paper feeding initial operation is set when the supplying operation of the sheets of recording paper is completely performed. A third stage of the paper feeding initial operation is set when a double-sided mode is set. In the case of each of these three stages, it is returned to step (1) in FIG. 34A by setting and resetting respective flags and it is determined whether the paper feeding initial operation is performed or not.

Figure 37:
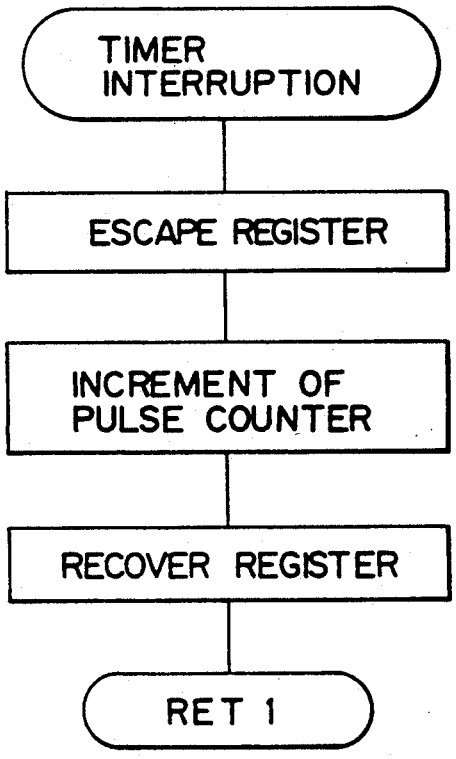
FIG. 37 illustrates the use of a pulse counter which is used to perform an incremental counting-up operation for interrupting the CPU in accordance with a set time interval.

Thereafter, detection of the paper size, control of the temperature of a heater, detection of the remaining amount of paper sheets, priority of the paper feeding operation, setting of an adsorbing voltage and supply of the paper sheets are performed. Further, the number of sheets of paper for enabling a double-sided copy is detected and the number of arranged sheets of paper for enabling the continuous page copying operation and making the double-sided copy is detected. Electric signals are respectively inputted to various kinds of sensors. A group of subroutines of processings except for pulse processing such as setting and resetting of flags are executed by the inputs of the sensors. Thereafter, it is judged by the flags whether a printing switch is pushed or not. When no printing switch is pushed, it is again returned to the mode changing processing and the above operating loop shown in FIG. 34A is repeatedly executed until the printing switch is pushed. When the printing switch is pushed, a pulse counter is reset and a counting operation thereof is then started. This pulse counter is a counter shown in FIG. 37 and performing a counting-up operation by the interruption of a timer. The interior of a central processing unit (CPU) is interrupted every constant time. An interrupting time is set by initially setting the timer.

After the counting operation is started, a pulse table according to each of the operating modes is set and a pulse counting value is compared with a pulse number set in this pulse table. The pulse table according to each of the operating modes is a table about pulse numbers of turning-on and turning-off timings of the respective loads divisionally set every operating mode. When no counting value is in conformity with the table pulse number, the above-mentioned processings except for pulse processing are executed in a branching step. If no final copying process is completed, it is returned to a step (3) in FIG. 34B and operations subsequent to this step are repeatedly performed. In contrast to this, when the counting value is in conformity with the table pulse number, subroutines of the pulse table are executed and an incremental operation of the pulse table is performed. Further, the processings except for pulse processing are executed and it is returned to a step (2) in FIG. 34A and the processing loop subsequent to this step is repeatedly executed if the final copying process is completed.

Figures 35, 35A:
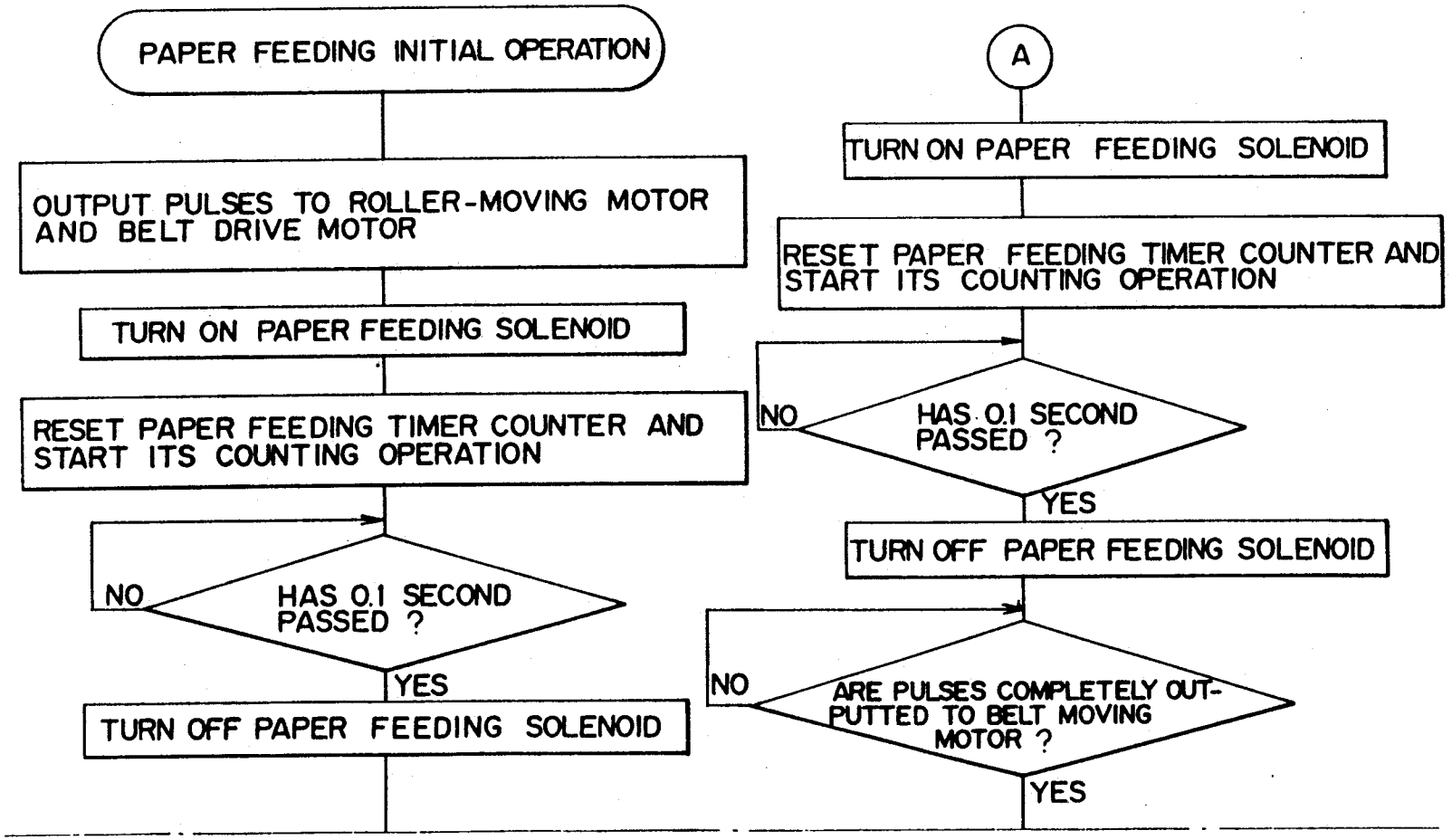
FIGS. 35A and 35B illustrate the manner by which an initial paper feeding operation is performed according to the invention.
Figure 35B:
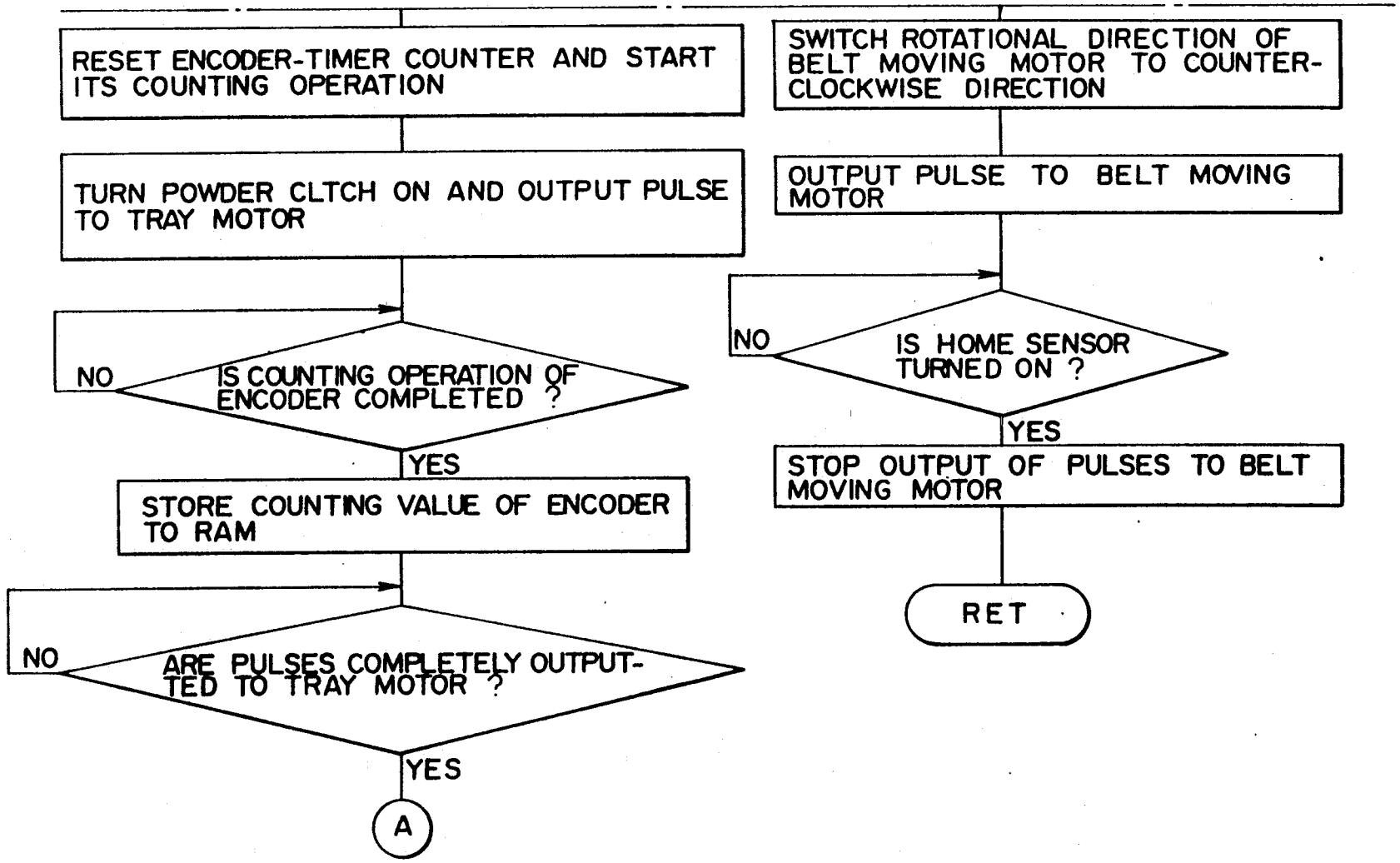

In the paper feeding initial operation shown in FIG. 35A, pulses are inputted from the main control board 401 to the roller moving motor 68, the belt driving motor and their drivers. In this case, the number of pulses corresponding to a moving amount of the pickup roller and a pulse frequency corresponding to a moving speed of this roller are set in advance. After the paper feeding solenoid 110 is next turned on, a paper feeding timer counter is reset and a counting operation thereof is started. The paper feeding timer counter is a counter for performing an incremental operation by the above timer interruption. It is judged by a counting value of this counter whether a time of 0.1 second has passed or not. After this time has passed, the paper feeding solenoid 110 is turned off. Thereafter, an encoder-timer counter is reset and a counting operation thereof is started. An encoder for this encoder-timer counter is constructed by the sensor 120 attached to the driving shaft 115 driven by a shaft of the tray motor 122 through the powder clutch 119.

After the powder clutch 119 is then turned on, a pulse is outputted to the driver for driving the tray motor 122. At this time, it is sufficient to set a pulse number counted until the raising tray 82 having no sheets of recording paper comes in contact with the conveying belt 53 in a lowering position thereof in a belt contact portion coming in contact with the sheets of recording paper. The pulse frequency may be set to a high frequency for normally rotating the tray motor.

Figure 38:
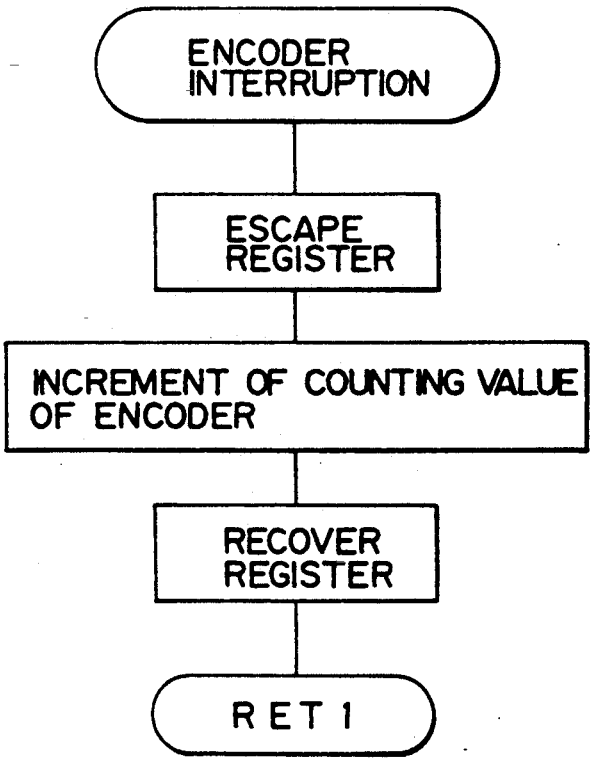
FIG. 38 illustrates the process according to the invention whereby it is determined that the timing operation is complete when the encoder interruption is not received.

Thereafter, it is judged that the counting operation is completed when there is no encoder interruption shown in FIG. 38. A counting value of the counter at this time is stored to a RAM. This counting value is inversely proportional to the remaining amount of sheets of recording paper stored in the tray so that the remaining amount of paper sheets can be detected from this counting value. After the pulse is outputted to the tray motor, the paper feeding solenoid 110 is turned on and off as mentioned above. After the pulse is outputted to the belt moving motor 68, a rotational direction of the belt moving motor 68 is switched to e.g., the counterclockwise (CCW) direction. Then, a pulse is again outputted to the belt moving motor 68 to escape the pickup roller to its home position. After the home sensor 71 detects the first driven roller 55, the pulse output is stopped and the above processings are completed.

Figure 44:
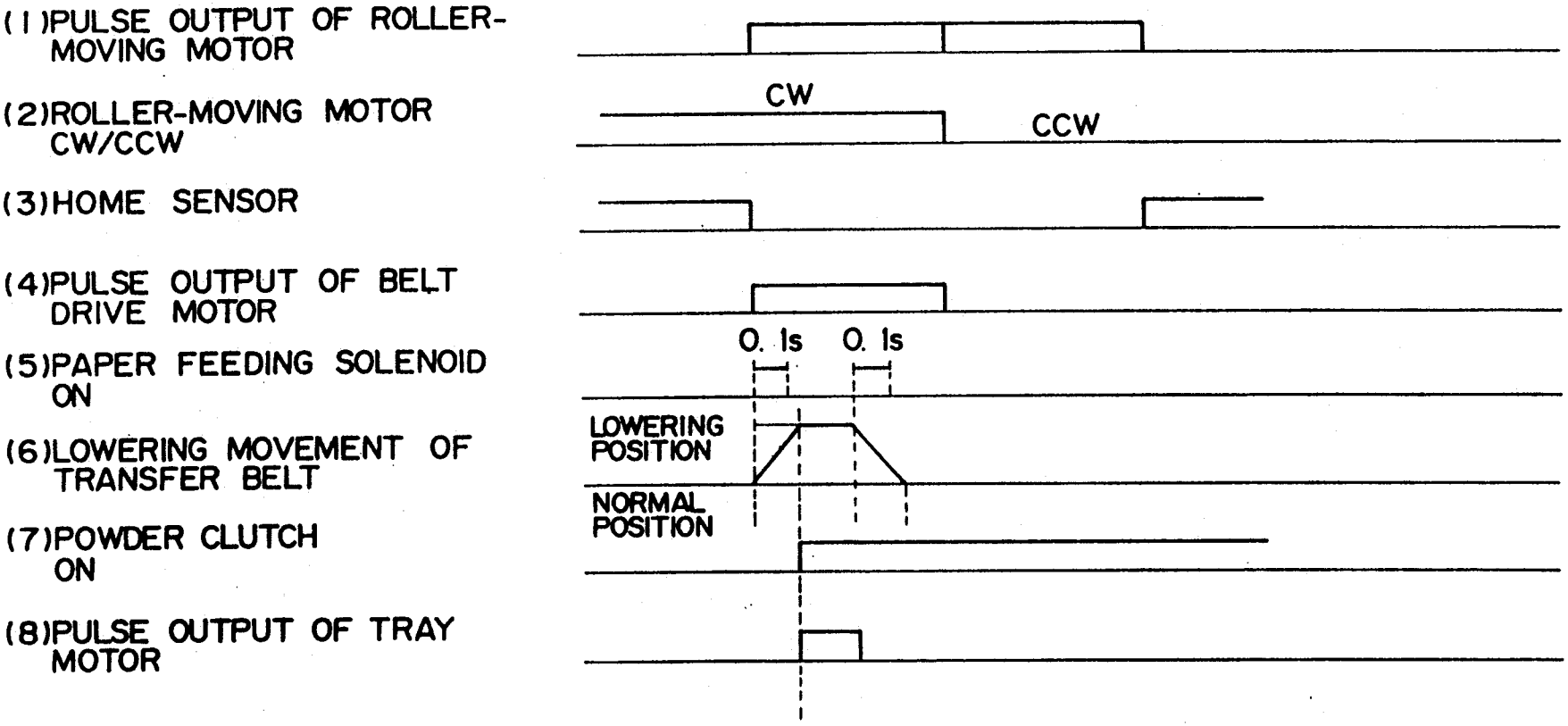
FIG. 44 is a timing chart showing the relationships between the paper driving mechanisms and the movement of the transfer belt and the powder clutch according to the present invention.

FIG. 44 is a timing chart showing the above-mentioned operations.

The paper feeding initial operation is separately performed with respect to the first tray 52' and the second tray 52".

A fed sheet of recording paper is transferred and fixed in known manners.

The various kinds of operating modes will next be explained.

Continuous paper feeding mode

In a continuous paper feeding mode, serial data showing this mode are transmitted from the operating display board by an input operation of the continuous paper feeding key 605 in the operating section shown in FIG. 33. The main control board 401 receives these serial data and generates signal-receiving interruption shown in FIG. 36A and sets a continuous paper feeding flag.

Figure 39:
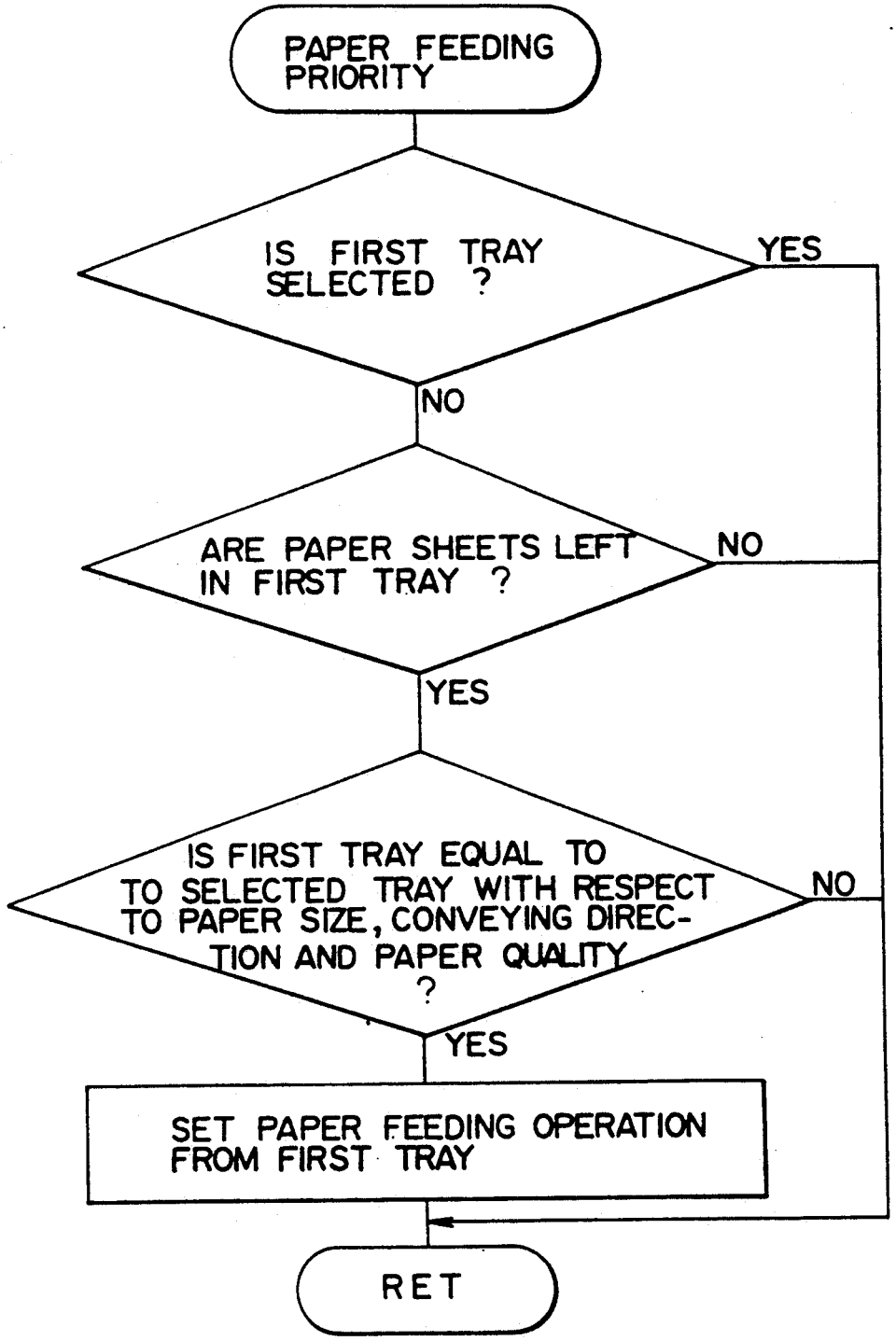
FIG. 39 shows a flow chart of a priority sequence for the paper feeding operation according to the invention.

When the continuous paper feeding flag is set, a new operating mode is set in the main flow chart shown in FIG. 34A. When the printing switch is pushed, sequential operations for turning the respective loads on and off are executed in accordance with a pulse table shown in a timing chart in FIG. 46. Paper feeding priority will next be explained before an explanation of this timing chart. In the paper feeding priority, when a sheet of recording paper having the same size, conveying direction and quality as the first tray 52' is selected, this sheet of recording paper is preferentially fed and conveyed from the first tray 52'. A processing flow of this paper feeding priority is set in the subroutine group of the processings except for pulse processing in the main flow chart. This processing flow is set to reduce a first copying time and improve productivity. FIG. 39 shows a flow chart of the paper feeding priority.

A timing chart of the continuous copying mode shown in FIGS. 45A and 45B will next be described.

Figure 45A:
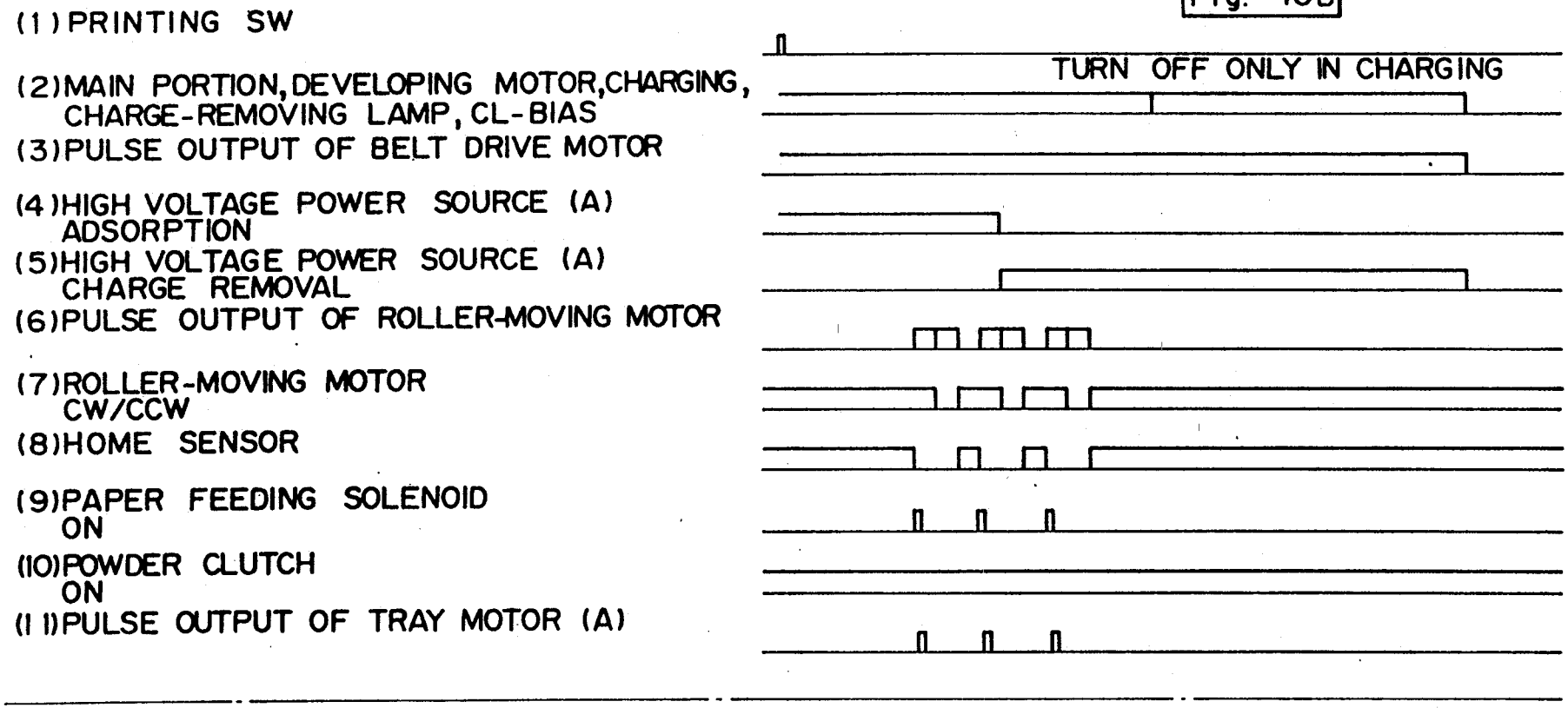
FIGS. 45A and 45B illustrate a timing chart in which three sheets of recording paper are sequentially fed and conveyed to form images thereon.

When the printing switch is pushed in a process 1 in FIG. 45A, a main constructional portion, a developing motor, a charge corona portion and a cleaning biasing (or CL-biasing) portion are turned on in a process 2. Simultaneously, a pulse is outputted to the belt drive motor in a process 3 and the conveying belt 53 is driven. In a process 4, the high voltage power source (A) is turned on at an adsorbing frequency and an electric charge density pattern is formed by the charging roller 26. Thereafter, a pulse is outputted to the roller moving motor 68 in a process 6. In a process 7, the roller moving motor 68 is rotated in the clockwise (CW) direction and the counterclockwise (CCW) direction. In a process 8, the home sensor 71 detects the home position of the first driven roller 55. The paper feeding solenoid 110A is turned on in a process 9. The powder clutch 119A is turned on in a process 10. In a process 11, a pulse is outputted to the PB tray motor 122A to perform the paper feeding operation.

Figure 46:
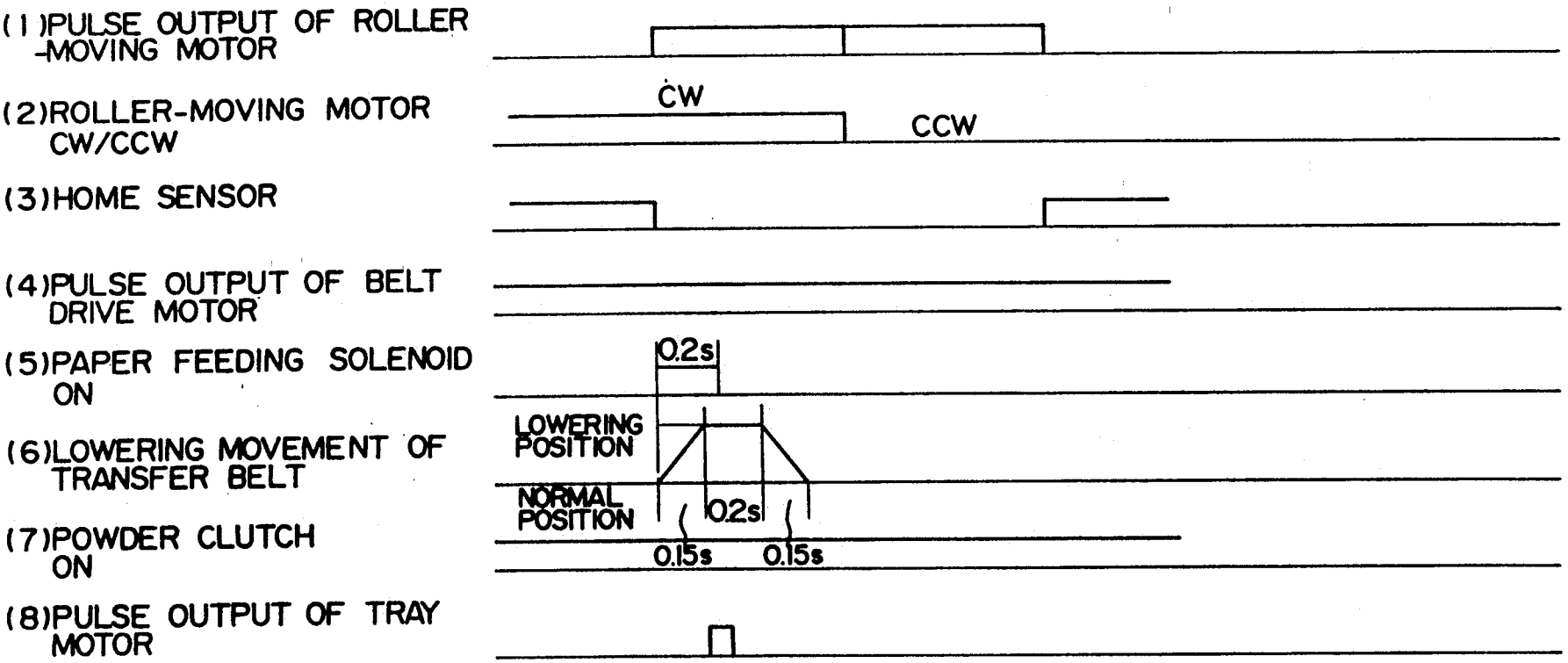
FIG. 46 illustrates a lowering movement of the conveying belt according to the present invention from a normal position to a lowered position.

When the first tray 52' and the second tray 52" are simultaneously used as in the case of recording paper size A3, the paper feeding solenoid 110B is turned on in a process 12 and the powder clutch 119B is simultaneously turned on in a process 13 and a pulse is simultaneously outputted to the tray motor 122B in a process 14. FIG. 46 shows a detailed timing chart of the paper feeding operation.

In FIG. 46, a pulse for rotating the roller moving motor 68 in the clockwise direction is outputted to this roller moving motor 68. The conveying belt 53 is in a stopping state while this pulse is outputted to the roller moving motor 68. The paper feeding solenoid 110 is turned on in synchronization with the pulse output of the roller moving motor 68. Accordingly, the conveying belt is lowered in 0.15 seconds from a normal position to a lowering position in accordance with a lowering movement thereof shown in FIG. 46. Thereafter, a pulse is outputted to the tray motor 122 to press the sheet of recording paper against the conveying belt 53 and adsorb this paper sheet. At this time, it is sufficient to set the number of pulses transmitted to the tray motor 122A such that this pulse number has margins corresponding to the thickness of one sheet of recording paper and the pressing operation since the tray is already raised by the preceding paper feeding initial operation.

After the paper feeding operation, the rotational direction of the roller moving motor 68 is switched to the counterclockwise direction to escape the pickup roller 58 to its home position. Then, a pulse is outputted to the roller moving motor 68 to return the first driven roller 55 to its home position detected by the home sensor 71.

In the case of the continuous paper feeding operation, the paper feeding operation is started at a timing at which a rear end of a fed sheet of recording paper passes through the rightward fence 79 of a paper feeding tray. Thus, the sheet of recording paper is fed and conveyed in a state in which a distance between paper sheets is approximately equal to zero.

Figure 45B:
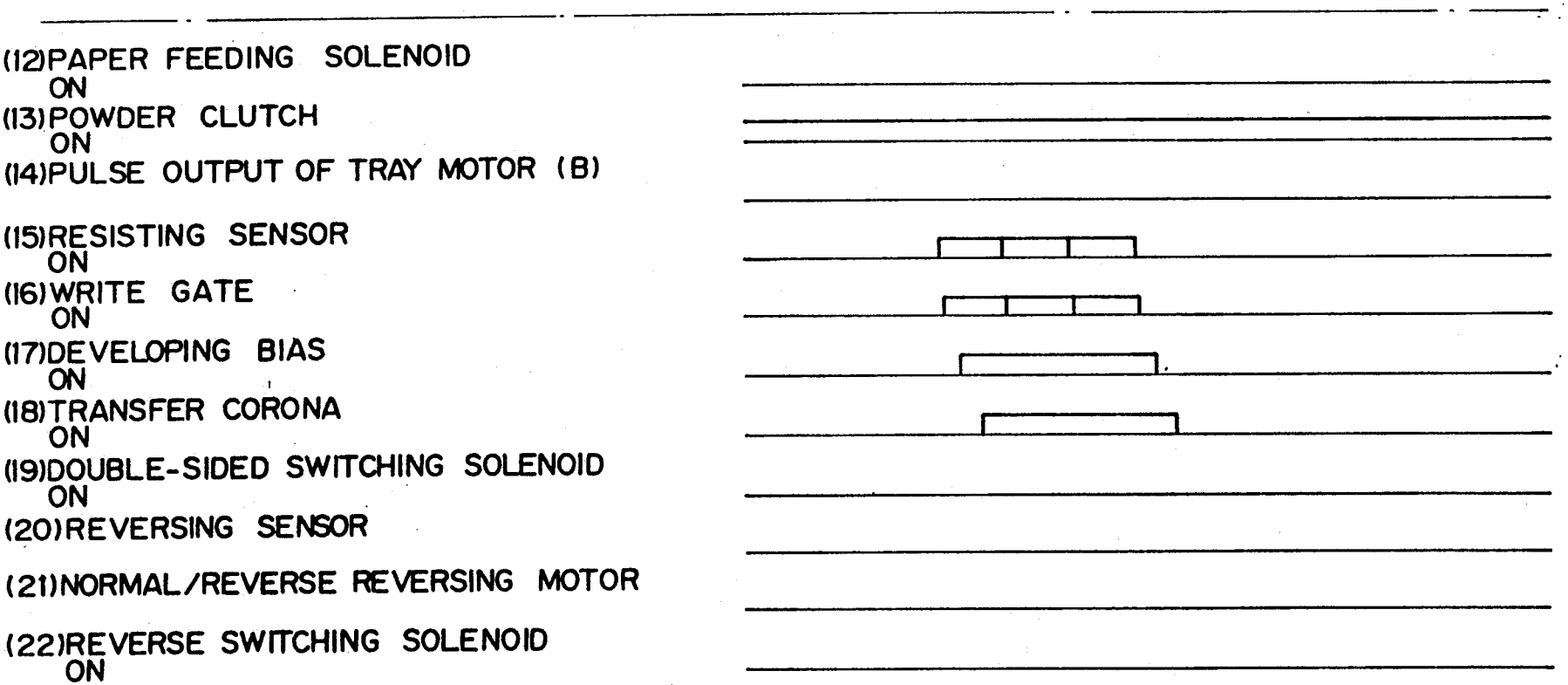

In FIGS. 45A and 45B after the paper feeding operation is completely performed, the resisting sensor detects the sheet of recording paper in a process 15. The number of subsequent pulses is counted and the turning-on and turning-off timings of the respective loads are set with a detecting position of the paper sheet as a reference. Thus, the turning-on and turning-off timings of a write gate, a developing biasing portion and a transfer corona portion are set to form an image on the paper sheet in processes 16 to 18.

The timing chart shown in FIGS. 45A and 45B shows an example in which three sheets of recording paper having size A4 are sequentially fed and conveyed from the first tray 52' to form images thereon.

The high voltage power source (A) is turned off to stop the adsorbing operation of the paper sheet at a timing at which an electric charge pattern is formed until a rear end of a final sheet of recording paper. Then, a charge-removing operation of the conveying belt is performed so that the electric charge pattern for adsorbing the paper sheet on the conveying belt is removed. Thus, it is possible to prevent the sheet of recording paper from being adsorbed to the conveying belt in an operation except for the paper feeding operation such as the paper feeding initial operation. Therefore, the operation of the copying machine is stopped after the final sheet of recording paper is externally discharged from the copying machine. Otherwise, the operation of the copying machine is stopped after the electric charge is completely removed from an adsorbing region of the conveying belt. In this case, the operation of the copying machine is stopped after a longer time of a paper discharging time and a completing time of the charge removal.

Continuous page copying mode

Figure 47A:
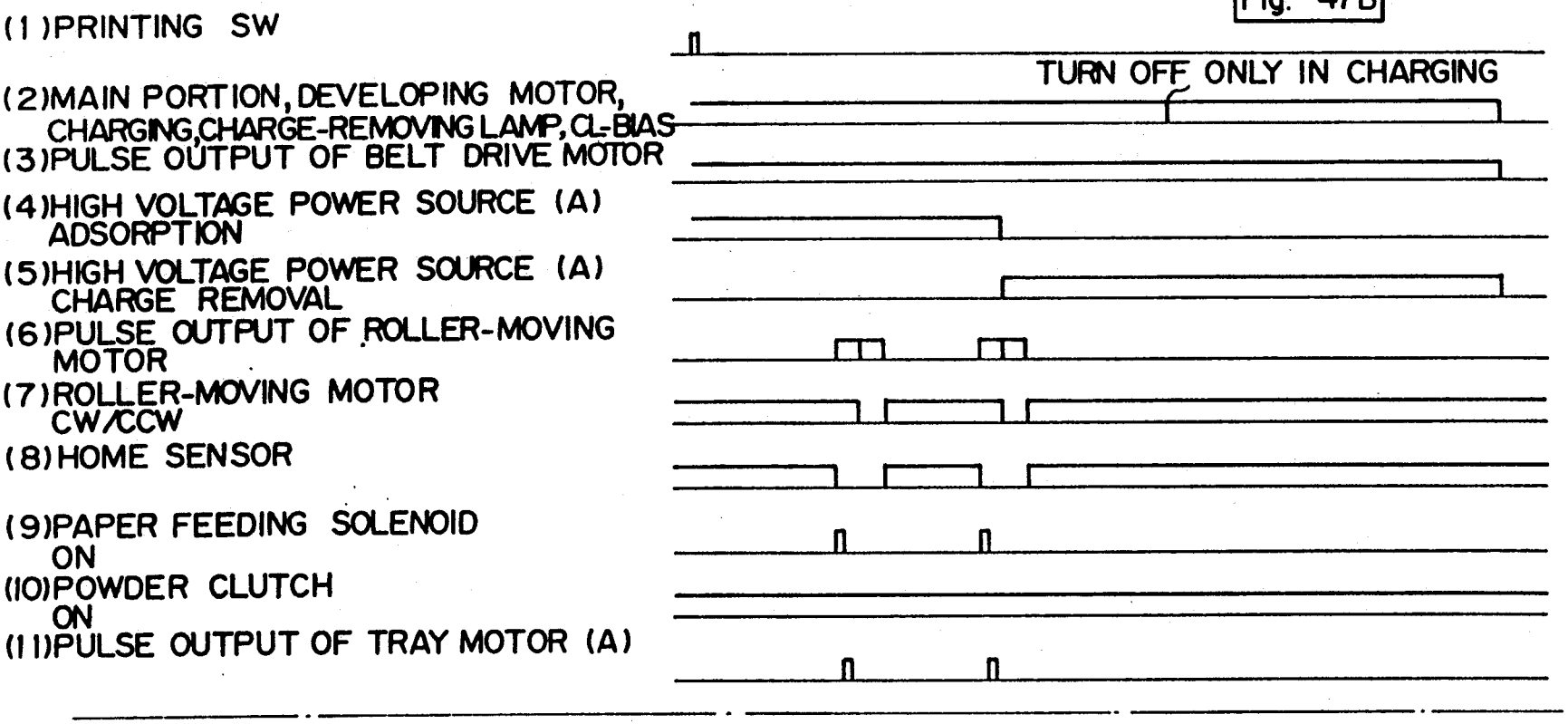
FIGS. 47A and 47B illustrate a continuous page copying mode similar to the continuous paper feeding mode with respect to image formation.
Figure 47B:
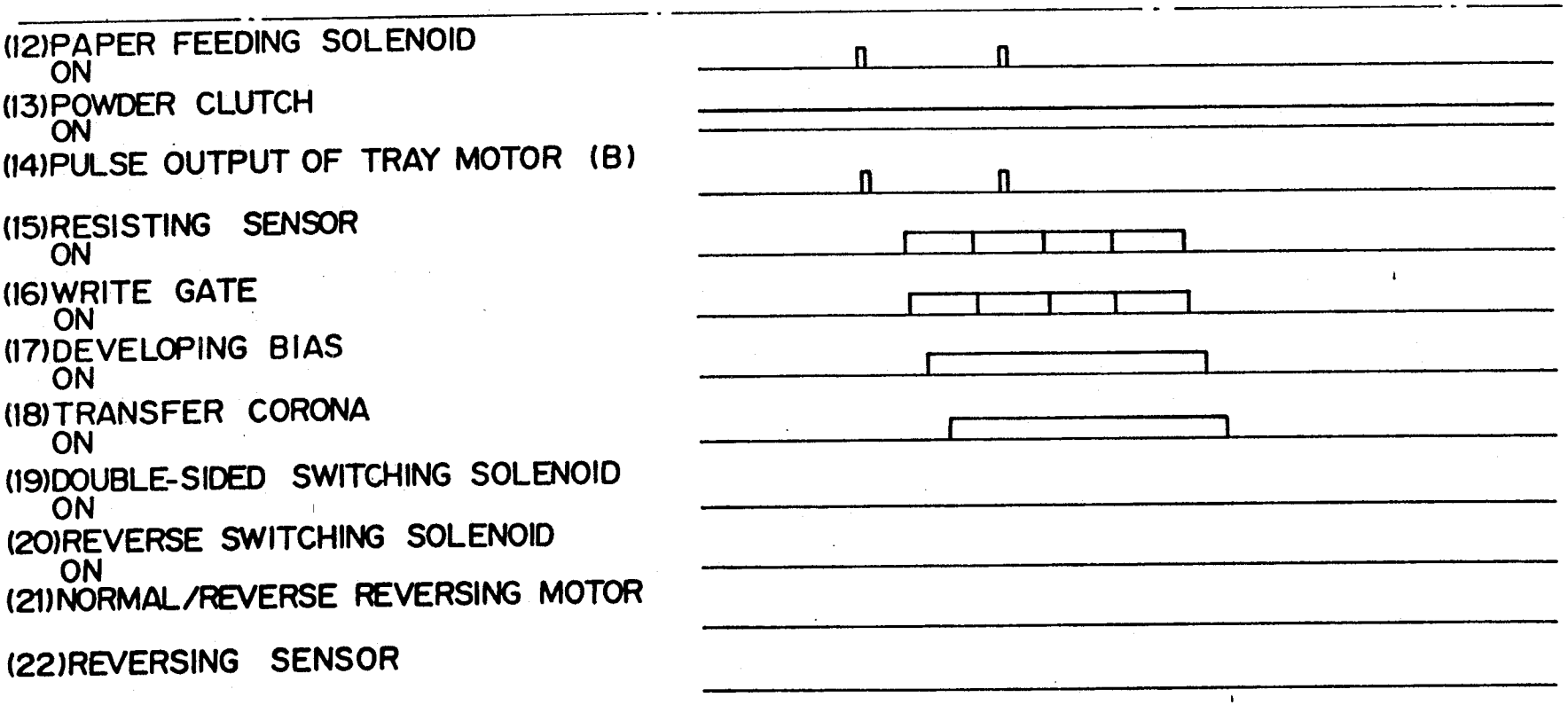

FIGS. 47A and 47B show a timing chart of the copying machine in the continuous page copying mode. In the continuous page copying mode, the paper feeding operations with respect to the first tray 52' and the second tray 52'' are simultaneously performed and two sheets of recording paper are simultaneously adsorbed onto the conveying belt and are conveyed by this belt to form images thereon. This timing chart shows a case in which each of these simultaneous paper feeding operations is performed twice so that a total of four images are formed on the paper sheets. Similar to the continuous paper feeding mode, a signal-receiving interruption is caused from the operating section by an inputting operation of the continuous page copying key and a new operating mode is set by setting the continuous page copying flag. In FIGS. 47A and 47B, the continuous page copying mode is basically similar to the continuous paper feeding mode with respect to the image formation. The differences between the continuous page copying mode and the continuous paper feeding mode are that the paper feeding operation is performed at synchronous timings in processes 9 to 11 with respect to the first tray 52' and similar processes 12 to 14 with respect to the second tray 52''. Namely, the paper feeding solenoids 110A and 110B are synchronously operated and recording paper contact regions of the conveying belt 53 are simultaneously lowered. Further, the raising tray 82A of the first tray 52' and the raising tray 82B of the second tray 52'' are synchronously raised, and sheets of recording paper in the first tray 52' and the second tray 52'' are simultaneously adsorbed and conveyed.

A timing of the next paper feeding operation may be set after a rear end of a sheet of recording paper fed from the second tray passes through the rightward fence 79 coming in contact with a front end of a sheet of recording paper in the first tray. Therefore, turning-on and turning-off operations of the roller moving motor and a detecting timing of the home sensor are set as in processes 6 to 8. Timings of the paper adsorbing operation and the charge removing operation in the recording paper region are set as shown in processes 4 and 5.

Continuous paper feeding double-sided mode

In the continuous paper feeding double-sided mode, an image is formed on the front face of a sheet of recording paper and the sheet of recording paper is then reversed by a reversing device. Thereafter, the sheet of recording paper is temporarily stored onto the second tray 52''. After a number of arranged sheets of recording paper are stored in the second tray 52'', these sheets of recording paper are fed from the second tray 52'' to form images on rear faces of these paper sheets. In this case, the second tray 52'' stores sheets of recording paper having no images thereon. The number of sheets of recording paper for enabling a double-sided copy is determined from the remaining amount of paper sheets having no images thereon. This number of paper sheets is the number of sheets which can be stacked with each other within the second tray 52''. The remaining amount of paper sheets is detected in the above-mentioned main flow chart. In the following description, detection of the number of paper sheets for enabling a double-sided copy will next be described with reference to the flow chart shown in FIG. 40.

In the main flow chart, the paper feeding initial operation is performed as mentioned above when the double-sided flag is set. Thus, a counting value of the encoder is set to a RAM. This counting value is set to a with respect to the first tray and is set to b with respect to the second tray. Detecting processing of the number of paper sheets for enabling a double sided-copy is set in the subroutine group of the processings except for pulse processing in the main flow chart.

Figure 40:
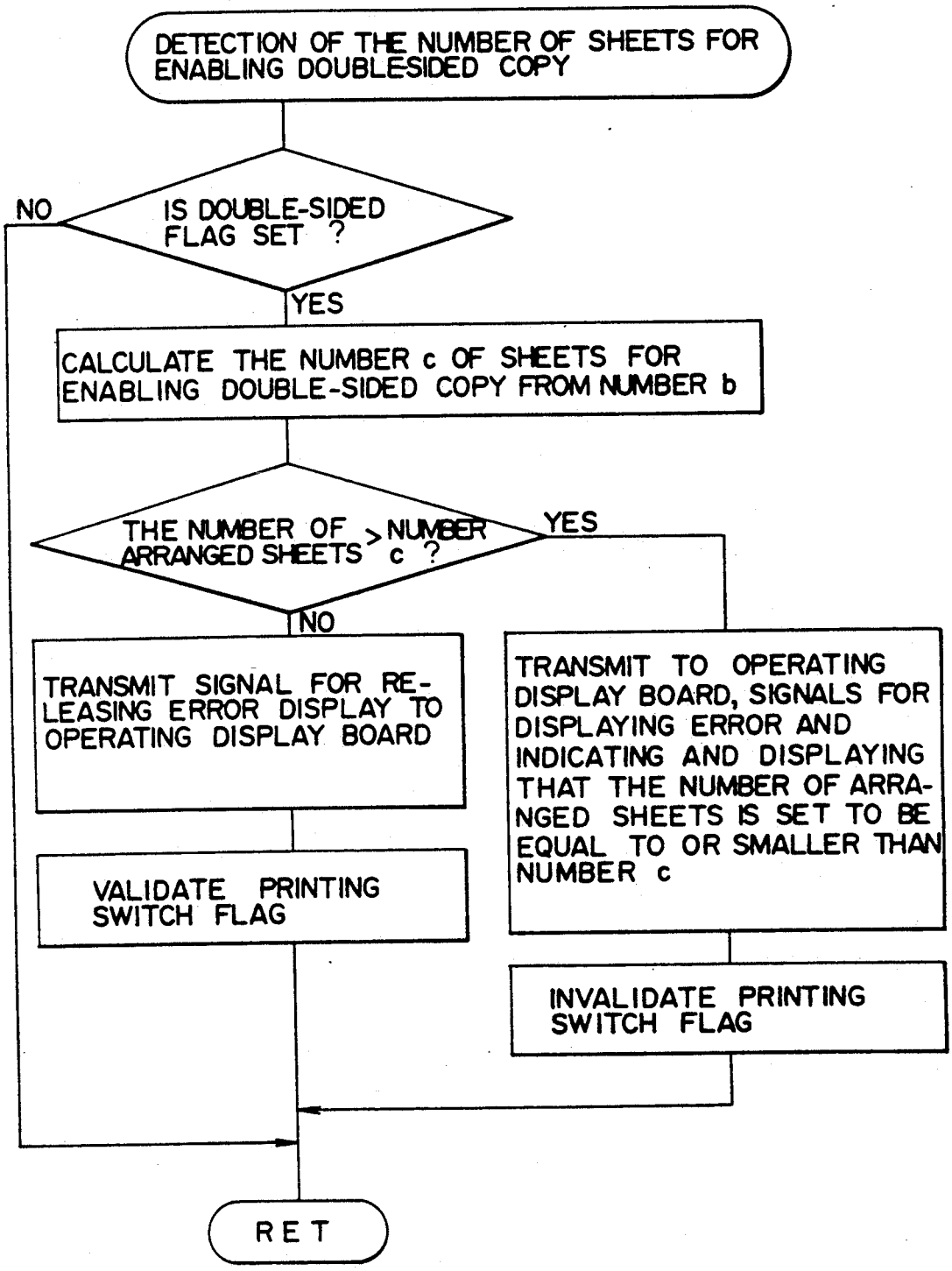
FIG. 40 illustrates the manner in which the number of paper sheets is detected for permitting a double-sided copy operation.

When the flow chart shown in FIG. 40 is executed, an operating state of the double-sided flag is first judged. When no operating state of the double-sided flag is set, the sheet number detecting processing in FIG. 40 is completed. In contrast to this, when the operating state of the double-sided flag is set, the number c of paper sheets for enabling the double-sided copy is calculated from the remaining amount b of paper sheets on the second tray side. This number c may be successively calculated from the remaining amount b. Otherwise, this number c may be called with respect to the remaining amount b set to a table in advance. Next, it is judged whether or not the number of arranged paper sheets is greater than the number c. When this judgment is YES, an error in number is displayed on the operating display board and an electric signal is transmitted to the operating display board so as to indicate and display that the number of arranged sheets is set to a number equal to or smaller than the number c.

Thereafter, the sheet number detecting processing in FIG. 40 is completed after a printing switch flag is invalidated. In this state, no copying machine is started even when the printing switch is pushed. The number of arranged sheets is again set by a user to be equal to or smaller than the number c and the number of paper sheets for enabling the double-sided copy is again detected. Thus, the number of arranged sheets is not greater than the number c and an electric signal for releasing the error display is transmitted to the operating display board. Further, the printing switch flag is validated and the sheet number detecting processing in FIG. 40 is completed.

Figure 48:
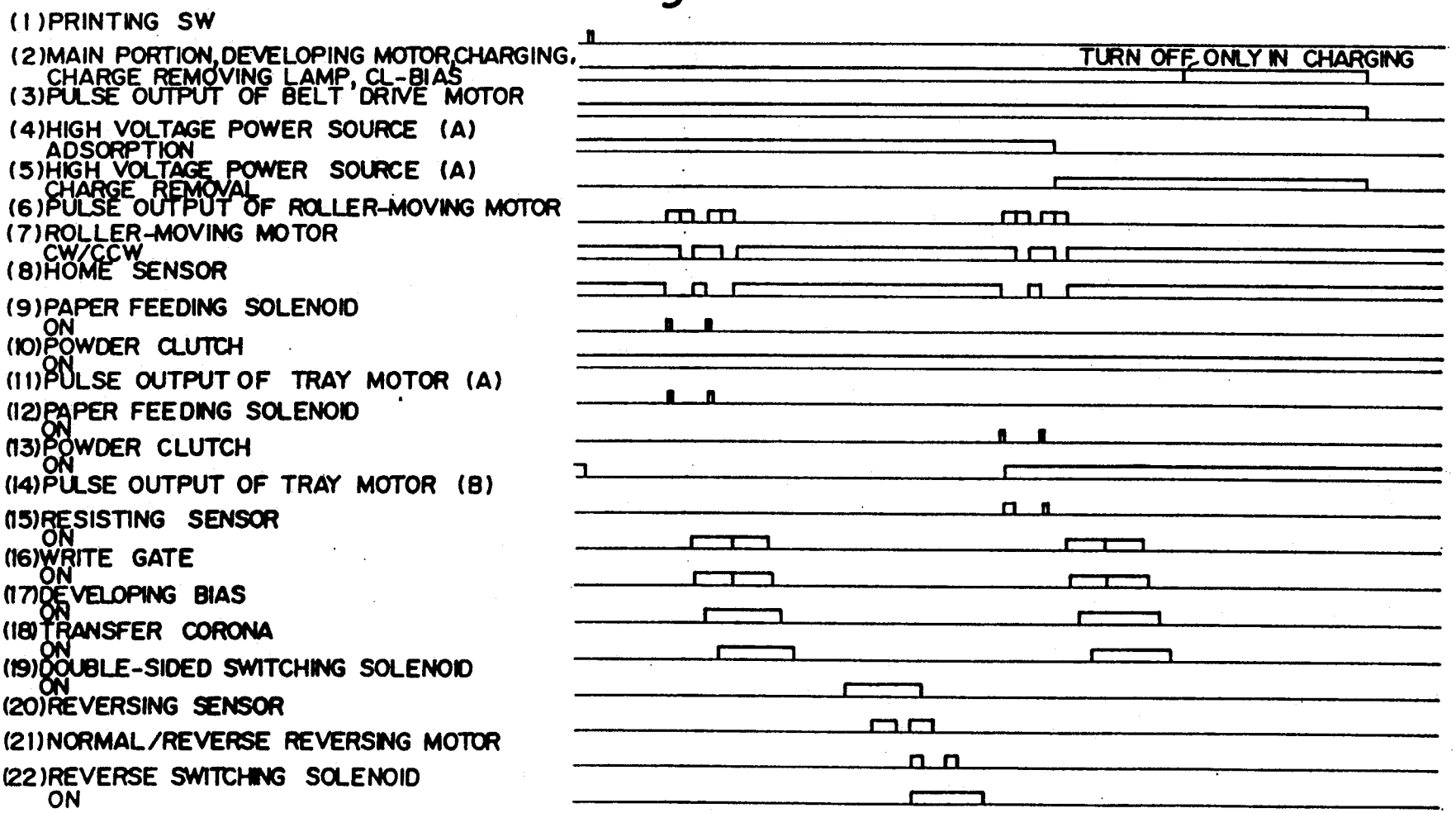
FIG. 48 illustrates the continuous paper feeding mode process in which the second tray is illustrated in the lowered position.

When the printing switch is pushed in this state, the copying machine is operated in accordance with a timing chart shown in FIG. 48. Similar to the continuous paper feeding mode shown in FIGS. 45A and 45B processes 2, 3 and 4 in FIG. 48 are executed when the printing switch is pushed. The differences between these processes 2, 3 and 4 shown in FIG. 48 and corresponding processes in the continuous paper feeding mode shown in FIGS. 45A and 45B are that the powder clutch 119B is turned off in a process 13 and the raising tray 82B of the second tray 52'' is lowered in FIG. 48.

Thus, a space for storing sheets of recording paper having images on front faces thereof is secured. The timing chart illustrated in FIG. 48 shows an example of a double-sided continuous paper feeding operation in which two arranged sheets of recording paper are continuously fed. A paper feeding operation in processes 6 to 11 and operations relative to image formation in processes 15 to 18 in FIG. 48 are similar to those in the continuous paper feeding mode. Accordingly, these operations are omitted in the following description. When a front end of a sheet of recording paper having a front face image is discharged from the fixing device 38, the double-sided switching solenoid is turned on in a process 19 and the two sheets of recording paper are continuously fed and guided to the return path 44.

The two paper sheets are next conveyed to the reversing path 45 by the rollers 47. When a first sheet of recording paper is guided to the reversing roller 48, the normal/reverse reversing motor 420 is already rotated at a high speed in the normal direction in a step 21 to feed this first paper sheet to the reversing tray 45*a*. Thus, the first paper sheet is rapidly fed to the reversing tray 45*a* by the reversing roller 48. When a front end of a second sheet of recording paper is next detected by the reversing sensor 125 in a process 20, the normal/-reverse reversing motor is rotated at a high speed in the reverse direction in a process 21. The reverse switching solenoid is turned on in synchronization with the reverse rotation of the normal/reverse reversing motor in a process 22.

The normal/reverse reversing motor is rotated in the reverse direction until a rear end of the first sheet of recording paper passes through the reversing roller 48. Thereafter, the normal/reverse reversing motor is rotated in the normal direction. Thus, the second sheet of recording paper is also guided onto a reversing PB tray. In the case of a finial sheet of recording paper, the normal/reverse reversing motor is rotated in the reverse direction by the counting operation of a timer and the paper sheet is stored into the second tray 52''. In this case, a linear velocity of the reversing roller 48 is set to be higher than that of the feed roller 47. Further, the linear velocity of the reversing roller 48 is set to be equal to that of the feed-out roller 49.

A paper feeding operation is next performed to form an image on a rear face of the sheet of recording paper from the second tray 52''. The paper feeding operation with respect to the rear face of the paper is basically similar to that with respect to the front face of the paper sheet. The differences in paper feeding operation between the front and rear faces of the paper sheet are that the powder clutch 119B is turned on in a process 13 in FIG. 48 and the number of pulses outputted to the tray motor 122B in a process 14 is simultaneously set to be equal to a pulse number provided in the paper feeding initial operation. Thus, the tray is raised from a lowering position thereof and the paper feeding operation can be performed. The subsequent image formation with respect to the rear face of the paper sheet is similar to that in the continuous paper feeding mode.

Continuous page copying double-sided mode

A continuous page copying double-sided mode is selected by the continuous page copying key 603 and the double-sided key 604 in the operating section 600 shown in FIG. 33. Similar to a book as an original, this mode is a mode for forming images to provide the relation between the front and rear faces of a paper sheet. For example, two sheets of recording paper are continuously fed and conveyed to copy images on first and second pages of the book original. In this case, an image on the first page of the book is copied onto a first sheet of recording paper. Further, an image on the second page of the book is copied onto a second sheet of recording paper. The first sheet of recording paper having the copied image on the first page of the book is discharged as it is. The second sheet of recording paper having the copied image on the second page of the book is turned upside down and is then stored to the second tray 52''.

The paper feeding operation is performed to copy an image on a third page of the book original on a rear face of the second sheet of recording paper stored in the second tray 52''. Further, a new sheet of recording paper is continuously fed to copy an image on a fourth page of the book original on this new paper sheet. The second sheet of recording paper having the copied image on the third page on the rear face thereof is discharged as it is. Similar to the case of the second page of the book original, the sheet of recording paper having the copied image on the fourth page of the book original is turned upside down and is stored to the second tray 52''. Thereafter, such a paper feeding operation is repeatedly performed. Therefore, in this mode, the number of arranged sheets of paper is limited. A storable number of arranged sheets of recording paper is determined by the paper sheet capacity of a conveying path from a paper feeding port onto the second tray 52'' through the transfer belt, the return path and the reversing path. In this embodiment, four sheets of recording paper can be stored in this conveying path in the case of paper size A4 and two sheets of recording paper can be stored in this conveying path in the case of paper size A3. Thus, the number of arranged sheets of recording paper is determined by such a size of the conveying path. Namely, the number of arranged sheets of recording paper for enabling a continuous page double-sided copy is detected by the recording paper size. This paper sheet number is detected in accordance with a flow chart shown in FIGS. 41A and 41B.

Figures 41, 41A:
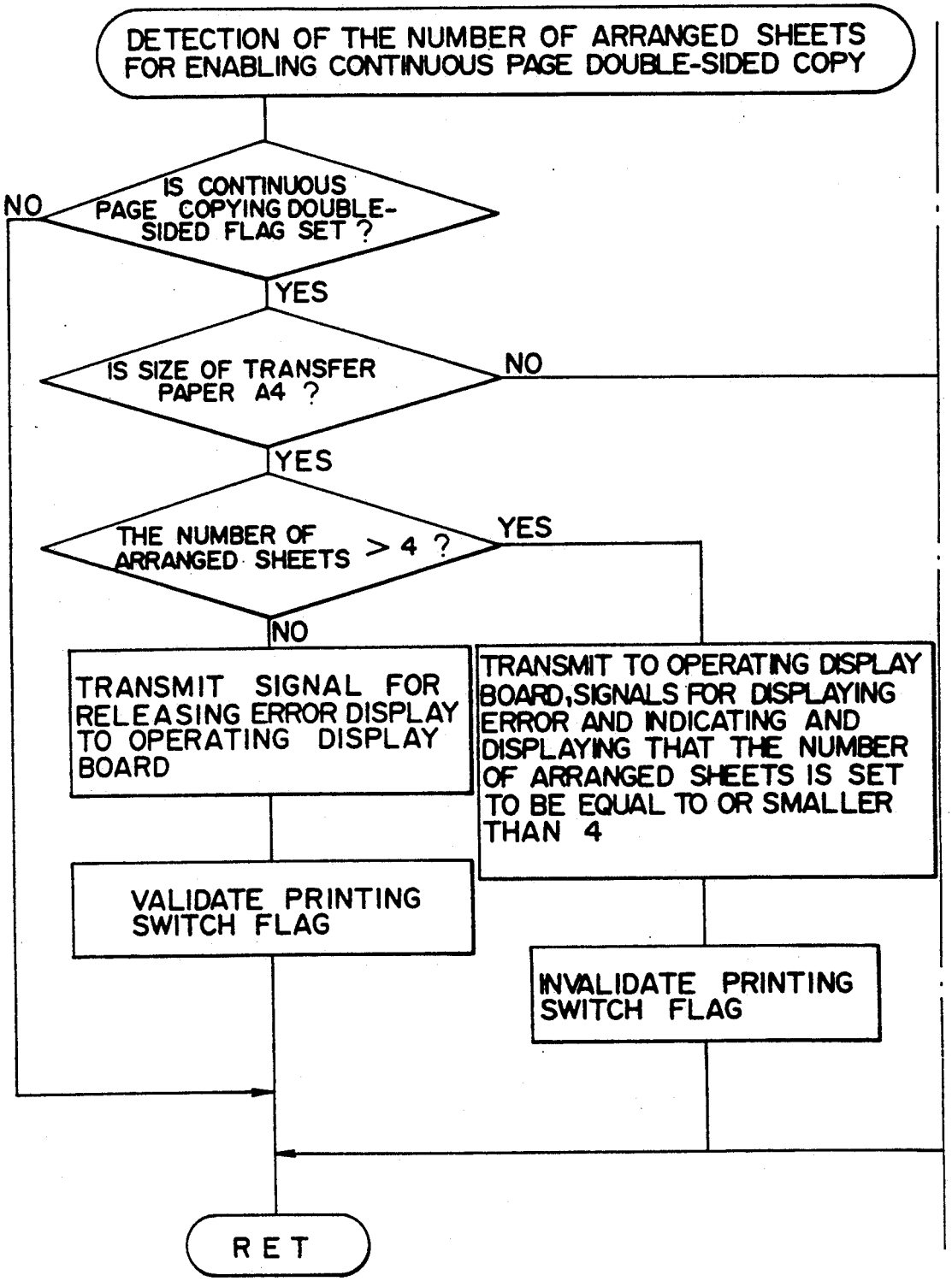
FIGS. 41A and 41B show a flow chart for detecting the number of sheets of recording paper necessary for permitting a continuous page double-sided copy operation.
Figure 41B:
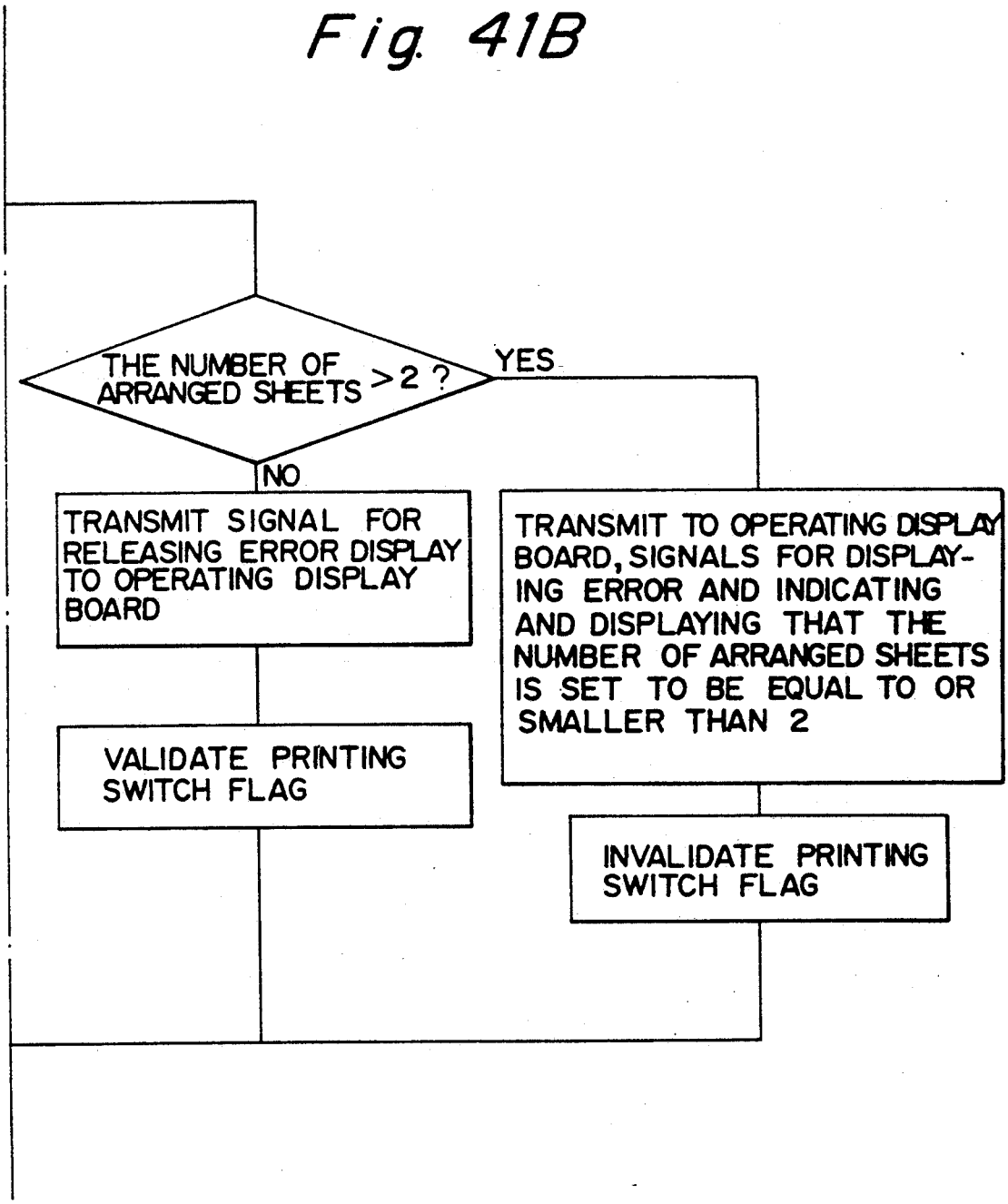
Figure 49:
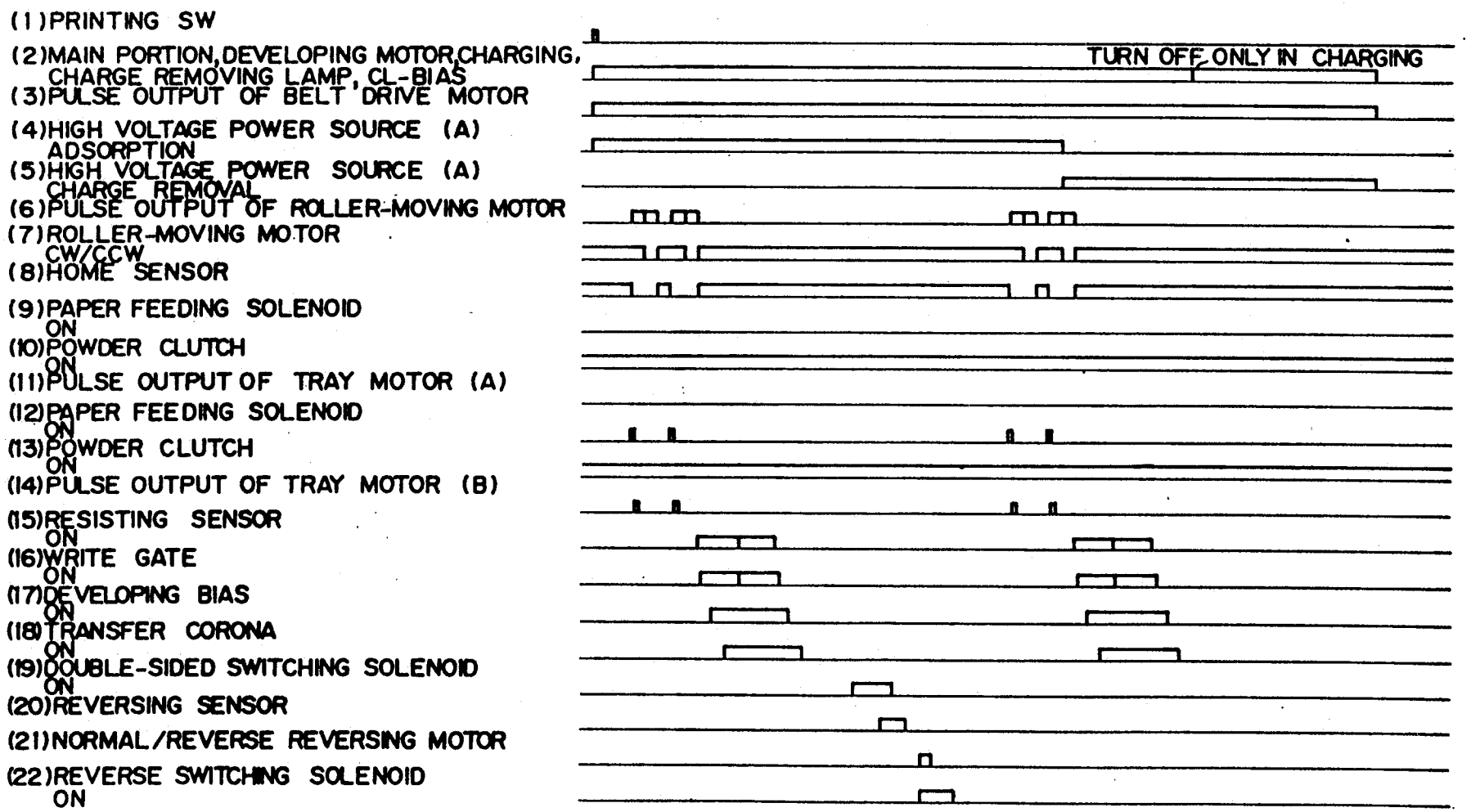
FIG. 49 illustrates the case in which a sheet of paper is fed and conveyed from the second tray in order to discharge the sheet of paper and store a second sheet of continuous recording paper to the second tray.

In the flow chart shown in FIGS. 41A and 41B, it is first judged whether or not the continuous page copying double-sided mode is started by a continuous page copying double-sided flag. Then, the number of arranged sheets of paper is compared with a set value in accordance with the recording paper size. When the number of arranged sheets is greater than the set value, the operating display board displays an error in number and indicates and displays that the number of arranged sheets is reduced and set to a value equal to or smaller than the set value. In contrast to this, when the number of arranged sheets is equal to or smaller than the set value, the error display is released and the printing switch is pushed, the copying machine is operated in accordance with a timing chart shown in FIG. 49. FIG. 49 shows a case in which a sheet of paper is fed and conveyed from only the second tray 52''. The double-sided switching solenoid, the reversing sensor, the normal/reverse reversing motor and the reverse switching solenoid are operated as shown in processes 19 to 22 in FIG. 49 to discharge a first sheet of continuous recording paper and store a second sheet of continuous recording paper to the second tray 52''. Subsequent operations are similar to those in the continuous double-sided mode.

Thick paper mode

Figure 42:
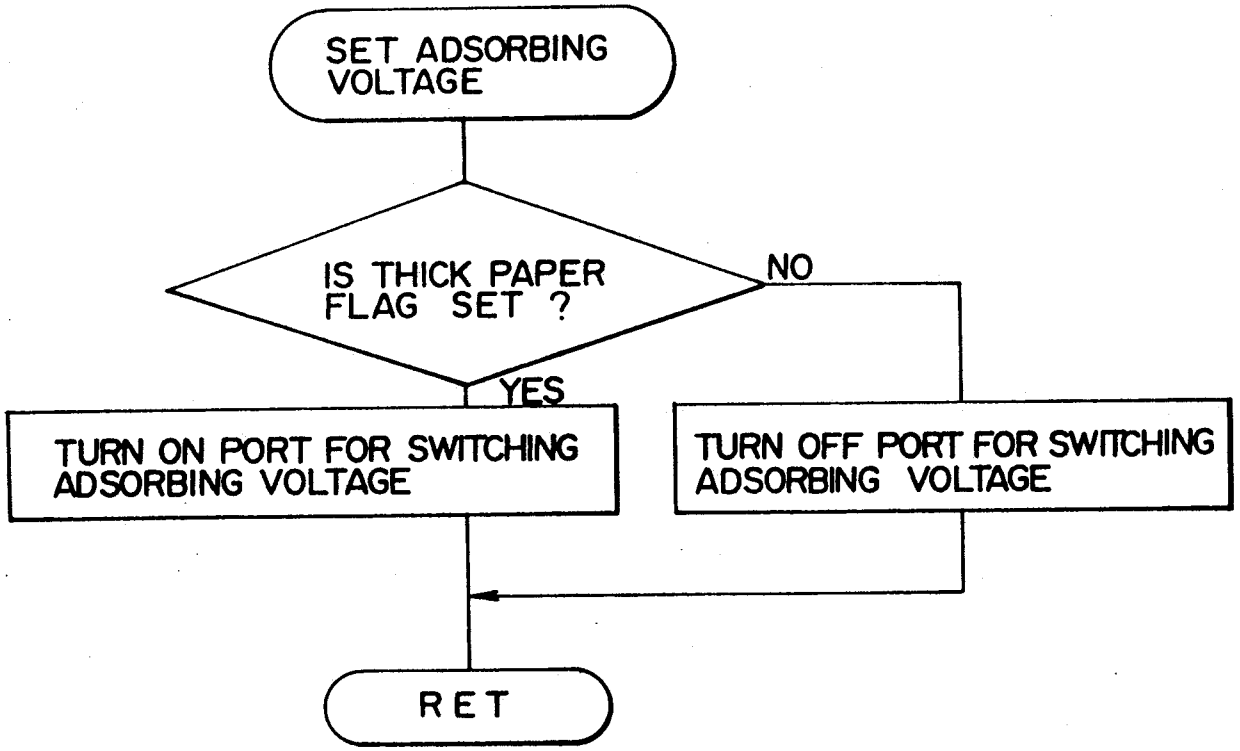
FIG. 42 shows a flow chart for setting an adsorbing voltage according to a subroutine process grouping according to the invention.

A signal-receiving interruption is generated on a main control side by pushing a thick paper key from the operating section. A thick paper flag is then set. An adsorbing voltage is set in accordance with the subroutine group of the processings except for pulse processing in the main flow chart. FIG. 42 shows a flow chart for setting the adsorbing voltage. In FIG. 42, it is first judged whether an operating state of the thick paper flag is set or not. When the operating state of the thick paper flag is set, a signal line for switching the adsorbing voltage of the high voltage power source (A) attains a turning-on state so that a voltage level on this signal line is set to a high voltage level suitable for the adsorption of thick paper. In contrast to this, when no operating state of the thick paper flag is set, the signal line attains a turning-off state so that the voltage level on this signal line is set to a high voltage level suitable for the adsorption of normal plain paper.

Supplying mode

Figure 43:
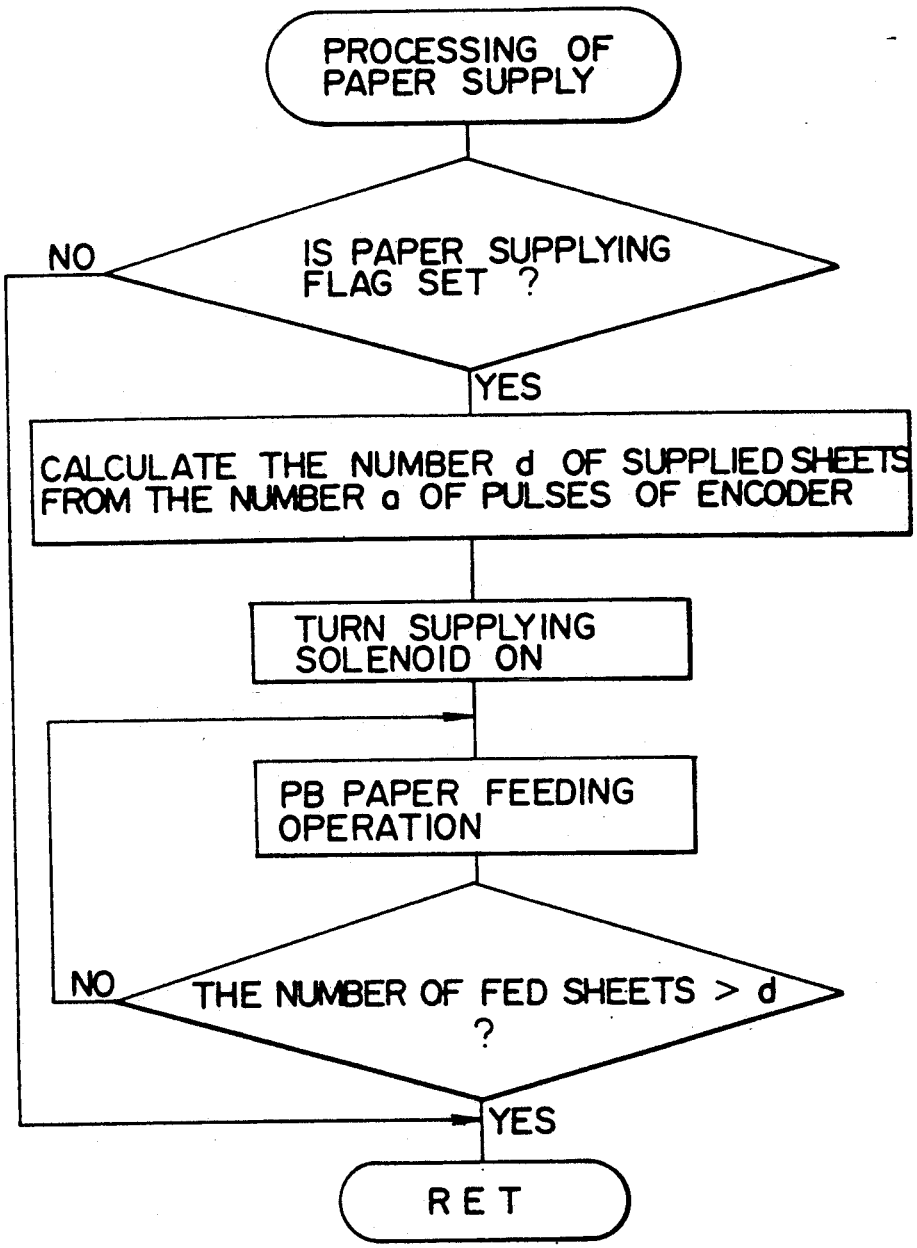
FIG. 43 illustrates a flow chart which describes paper supply processing in accordance with the subroutine process grouping described above.

A signal-receiving interruption is generated on the main control side by pushing the supplying key 606 from the operating section. A supplying flag is then set. Supplying processing of paper is performed in accordance with the subroutine group of the processings except for pulse processing in the main flow chart. FIG. 43 shows a flow chart of this supplying processing. In FIG. 43, the number d of sheets of paper supplied to the first tray 52' is first calculated. Thereafter, a supplying solenoid is turned on to feed a sheet of paper from the paper bank side. The supplying processing is completed if the number of sheets of paper actually fed is equal to or greater than the number d.

Reception and transmission of a sheet of recording paper from the paper bank side A sheet of recording paper can be smoothly transmitted from the paper bank side to the copying body side without any slack and tension by setting conveying speeds of the conveying belt 53 and the PB belt 218 to be equal to each other. For example, since a linear velocity of the conveying belt 53 on the copying body side is set to 120 mm/s, the sheet of recording paper can be smoothly transmitted by setting a linear velocity of the PB belt 218 to 120 mm/s. However, in this embodiment, the linear velocity of the PB belt is set to 130 mm/s to improve productivity on the paper bank side.

Figure 50:
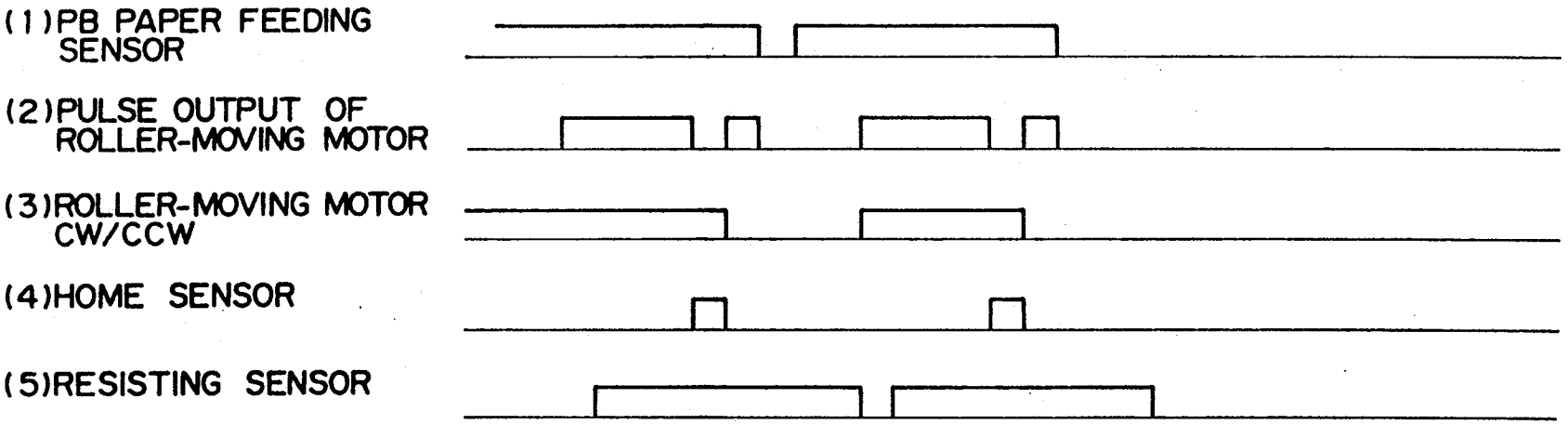
FIG. 50 illustrates the case where a sheet of recording paper is conveyed from the paper bank side and the paper bank feeding sensor is turned on so that the paper receiving operation is performed using the paper bank sensor.

In this case, the linear velocity of the PB belt 218 is higher than that of the conveying belt 53 (linear velocity of PB belt > linear velocity of conveying belt). The first driven roller 55 is moved from leftward to rightward in FIG. 2 when the sheet of recording paper is transmitted from the PB belt 218 to the conveying belt 53. Thus, the conveying belt 53 and the sheet of recording paper apparently come in contact with each other at a zero relative speed. Accordingly, the sheet of recording paper is adsorbed by an electric charge pattern to the conveying belt 53 and is conveyed by this conveying belt, thereby completing the receiving operation of the sheet of recording paper. FIG. 50 shows a timing chart of this paper receiving operation.

In FIG. 50, when a sheet of recording paper is conveyed from the paper bank side, a paper bank paper feeding sensor (or a PB paper feeding sensor) 139 is turned on and the paper receiving operation is performed with this sensor as a reference. Further, a pulse is outputted to the roller moving motor 68 to rotate this motor in the normal and reverse directions. A pulse frequency of this roller moving motor 68 may be set to a pulse frequency provided at a moving speed of the pickup roller 58 at which the difference in linear velocity between the conveying belt 53 and the PB belt 218 is equal to 10 mm/sec (=130 mm/sec−120 mm/sec). At this time, it is sufficient to set the number of pulses of the roller moving motor 68 in accordance with an escaping amount of the pickup roller 58 for moving the first driven roller 55 to its home position detected by the home sensor 71. A pulse for rotating the roller moving motor 68 in the clockwise direction is transmitted to this roller moving motor 68 after the pickup roller 58 has been escaped to its home position.

Thus, the sheet of recording paper and the conveying belt 53 apparently come in contact with each other, thereby performing the paper receiving operation. Thereafter, a front end of the sheet of recording paper is detected by the resisting sensor. Thus, operating timings relative to the subsequent image formation are determined.

FIG. 50 shows timings of the paper receiving operation in which two sheets of recording paper are fed. After the receiving operation of a first sheet of recording paper has been completely performed, the rotational direction of the roller moving motor 68 is switched to the counterclockwise (CCW) direction to return the moving pickup roller to its initial position. In this case, the number of pulses of this motor may be set to the above-mentioned pulse number, but a conveying frequency of the roller moving motor 68 is set to be slightly high so as to improve productivity.

The paper feeding operation is performed as mentioned above at times of various kinds of copying operations in which a sheet of recording paper is fed from the first tray 52' and the second tray 52'' in the copying body 3. In contrast to this, a copying operation of the copying machine is performed as follows by feeding the sheet of recording paper from the paper bank device 4.

The paper bank device 4 has the tray opening/closing sensors 261 to 264 for respectively detecting opening and closing operations of the first to fourth PB trays 201 to 204. When the opening and closing operations of each of the PB trays are detected, sheets of recording paper are assumed to be supplied into each of the PB trays and the following initial operation is performed.

Each of the PB trays 201 to 204 is positioned in the paper bank device 4. A sheet of recording paper is fed from a certain PB tray by the corresponding one movable paper feeding unit 220. The paper bank device 4 has a PB tray changing means operated at a high speed. The PB tray changing means stores a paper position in accordance with the remaining amount of paper sheets. The PB tray changing means conforms this paper position to a paper feeding position as the position of an uppermost paper sheet such that no paper feeding position is changed by the paper feeding operation irrespective of a change in the remaining amount of paper sheets on the PB tray.

After the opening and closing operations of the first to fourth PB trays 201 to 204 are respectively detected, the paper feeding unit 220 is vertically moved to an uppermost point of a first selected PB tray by the drive motor 251 for driving the elevating device in the paper bank unit. The uppermost point of each of the PB trays is located by about 5 mm above an uppermost face of the paper sheets when 250 sheets of paper as a maximum loading capacity are stored in each of the first to third PB trays 201 to 203, or when 2000 sheets of paper as a maximum loading capacity are stored in the fourth PB tray 204. The uppermost point of each of the first to third PB trays is located by 30 mm above a bottom plate thereof. The uppermost point of the fourth PB tray is located by 205 mm above a bottom plate thereof. The uppermost point of each of the PB trays is set as a home position thereof.

A vertical home position of the paper feeding unit 220 is equal to that of the first PB tray 201 located at an uppermost stage. The vertical position of the paper feeding unit 220 is controlled by a stepping motor such that the paper feeding unit 220 is moved from the vertical home position thereof in a downward direction in accordance with the number of pulses of the stepping motor. At this time, for example, a vertical moving speed of the paper feeding unit 220 is set to 150 mm/sec and the paper feeding unit 220 is moved upward and downward in accordance with normal and reverse rotations of the stepping motor. The paper feeding unit 220 is lowered from the home position of each of the PB trays until an upper end of the sheets of paper is detected by the paper upper end sensor 233 disposed in the paper feeding unit 220. The PB belt is then stopped in a position located by 5 mm above the detected upper end of the sheets of paper. A paper feeding operation is repeatedly performed with this position as a home position of this paper feeding operation.

Information of the paper feeding position of the paper feeding unit 220 is stored at any time to a non-volatile RAM within the main control board 401 as an amount indicative of the number of pulses counted from the home position of the stepping motor even when the selected PB tray is changed. Thus, it is possible to judge the remaining amount of sheets of paper stored in each of the PB trays. This paper feeding position of the paper feeding unit 220 is set to an initial position for starting the next paper feeding operation thereof.

When the above PB tray is selected again, the paper feeding unit 220 is directly moved to a position detected by the paper upper end sensor which is attached to the paper feeding unit 220 and is located by 5 mm above an upper end of the stored sheets of paper below the home position of the selected PB tray. The paper feeding operation is repeatedly performed with this position as a home position of the paper feeding operation. Thus, the PB trays are rapidly selected and changed even when the remaining amount of sheets of paper is small.

When no sheet of paper is detected by the paper upper end sensor 233 in the home position of the paper feeding operation during a continuous paper feeding operation, the paper feeding unit 220 is moved downward by the paper feeding unit drive motor 251 until the sheet of paper is detected by the paper upper end sensor 233. Then, the paper feeding operation is repeatedly performed. Thereafter, the sheet of paper is repeatedly fed from a fixed PB tray while the paper feeding unit 220 is lowered as the paper feeding operation is performed.

Figures 51, 51A:
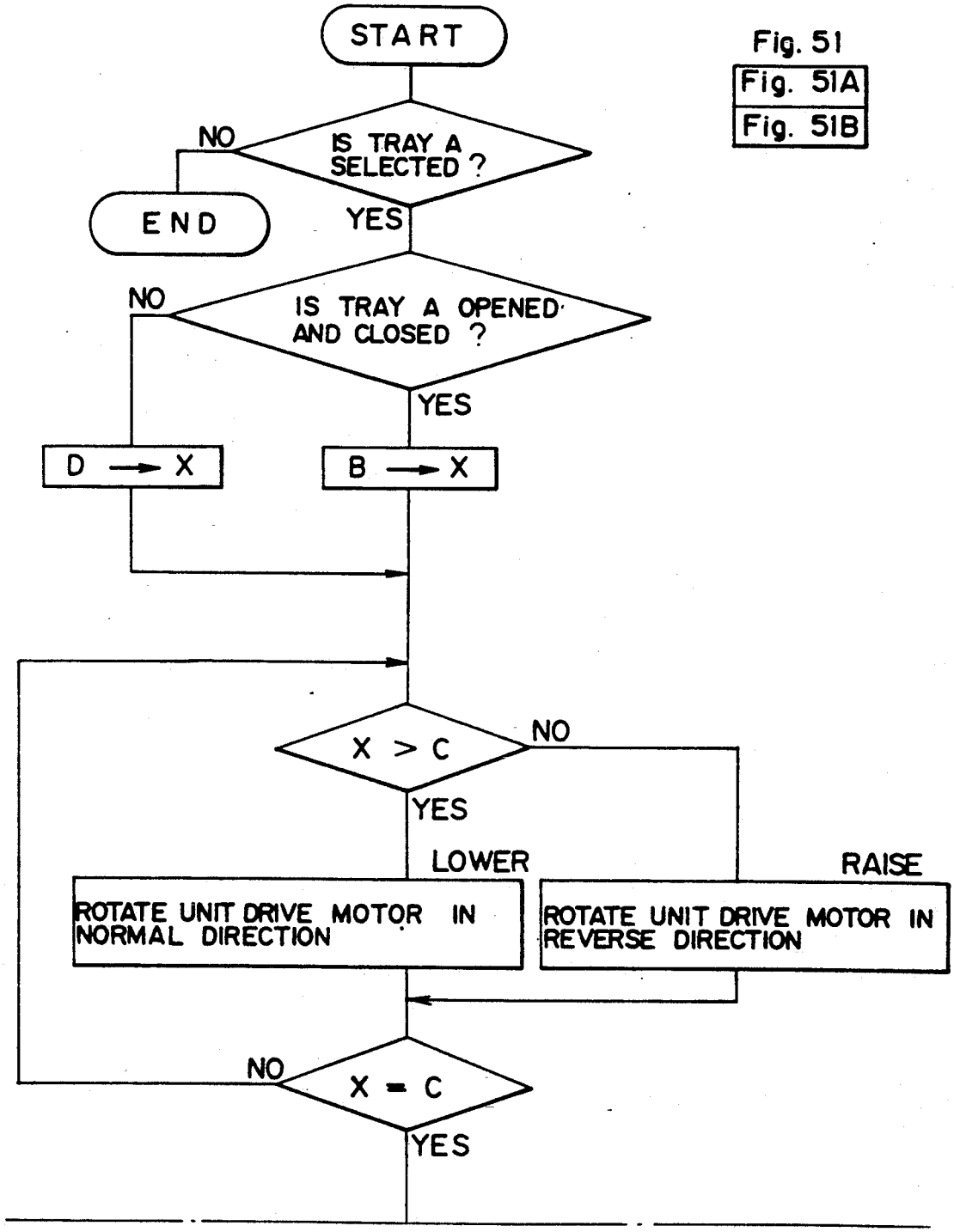
FIG. 51 is a control flow chart of the paper bank device.
Figure 51B:
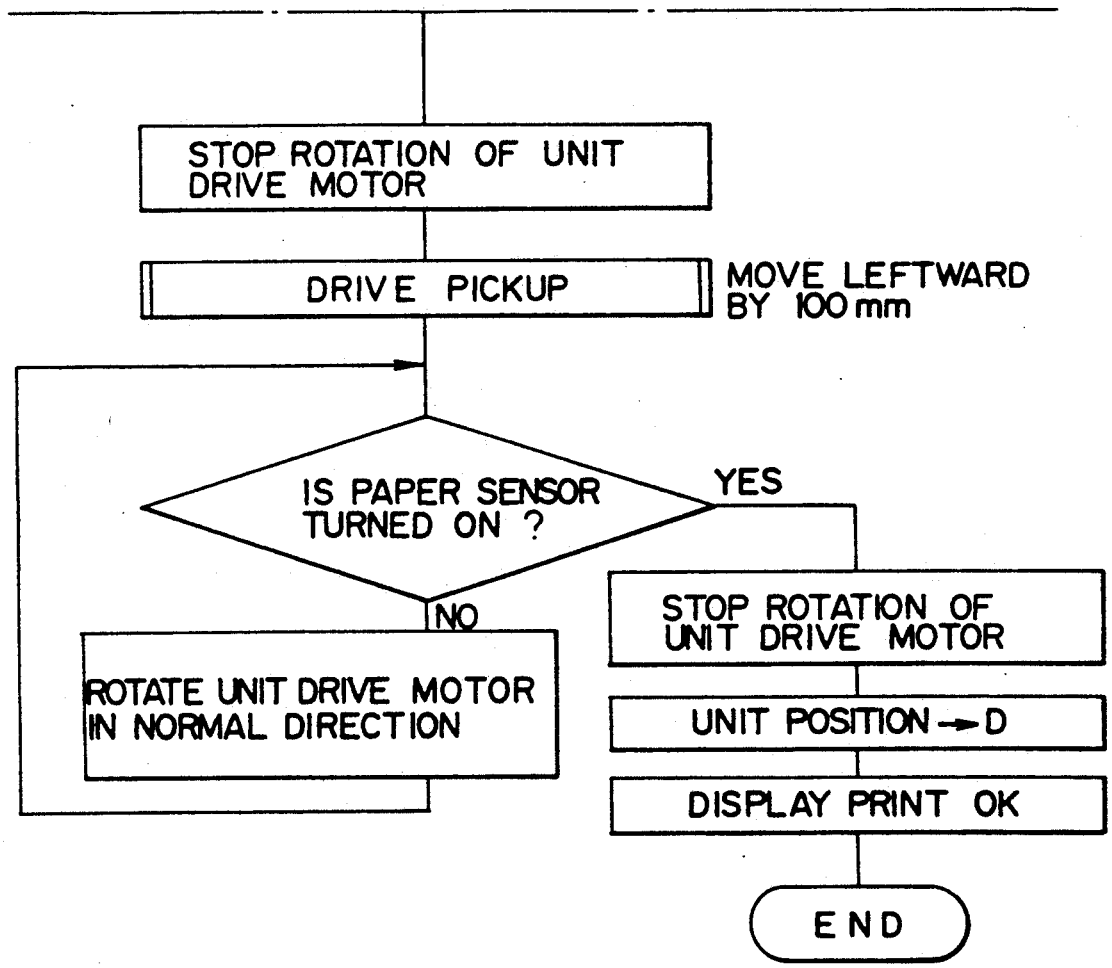

A selecting operation of the fed sheet of paper is shown in a flow chart in FIG. 51. When a certain PB tray is selected in accordance with the selection of a paper size, it is judged whether or not it is a first paper feeding operation after this selected PB tray is opened and closed. In the case of the first paper feeding operation, the remaining amount of sheets of paper is unknown so that a paper feeding position is undetermined. After a second paper feeding operation, a loading amount of the sheets of paper is already known in an uppermost position B of each of the above PB trays. Accordingly, a preceding final paper feeding home position D is set to a target position X of the paper feeding unit 220 and is compared with the present position of the paper feeding unit 220. Then, the paper feeding unit 220 is vertically moved.

To vertically move the paper feeding unit 220, the pickup roller 215 is already located within the paper feeding unit 220. When the paper feeding unit 220 reaches the target position, the pickup roller 215 is moved in a paper feeding direction to perform the paper feeding operation. Next, an upper end of the sheets of paper is detected by the paper upper end sensor 233 and the paper feeding unit 220 is lowered such that this paper feeding unit is moved to the paper feeding home position. After the second paper feeding operation, the paper feeding unit 220 has already reached the preceding final paper feeding home position D so that this lowering movement of the paper feeding unit is not performed. At this time, the paper feeding home position is stored to a buffer memory D to use this position in the paper feeding operation.

When the paper feeding unit 220 has reached the paper feeding home position, a display section for displaying the ability of a printing operation is turned on to show a state in which the printing operation can be performed. Further, a copying operation is also started. Thereafter, operations subsequent to the second paper feeding operation are repeatedly performed during the paper feeding operation. The position of the paper feeding unit 220 is stored to the buffer memory D while this paper feeding unit 220 is lowered.

The pickup roller 215 of the paper feeding unit 220 is displaced by a constant distance such as 100 mm in the paper feeding direction together with the PB belt 218 to adsorb a sheet of paper within a PB tray to the PB belt 218 at a paper feeding time. When the paper feeding unit 220 is vertically moved by the selection of a paper size, the pickup roller 215 is moved to a rightward home position to perform an escaping operation thereof. The pickup roller 215 is moved from the home position detected by the PB pickup sensor 235 by an operation of the PB pickup drive motor 230 attached to the paper feeding unit 220. The PB pickup drive motor 230 is constructed by a stepping motor and a position of the PB pickup drive motor 230 is controlled in accordance with the number of pulses thereof.

In the paper bank device 4, a sheet of paper is fed from a fixed PB tray by the paper feeding unit 220 moved in the vertical direction. Accordingly, paper feeding positions are different from each other in accordance with separate stages of paper feeding PB trays and a loading amount of paper sheets thereof. A timing for conveying the sheet of paper to the copying body is calculated from a paper feeding timing of the paper feeding unit 220 as follows. The PB belt 218 is moved by the PB belt drive motor 241 composed of a stepping motor at an equal speed of 130 mm/sec. After the PB belt variable speed motor 238 is operated, the sheet of paper is conveyed at a speed of 130 mm/sec. A conveying distance of the paper sheet is changed in accordance with the vertical position of the paper feeding unit and is determined by the number N of steps of the paper feeding unit drive motor 251 counted from a home position thereof. The sheet of paper is moved by 0.2 mm in one step of the paper feeding unit drive motor 251. Accordingly, a conveying passage distance L with respect to each of the PB trays is represented as follows.

$$L=N\times 0.2+P$$

In this formula, reference numeral P designates a fixed distance in accordance with each of the PB trays. For example, the fixed distance P is set to 200 mm in the case of the first to third PB trays and is set to 120 mm in the case of the fourth PB tray. This difference in distance is based on the conveying distance in a horizontal direction. Accordingly, a conveying time T is provided as follows.

$$T=L/130$$

A total of this conveying time T and a paper feeding time is equal to a time required to feed a first sheet of paper. A time required to continuously feed a second or subsequent sheet of paper does not relate to this conveying time T. It is sufficient to repeatedly perform the continuous paper feeding operation in a state in which the distance between sheets of paper is constant. In the case of paper size A4, the paper feeding operation is repeatedly performed in 3 seconds/cycle so that a printing operation of 20 PPM can be performed.

Figure 28B:
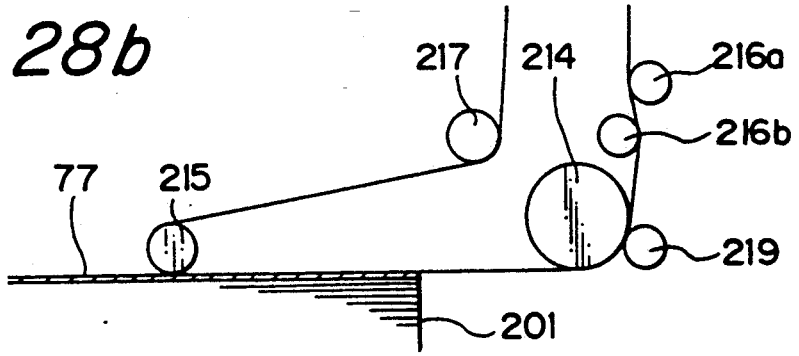
Figure 28C:
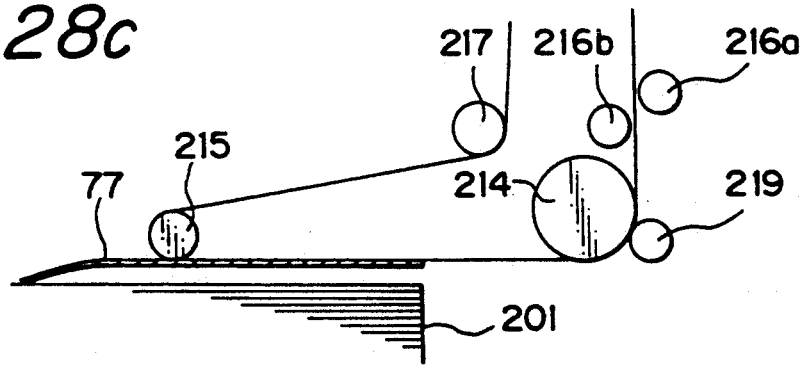

The paper feeding operation will next be explained with reference to FIGS. 28*a* to 28*c* and FIGS. 29*a* to 29*c*. In this embodiment, a mechanism for reducing and stopping the movement of the PB belt 218 is constructed by using the two belt speed changing rollers 216*a* and 216*b*. FIGS. 28*a* to 28*c* show a case in which the sheet of paper is fed from the first to third PB trays 201 to 203. FIGS. 29*a* to 29*c* show a case in which the sheet of paper is fed from the fourth PB tray 204.

As a home position of the paper feeding operation, the paper feeding unit 220 sets a position detected by the paper upper end sensor 233 which is attached to the paper feeding unit 220 and is located by 5 mm above an upper portion of sheets of paper stored in a PB tray below a home position thereof. The paper feeding operation is repeatedly performed with this position detected by the paper upper end sensor as the home position of the paper feeding operation. At this time, a flat portion of the PB belt 218 arranged between the pickup roller 215 and the driven roller 214 is located by 5 mm above the upper end of the sheets of paper. Next, the pickup roller 215 of the paper feeding unit 220 is displaced by 100 mm together with the PB belt 218 in the paper feeding direction to adsorb a sheet of paper within the PB tray to the PB belt 218 at the paper feeding time.

Before the paper feeding operation, an electric charge pattern is formed by the charging roller 217 on the PB belt 218 by a length amount corresponding to the paper size in synchronization with paper feeding timing so as to absorb an uppermost sheet of paper in the PB tray to the PB belt 218.

The paper feeding unit 220 is then lowered by 5 mm to make the PB belt 218 come in contact with an upper end portion of the paper sheet. At this time, the paper feeding unit 220 is operated by using the above-mentioned belt speed changing rollers 216 such that a feeding speed of the PB belt 218 on a paper contact face thereof is equal to zero. The feeding speed of the PB belt 218 is set to zero to improve adsorption of the sheet of paper since only the uppermost sheet of paper is adsorbed and conveyed from the sheets of paper at rest. However, the sheet of paper comes in contact with the PB belt 218 and may be adsorbed and conveyed by this belt in a state in which the conveying speed of the PB belt 218 is reduced and set to a speed equal to or lower than 130 mm/sec.

The sheet of paper is adsorbed to the PB belt from a front end thereof when the sheet of paper is fed from each of the first to third PB trays 201 to 203. The sheet of paper is then conveyed in the horizontal direction. To do this, the paper feeding unit 220 is raised by using the belt speed changing rollers 216 to the home position of the paper feeding operation located by 5 mm above the upper portion of the sheets of paper in a state in which the feeding speed of the PB belt 218 on the paper contact face is equal to zero.

A conveying path of the sheet of paper having an S-shaped curve is changed to an original conveying path having no S-shaped curve by operations of the belt speed changing rollers 216. A vertical conveying moving section of the PB belt 218 is then changed and formed in the shape of a straight line to feed the sheet of paper. At this time, the sheet of paper is adsorbed to the PB belt 218 moved by the PB belt drive motor 241 at the equal speed of 130 mm/sec and is conveyed at the equal speed.

A winding means of the belt speed changing rollers 216 is then operated between conveyed sheets of paper continuously fed and passing through the belt speed changing rollers 216, thereby preparing a speed reducing operation in the next paper feeding process. At this time, the conveying speed of the PB belt 218 on a paper feeding face is accelerated, but no PB belt comes in contact with the sheet of paper so that no problem about the belt is caused.

When the sheet of paper is fed from the fourth PB tray 204, the sheet of paper is adsorbed to the belt from a position separated about 20 mm from a front end of the sheet of paper. The sheet of paper is first conveyed by using the belt speed changing rollers 216 in the horizontal leftward direction to convey the sheet of paper by the driven roller 214 in the vertical direction. Namely, the paper feeding unit 220 is raised to the home position of the paper feeding operation located by 5 mm above the sheets of paper while the feeding speed of the PB belt 218 in a paper contact region thereof is set to a minus speed showing a reverse moving direction. Thus, the sheet of paper can be also adsorbed to the PB belt 218 until the front end of the paper sheet in the case of the fourth PB tray 204, thereby stably feeding and conveying the sheet of paper.

The PB belt speed changing motor 238 for rotating the belt speed changing rollers 216 is constructed by a stepping motor. A timer value corresponding to a rotational speed of the PB belt speed changing motor 238 at each of times the belt speed changing operation provided above is stored to a ROM disposed within the main control board 401 in advance. Speed and rotation of the PB belt speed changing motor 238 in normal and reverse directions thereof are controlled while this timer value is called from the ROM.

To reduce the moving speed of the PB belt in the next paper feeding process, a winding operation of the belt speed changing mechanism may be performed at an equal rotational speed of the PB belt speed changing motor 238 between conveyed sheets of paper continuously fed and passing through the belt speed changing rollers 216 since the distance between the sheets of paper is normally set to about 150 mm in the case of paper size A4.

Figure 52:
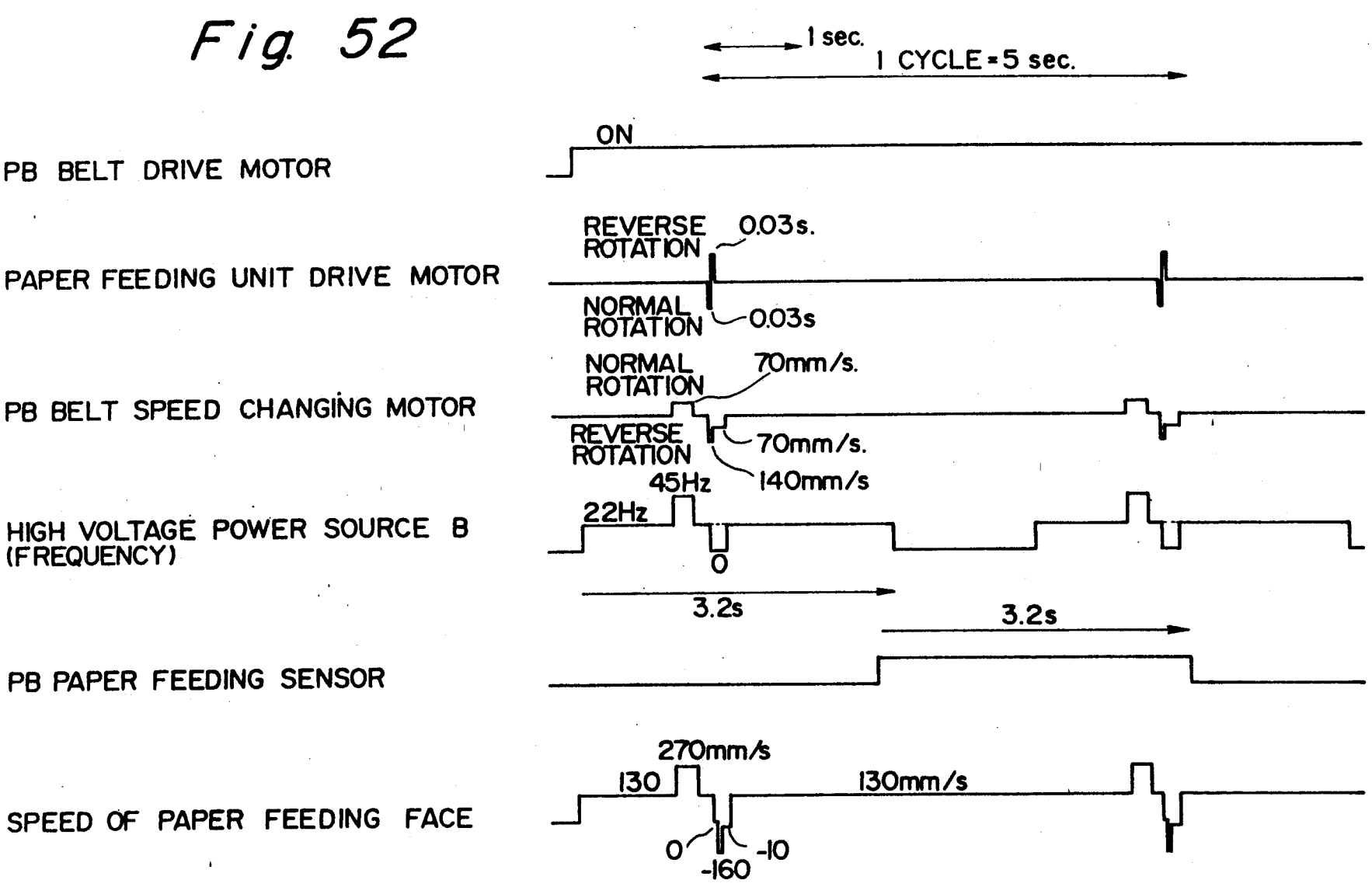
FIGS. 52 and 53 are timing charts in control of the paper bank device shown in FIG.
Figure 53:
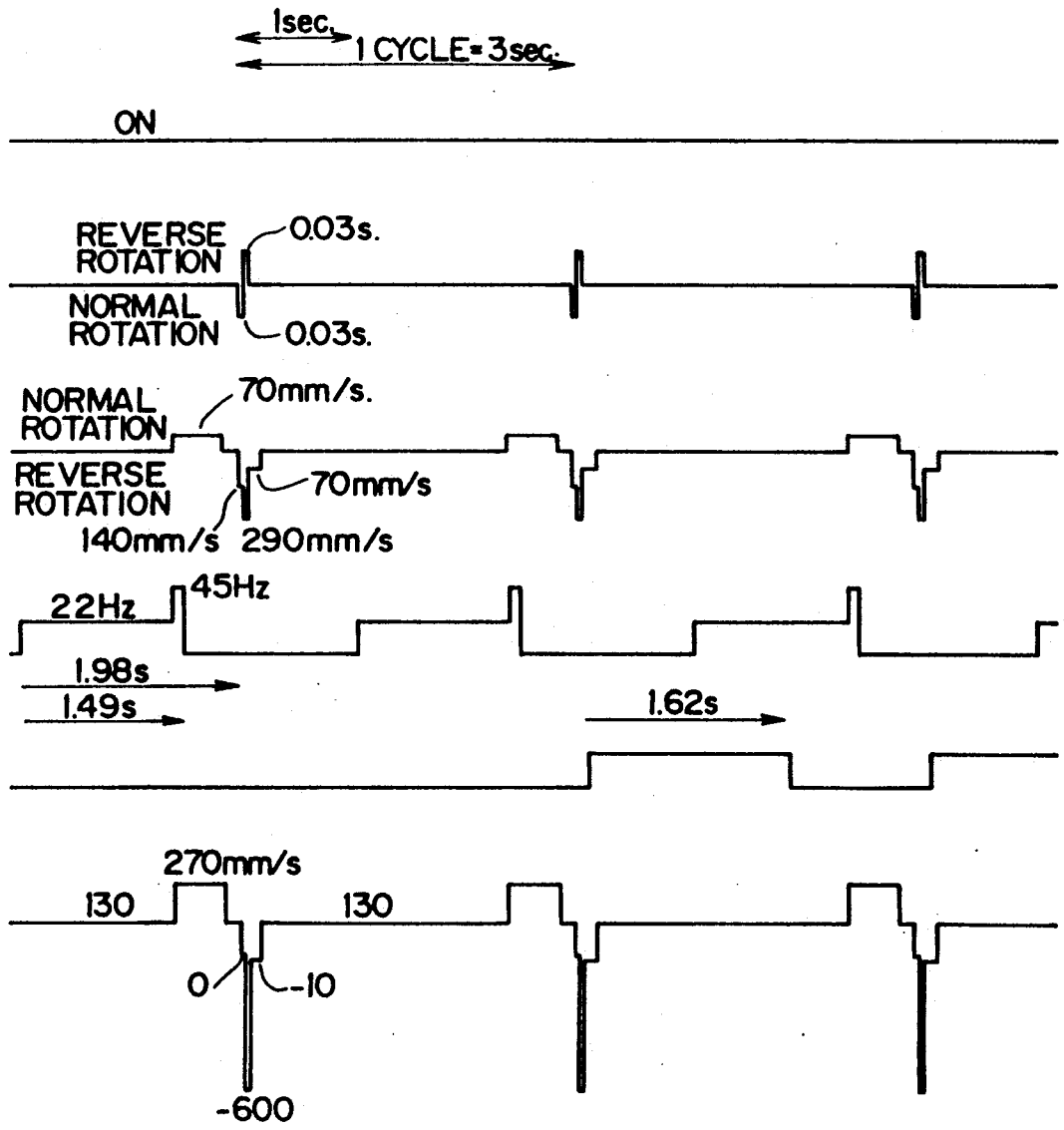

For example, the paper feeding operation with respect to each of the first to third PB trays 201 to 203 is performed in accordance with a timing chart shown in FIG. 52. The paper feeding operation with respect to the fourth PB tray 204 is performed in accordance with a timing chart shown in FIG. 53. FIG. 52 shows an example in which a sheet of recording paper having size A3 is fed. FIG. 53 shows an example in which the sheet of recording paper having size A4 is transversally fed.

In FIG. 52, the PB belt drive motor 241 is turned on to rotate this motor at an equal speed. Next, the high voltage power source B for applying a voltage to the charging roller 217 is operated in synchronization with paper feeding timing. With respect to this paper feeding timing for start, a time value calculated from a linear velocity of the belt is programmed in advance as the forming position of an electric charge pattern of the PB belt 218 so as to form the electric charge pattern on an upstream side from a paper adsorbing position of the PB belt 218. In this embodiment, this time value is equal to a time set by about 1.48 seconds before the adsorbing operation of the paper sheet. The time value in the case of the fourth PB tray 204 is different from that in the case of each of the first to third PB trays.

Next, before the paper feeding operation, the PB belt speed changing motor 238 is rotated in the normal direction to move the belt speed changing rollers 216 or the displacing roller 216'', thereby attaining a standby state thereof. The paper feeding unit drive motor 251 is then rotated in the normal direction at the paper feeding timing and the PB belt speed changing motor 238 is simultaneously rotated in the reverse direction at a high speed. Thus, the moving speed of the PB belt 218 in an adsorbing face region of the fed sheet is set to zero to make the PB belt 218 come in contact with an upper face of the paper sheet. Further, the PB belt speed changing motor 238 is rotated in the reverse direction to escape the belt speed changing rollers 216 or the displacing roller 216'' leftward, thereby vertically conveying the PB belt 218.

The fed and conveyed sheet of paper is detected for about 3.2 seconds by a PB paper feeding sensor 139 disposed in a paper feeding path of the copying body. A completing timing of the operation of the high voltage power source (B) 427 is equal to that in the case of an equal speed operation of the PB belt 218 since the PB belt 218 is accelerated and decelerated for a continuous operating period of the high voltage power source. Accordingly, the high voltage power source 427 is operated for a time period of 3.2 seconds. The PB belt speed changing motor 238 is operated when the linear velocity of the PB belt 218 is changed in the forming position of the electric charge pattern. When the PB belt speed changing motor 238 is operated, an applied frequency of the high voltage power source (B) 427 is changed such that a period of the electric charge pattern of the PB belt 218 is constant. When the linear velocity of the PB belt 218 is equal to or lower than zero in the forming position of the electric charge pattern, an arbitrary operation of the high voltage power source (B) 427 can be performed by effectively providing a finally formed electric charge pattern. In this embodiment, the high voltage power source (B) 427 is turned off.

In FIG. 53, a basic operation of the copying machine is similar to that shown in FIG. 52. The paper feeding operation with respect to the fourth PB tray 204 includes a displacing operation of the PB belt 218 on an adsorbing face thereof in a minus displacing direction to adsorb the sheet of paper to the PB belt until a front end of the paper sheet. When the paper feeding unit drive motor 251 is rotated in the reverse direction, the PB belt speed changing motor 238 is rotated in the reverse direction at a higher speed to provide a linear velocity of -600 mm/sec on the paper feeding face. Since the fourth PB tray is different from the first to third PB trays with respect to layout, the high voltage power source (B) 427 is operated before about 1.98 seconds with respect to the paper adsorbing operation. Since paper size A4 is used, the operation of the PB belt 218 is stopped in the forming position of the electric charge pattern during a high speed movement of this belt.

Thus, the sheet of paper can be adsorbed and conveyed by the PB belt 218 in the forming position of the electric charge pattern thereon having a length equal to the paper size in a state in which the operation of the PB belt 218 is stopped.

It is possible to use a common vacuum sucking device in some cases as an adsorbing or attractive device using the above method of the electric charge pattern.

In accordance with the present invention, it is possible to prevent a recording medium from being slantingly fed and conveyed without disposing a resisting means. Further, no recording medium is fed in an overlapping state and is jammed. Accordingly, it is possible to provide an apparatus for feeding and conveying the recording medium with very high reliability.

Further, in accordance with the present invention, it is possible to set the frictional force of a conveying means applied to the recording medium to zero, or reduce this frictional force as much as possible. Thus, the generation of paper powder can be restricted and no error in conveyance of the recording medium is caused by the paper powder and no reduction in image quality is caused at an image forming time. Accordingly, it is possible to provide an apparatus for feeding and conveying the recording medium with very high reliability.

In accordance with the present invention, a feeding or conveying state of the recording medium from a storing means is constant and reliable at any time. Therefore, it is not necessary to dispose any special device for adjusting a conveying state of the recording medium and any special recording medium conveying means in addition to the conveying means. Accordingly, it is possible to provide an apparatus for feeding and conveying the recording medium and having a simplified structure with reduced cost.

In the recording medium feeding/conveying apparatus in accordance with the present invention, the recording medium can be constantly and reliably fed from the storing means at any time without changing the entire moving speed of an endless conveying means in a feeding operation of the recording medium from the storing means to an image forming section. Accordingly, the recording medium can be constantly and reliably fed from the storing means at any time without reducing a copy producing speed per unit time.

When a belt for forming an alternating electric field is used as the endless conveying means, the recording medium can be adsorbed to the conveying means stably and reliably. Accordingly, it is not necessary to dispose any special resisting device.

An additional moving device may be reciprocated after a rear end of the recording medium such as a sheet of paper passes through the additional moving device. In accordance with such a structure, it is possible to prevent external force from being applied to the recording medium during a conveying operation thereof. Accordingly, it is possible to reliably prevent all the recording media from being slantingly fed and jammed.

Many widely different embodiments of the present invention may be constructed without departing from the spirit and scope of the present invention. It should be understood that the present invention is not limited to the specific embodiments described in the specification, except as defined in the appended claims.

What is claimed is:

1. A feeder of an image forming apparatus comprising:

storing means for storing a stack of recording mediums;

an endless belt, disposed adjacent to said storing means and an image forming section for forming an image on a recording medium, for conveying the foremost recording medium of the stack in said storing means to said image forming section;

driving means for driving said endless belt in a prescribed direction for conveying a recording medium; and speed controlling means for varying a speed of said endless belt driven by said driving means and passing by said storing means and for simultaneously maintaining a speed of said endless belt passing by at least said image forming section.

2. A feeder of an image forming apparatus as claimed in claim 1, wherein said speed controlling means are adapted to vary the speed of said endless belt passing by said storing means without performing speed control of said driving means.

3. A feeder of an image forming apparatus as claimed in claim 2, wherein said speed controlling means are adapted to vary the speed of said endless belt passing by said storing means in such a manner that said belt is reduced in speed, is stopped, or is further moved in a direction opposite to said prescribed direction for conveying a recording medium.

4. A feeder of an image forming apparatus as claimed in claim 3, wherein said speed controlling means comprises:

moving means for moving said endless belt driven by said driving means in a direction opposite to said prescribed direction or in said prescribed direction, and tension adjusting means for holding a tensile force of said endless belt constant at the point where said belt is passing by said image forming section as said endless belt is moved by said moving means.

5. A feeder of an image forming apparatus as claimed in claim 4, wherein said moving means are adapted to move said endless belt passing by said storing means at the same speed as a conveying speed of said endless belt driven by said driving means in the direction opposite to said prescribed direction, such that said endless belt is in contact with a foremost recording medium of a stack in said storing means at a zero relative speed.

6. A feeder of an image forming apparatus as claimed in claim 5, wherein said moving means comprises a roller movably disposed inside of said endless belt for moving said endless belt driven by said driving means in said prescribed direction or a direction opposite to said prescribed direction.

7. A feeder of an image forming apparatus as claimed in claim 6, wherein said moving means are disposed at a location downstream from a position where the foremost recording medium is attracted from said storing means with respect to said prescribed direction.

8. A feeder of an image forming apparatus as claimed in claim 1, wherein said feeder further comprises attractive means formed in said endless belt for attracting the foremost recording medium of a stack in said storing means.

9. A feeder of an image forming apparatus as claimed in claim 8, wherein said attractive means comprises an alternating electric field pattern formed on said endless belt.

10. A feeder of an image forming apparatus as claimed in claim 8, wherein said feeder further comprises pickup means disposed adjacent to said endless belt for moving said endless belt toward the foremost recording medium of the stack in said storing means such that said attractive means in said endless belt are in contact with said foremost recording medium.

11. A feeder of an image forming apparatus as claimed in claim 10, wherein said endless belt is held in a non-contact state with respect to said foremost recording medium when no recording medium is being fed, and only one portion of said endless belt passing by said storing means approaches said recording medium and comes into contact with said recording medium by said pickup means and is stopped at a feeding time of the recording medium by said speed controlling means and is returned after a predetermined time by said pickup means.

12. A feeder of an image forming apparatus as claimed in claim 11, wherein said pickup means comprises at least two rollers spaced from each other at a predetermined distance in said prescribed direction.

13. A feeder of an image forming apparatus comprising:

a plurality of storage means each for storing a stack of recording mediums;

an endless belt for feeding a recording medium from one of said plurality of storage means to an image forming section for forming an image;

attractive means formed in said endless belt for attracting a foremost recording medium of a stack in said storage means; and a plurality of pickup means disposed adjacent to said endless belt and each corresponding to a respective storage means for moving said endless belt toward the foremost recording medium in the respective storage means such that said attractive means in said endless belt are in contact with the foremost recording medium when the foremost recording medium is fed.

14. A feeder of an image forming apparatus as claimed in claim 13, wherein two or more of said pickup means are simultaneously operated and the recording media in said plural storage means can be simultaneously fed.

15. A feeder of an image forming apparatus as claimed in claim 14, wherein the foremost recording medium is fed from one of said plural storage means located on a most downstream side in a feeding direction of the foremost recording medium.

16. A feeder of an image forming apparatus as claimed in claim 13, wherein each of said plurality of pickup means comprises at least two rollers spaced from each other at a predetermined distance in a feeding direction of the foremost recording medium.

17. A feeder of an image forming apparatus comprising:

means for storing a recording medium for recording an image thereon;

endless conveying means for feeding said recording medium from the storing means to a predetermined position;

attractive means for attracting said recording medium and disposed in said endless conveying means;

attractive operating means for attracting and moving one portion of said endless conveying means to said recording medium; and feeding-speed changing means for changing a relative speed of said endless conveying means with respect to said recording medium in only one portion of the endless conveying means including a portion coming in contact with said recording medium;

the feeder being constructed such that plural recording media can be continuously fed at an approximately zero interval from said storing means by controlling operations of said attractive operating means and said feeding-spaced changing means.

18. A feeder of an image forming apparatus as claimed in claim 17, wherein said storing means is formed such that the storing means can be divided into a plurality of storing chambers by partition means;

said attractive operating means is disposed in each of the storing chambers;

the recording medium in each of the storing chambers can be attracted to said endless conveying means by separately operating the attractive operating means; and the recording medium is continuously fed one by one at the approximately zero interval from the plural storing chambers by controlling the operations of said feeding-speed changing means and the attractive operating means disposed in each of the storing chambers.

19. A feeder of an image forming apparatus as claimed in claim 17, wherein said storing means comprises a plurality of storage means arranged forward and backward in a feeding direction of the recording medium;

said attractive operating means disposed in each of the storage means; and said recording medium is continuously fed at the approximately zero interval from the plural storage means by controlling the operations of said feeding-speed changing means and the attractive operating means disposed in each of the storing means.

20. A feeder of an image forming apparatus as claimed in any of claims 17 to 19, wherein said feeding-speed changing means is arranged near said attractive operating means relative to a lowermost storage means located on a downstream side of said storing means in a feeding direction of said recording medium.

21. A feeder of an image forming apparatus as claimed in claim 20, wherein the recording medium is continuously fed at the approximately zero interval by automatically controlling the operations of the attractive operating means and the feeding-speed changing means when a detecting means detects that plural image information are formed in image-information holding means at an approximately zero interval, and detects commands for forming an image at a high speed and images on continuous pages.

22. A paper feeder of an image forming apparatus comprising:

means for storing a recording medium for recording an image thereon;

endless conveying means for adsorbing and conveying said recording medium from the storing means to a predetermined position;

said endless conveying means being moved at a constant speed and being formed such that a moving speed of the endless conveying means can be changed only in the vicinity of said storing means; and the paper feeder further comprising means for cleaning said endless conveying means and disposed in a moving portion of the endless conveying means moved at the constant speed.

23. A feeding method used in an image forming apparatus for feeding a recording medium stored within storing means to a predetermined position by endless conveying means, said feeding method comprising the steps of:

lowering at least one portion of said endless conveying means from an initial position to a feeding position of the storing means for feeding the recording medium, and stopping a lowering movement of said at least one portion;

raising the recording medium within the storing means until the recording medium comes into contact with said endless conveying means, and stopping a raising movement of the recording medium; and raising said endless conveying means in a returning process to the initial position;

said lowering, raising and returning processes being sequentially executed; and forming an electrical charge density pattern using a charger before said endless conveying means reaches the feeding position in said lowering step.

24. A feeding method used in an image forming apparatus as claimed in claim 23, wherein said lowering, raising and returning processes are executed in a state in which no charging occurs when said storing means is pulled out of an apparatus body and is then stored into said apparatus body, when the recording medium is supplied into said storing means, when a power source of the apparatus body is turned on, or when a double-sided copying mode is set.

* * * * *

UNITED STATES PATENT AND TRADEMARK OFFICE

CERTIFICATE OF CORRECTION

PATENT NO. : 5,255,904

DATED : OCTOBER 26, 1993

INVENTOR(S) : KAZUSHIGE TAGUCHI ET AL

It is certified that error appears in the above-indentified patent and that said Letters Patent is hereby corrected as shown below:

On the title page, item [54] and column 1, line 2, change "OR" to --OF--.

Signed and Sealed this

Thirty-first Day of May, 1994

Bruce Lehman

*Attest:*

BRUCE LEHMAN

*Attesting Officer*

*Commissioner of Patents and Trademarks*